US011164532B2

(12) United States Patent
Kwon

(10) Patent No.: US 11,164,532 B2
(45) Date of Patent: Nov. 2, 2021

(54) DISPLAY DEVICE INCLUDING SENSING DEVICE AND DRIVING METHOD THEREOF

(71) Applicant: LG Display Co., Ltd., Seoul (KR)

(72) Inventor: Ki Tae Kwon, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/886,576

(22) Filed: May 28, 2020

(65) Prior Publication Data

US 2020/0394968 A1 Dec. 17, 2020

(30) Foreign Application Priority Data

Jun. 13, 2019 (KR) ..... 10-2019-0070173

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2310/027* (2013.01); *G09G 2310/0286* (2013.01); *G09G 2310/0289* (2013.01); *G09G 2310/08* (2013.01)

(58) Field of Classification Search
CPC ..... G09G 3/3291; G09G 3/3266; G09G 2310/08; G09G 2310/0289; G09G 2310/027; G09G 2310/0286
See application file for complete search history.

(56) References Cited

U.S. PATENT DOCUMENTS

2005/0162368 A1 7/2005 Yoshida et al.
2008/0007505 A1* 1/2008 Kim ..... G09G 3/3648 345/90
2015/0221275 A1 8/2015 Shin et al.
2018/0130423 A1 5/2018 Kim et al.
2020/0020280 A1 1/2020 Han et al.

FOREIGN PATENT DOCUMENTS

EP 3611717 2/2020
KR 10-2015-0072704 A 6/2015
KR 10-2015-0079273 A 7/2015
KR 10-2016-0078781 A 7/2016
KR 10-2017-0081088 A 7/2017

OTHER PUBLICATIONS

Search Report dated Nov. 10, 2020 issued in the corresponding United Kingdom Patent Application No. GB 2007268.2 (4 pages).

* cited by examiner

*Primary Examiner* — Temesghen Ghebretinsae
*Assistant Examiner* — Ivelisse Martinez Quiles
(74) *Attorney, Agent, or Firm* — Polsinelli PC

(57) ABSTRACT

A display device receives a feedback signal for a pulse signal supplied to a display panel, senses a pulse width of a scan signal, and changes one or both of a pulse width of the shift clock and a pulse voltage of the shift clock for each screen position of the display panel in response to a pulse width of the feedback signal.

20 Claims, 42 Drawing Sheets

| | 255G | 191G | 127G | 63G | 31G |
|---|---|---|---|---|---|
| Bottom | 670 | 330 | 131 | 26.0 | 4.80 |
| Middle | 600 | 317 | 129 | 27.0 | 5.00 |
| Top | 585 | 315 | 135 | 31.0 | 6.20 |

단위 : nit

| Vertical Count | VGL |
|---|---|
| 1 | -8.00 |
| 300 | -7.95 |
| 600 | -7.90 |
| 900 | -7.85 |
| 1200 | -7.80 |
| ⋮ | ⋮ |
| 1700 | -7.70 |
| 2000 | -7.65 |
| 2300 | -7.60 |
| 2600 | -7.55 |
| 2880 | -7.50 |

FIG. 44

| | VDD & VGL Fixation | | | VDD & VGL Modulation | | |
|---|---|---|---|---|---|---|
| Measurement Position | Luminance | x | y | Luminance | x | y |
| P1 | 556.2 | 0.3038 | 0.3222 | 514.7 | 0.3029 | 0.3221 |
| P2 | 573.4 | 0.3037 | 0.3254 | 528.6 | 0.3031 | 0.3237 |
| P3 | 586.9 | 0.3031 | 0.3268 | 534.0 | 0.3029 | 0.3247 |
| P4 | 500.6 | 0.3008 | 0.3172 | 507.4 | 0.3005 | 0.3195 |
| P5 | 520.0 | 0.3005 | 0.3197 | 520.0 | 0.3002 | 0.3214 |
| P6 | 522.9 | 0.2997 | 0.3174 | 527.6 | 0.2996 | 0.3191 |
| P7 | 514.4 | 0.2983 | 0.3221 | 507.6 | 0.298 | 0.3224 |
| P8 | 526.2 | 0.2976 | 0.3226 | 520.2 | 0.2973 | 0.3234 |
| P9 | 538.5 | 0.2973 | 0.3221 | 532.3 | 0.2971 | 0.3228 |
| min/max | 85.30 | 97.86 | 97.06 | 95.02 | 98.02 | 98.28 |

FIG. 45

| | VDD & VGL Fixation | | | VDD & VGL Modulation | | |
|---|---|---|---|---|---|---|
| Measurement Position | Luminance | x | y | Luminance | x | y |
| P1 | 5.28 | 0.3079 | 0.3253 | 4.87 | 0.3089 | 0.3466 |
| P2 | 5.42 | 0.3080 | 0.3270 | 5.03 | 0.3091 | 0.3491 |
| P3 | 5.25 | 0.3077 | 0.3265 | 4.80 | 0.3087 | 0.3478 |
| P4 | 5.15 | 0.3055 | 0.3222 | 4.99 | 0.3067 | 0.3440 |
| P5 | 5.27 | 0.3056 | 0.3228 | 5.05 | 0.3069 | 0.3440 |
| P6 | 4.92 | 0.3043 | 0.3165 | 4.82 | 0.3059 | 0.3391 |
| P7 | 6.90 | 0.3037 | 0.3326 | 5.05 | 0.3043 | 0.3368 |
| P8 | 6.84 | 0.3031 | 0.3298 | 5.02 | 0.3037 | 0.3440 |
| P9 | 6.53 | 0.3025 | 0.3264 | 4.83 | 0.3032 | 0.3407 |
| min/max | 71.39 | 98.21 | 95.16 | 95.05 | 98.09 | 97.14 |

DISPLAY DEVICE INCLUDING SENSING DEVICE AND DRIVING METHOD THEREOF

CROSS REFERENCE TO RELATED APPLICATION

This application claims priority to and the benefit of Korean Patent Application No. 10-2019-0070173, filed Jun. 13, 2019, the disclosure of which is hereby incorporated by reference in its entirety.

BACKGROUND

Field of the Disclosure

The present disclosure relates to a display device configured to sense electrical characteristics of a driving element and compensating for a deviation or change of the electrical characteristics and a driving method thereof.

Description of the Background

An electroluminescence display is classified as an inorganic light-emitting display device and an organic light-emitting display device according to the material of a light emission layer. An active-matrix-type organic light-emitting display device includes an organic light-emitting diode (OLED) that emits light by itself and has advantages in terms of a fast response rate, high light emission efficiency, high luminance, and a large viewing angle. An organic light-emitting display device has OLEDs formed in pixels. An organic light-emitting device can represent a black grayscale level as perfect black as well as having a fast response rate, high light emission efficiency, high luminance, and a large viewing angle, and thus has an excellent contrast ratio and color gamut.

An organic light-emitting display device does not require a backlight unit and may be implemented on a flexible plastic substrate, a thin glass substrate, or a metal substrate. Accordingly, a flexible display may be implemented as an organic light-emitting display device.

A flexible display may have a screen that is variable in size and form by winding, folding, or bending a display panel. A flexible display may be implemented as a rollable display, a bendable display, a foldable display, a slidable display, or the like. Such a flexible display device may be applicable to a TV, a vehicle display, a wearable device, and the like in addition to a mobile device such as a smart phone and a tablet PC, and the field of application is expanding.

The pixels of an organic light-emitting display device include an OLED, a driving element for driving the OLED by adjusting current flowing through the OLED according to a gate-source voltage Vgs, a storage capacitor for maintaining the gate voltage of the driving device, and the like.

The driving element may be implemented as a transistor. In order to uniformize the image quality of the entire screen of an organic light-emitting display device, a driving element may have uniform electrical characteristics for each pixel. Due to a process deviation and a device characteristic deviation caused in a manufacturing process for a display panel, there may be differences between electrical characteristics of driving elements of pixels, and these differences may increase as the driving time of the pixels elapses. In order to compensate for the electrical characteristic deviation of driving elements of pixels, an internal compensation technique or an external compensation technique may be applied to an organic light-emitting display device.

SUMMARY

The internal compensation technique uses an internal compensation circuit embedded in each pixel to sense the threshold voltage of the driving element for each sub-pixel and compensate the threshold voltage for the gate-source voltage Vgs of the driving element.

The external compensation technique uses an external compensation circuit to sense the current or voltage of the driving element that changes according to the electrical characteristics of the driving element. The external compensation technique compensates for the deviations (changes) in the electrical characteristics of the driving element of each pixel by modulating the pixel data (digital data) of the input image by the electrical characteristic deviations (changes) of the driving element which are sensed for each pixel.

In order to drive pixels of an organic light-emitting display device, voltages such as a pixel driving voltage VDD and a low-potential power supply voltage VSS are applied in common to the pixels. However, these voltages VDD and VSS have voltage drop amounts varying depending on the position in a screen by IR drop. When VDD changes, the gate-source voltage Vgs and the drain-source current Ids of the driving element, which drives the OLED, change, and thus the luminance change of pixels may occur.

In the case of the internal compensation technique, all pixels should have the same sensing period in which the threshold voltage of a driving element is sensed. However, when the on-time of a gate signal varies depending on the pixels, the sensing period is changed. The gate signal on-time is determined according to the pulse width of the gate signal. The on-time of the gate signal may vary depending on a resistor-capacitor (RC) delay of a shift clock line applied to a gate driving circuit. For example, the sensing period may be reduced in pixels at a position where the RC delay of the shift clock line is large. In a display panel, a line through which a clock or an analog voltage is applied may have an RC delay. When the sensing signal varies depending on the pixels, the threshold voltage of the driving element is not accurately sensed.

According to the experimental measurements, in the case of an organic light-emitting display device, the influence of IR drop, which causes luminance fluctuation for each grayscale level of pixel data, is changed. For a high grayscale level, the amount of current flowing through an OLED is high, and thus the amount of IR drop is high. The amount of IR drop increases as the distance between a pixel and a drive IC increases. For a low grayscale level, the amount of IR drop is small because the amount of current flowing through an OLED is small. According to the experimental result, in the case of a low grayscale level, a decrease in luminance due to a decrease in the sensing period is greater than a decrease in luminance due to the IR drop.

The present disclosure is directed to solving the aforementioned needs and/or problems.

The present disclosure provides a display device capable of reducing a difference in luminance between pixels due to a sensing period deviation and a driving method thereof.

It should be noted that objectives of the present disclosure are not limited to the above-described objective, and other objectives that are not described herein will be apparent to those skilled in the art from the following descriptions.

According to an aspect of the present disclosure, there is provided a display device including a display panel in which data lines and gate lines intersect each other and in which pixels are disposed in a matrix form; a gate driving unit formed on the display panel and configured to supply a scan signal to the gate lines; a shift clock line formed on the display panel and configured to supply a shift clock to the gate driving unit; a sensing device configured to receive a feedback signal for a pulse signal supplied to the display panel and sense a pulse width of the scan signal; and a driving device configured to supply a data voltage to the data lines and generate the shift clock.

The driving device changes one or both of a pulse width of the shift clock and a pulse voltage of the shift clock for each screen position of the display panel in response to a pulse width of the feedback signal sensed by the sensing device.

According to another aspect of the present disclosure, there is provided a driving method of a display device, the driving method including receiving a feedback signal for a pulse signal supplied to the display panel and sense a pulse width of the scan signal; and changing one or both of a pulse width of the shift clock and a pulse voltage of the shift clock for each screen position of the display panel in response to a pulse width of the feedback signal sensed.

BRIEF DESCRIPTION OF THE DRAWINGS

The above and other objects, features and advantages of the present disclosure will become more apparent to those of ordinary skill in the art by describing exemplary aspects thereof in detail with reference to the attached drawings, in which:

FIG. 44 is a diagram of a luminance measurement result showing an improvement in luminance uniformity of a screen at higher grayscale levels when a pixel driving voltage and a gate-on voltage are modulated in the same way as that of an aspect of the present disclosure;

FIG. 45 is a diagram of a luminance measurement result showing an improvement in luminance uniformity of a screen in lower grayscale levels when a pixel driving voltage and a gate-on voltage are modulated in the same way as that of an aspect of the present disclosure.

DETAILED DESCRIPTION

Figure 1:
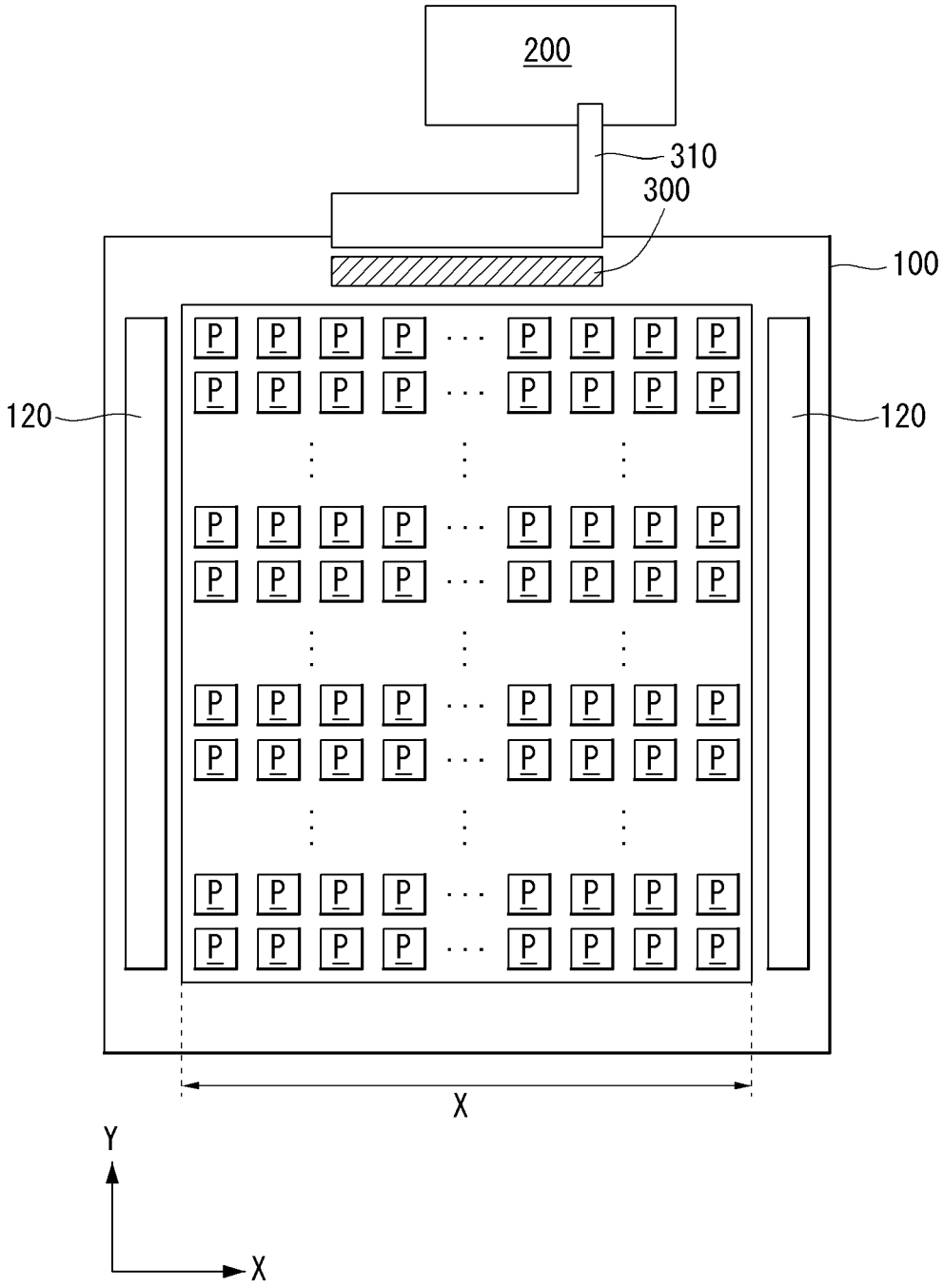
FIG. 1 is a block diagram showing a display device according to an aspect of the present disclosure.

Advantages and features of the present disclosure, and implementation methods thereof will be clarified through the following aspects described with reference to the accompanying drawings. However, the present disclosure is not limited to the following aspects but will be implemented in various forms. The exemplary aspects of the present disclosure make disclosure of the present disclosure thorough and are provided so that the scope of the present disclosure is fully conveyed to those skilled in the art. Therefore, the present disclosure will be defined by the scope of the appended claims.

The figures, dimensions, ratios, angles, numbers, and the like disclosed in the drawings for describing the aspects of the present disclosure are merely illustrative and are not limited to matters shown in the present disclosure. Like reference numerals refer to like elements throughout. Further, in describing the present disclosure, detailed descriptions on well-known technologies will be omitted when it is determined that they may unnecessarily obscure the gist of the present disclosure. Terms such as "including" and "having" used herein are intended to allow other elements to be added unless the terms are used with the term "only." Any references to the singular may include the plural unless expressly stated otherwise.

Components are interpreted to include an ordinary error range even if not expressly stated.

For description of a positional relationship, for example, when the positional relationship between two parts is described as "on," "above," "below," and "next to," etc., one or more parts may be interposed therebetween unless the term "immediately" or "directly" is used in the expression.

In the description of aspects, terms such as first, second, etc. are used to describe various elements, but these elements are not limited by these terms. These terms are used only to distinguish one element from another. Therefore, a first element discussed below could be termed a second element without departing from the teachings of the present disclosure.

Like reference numerals refer to like elements throughout.

The features of various aspects may be partially or entirely bonded to or combined with each other. The aspects may be interoperated and performed in technically various ways and may be carried out independently of or in association with each other.

Each of a gate driving unit and a pixel circuit in a display device of the present disclosure may include multiple transistors. Each transistor may be implemented as an oxide thin-film transistor (TFT) including an oxide semiconductor, a low-temperature polysilicon (LTPS) TFT including LTPS, and the like. Each transistor may be implemented as a transistor with a p-channel or n-channel metal-oxide-semiconductor field-effect transistor (MOSFET) structure. The following aspects will be described focusing on an example in which the transistors of the pixel circuit are implemented as p-channel transistors, but the present disclosure is not limited thereto.

A transistor is a three-electrode element including a gate, a source, and a drain. The source is an electrode through which carriers are supplied to the transistor. In the transistor, carriers begin to flow from the source. The drain is an electrode through which carriers exit the transistor. The flow of carriers in the transistor is from the source to the drain. In the case of an n-channel transistor, the carriers are electrons. Thus, the source voltage is lower than the drain voltage so that the electrons may flow from the source to the drain. In an n-channel transistor, current flows from the drain to the source. In the case of a p-channel transistor, the carriers are holes. Thus, the source voltage is higher than the drain voltage so that the holes may flow from the source to the drain. Since the holes in the p-channel transistor flow from the source to the drain, current flows from the source to the drain. It should be noted that the source and drain of the transistor are not fixed. For example, the source and drain may be changed depending on an applied voltage. Accordingly, the present disclosure is not limited by the source and drain of the transistor. In the following description, the source and drain of the transistor will be referred to as first and second electrodes, respectively.

A gate signal swings between a gate-on voltage and a gate-off voltage. The gate-on voltage is set to be a voltage higher than the threshold voltage of the transistor, and the gate-off voltage is set to be a voltage lower than the threshold voltage of the transistor. The transistor is turned on in response to the gate-on voltage while the transistor is turned off in response to the gate-off voltage. In the case of an n-channel transistor, the gate-on voltage may be a gate high voltage VGH/VEH, and the gate-off voltage may be a gate low voltage VGL/VEL. In the case of a p-channel transistor, the gate-on voltage may be a gate low voltage VGL/VEL, and the gate-off voltage may be a gate high voltage VGH/VEH.

Each of the pixels of the present disclosure includes a light-emitting element, a driving element configured to adjust current flowing through the light-emitting element according to a gate-source voltage, and an internal compensation circuit configured to sense the threshold voltage of the driving element at a sensing period defined by a pulse of the scan signal and supply the threshold voltage to a capacitor. The internal compensation circuit includes a capacitor connected to the gate of the driving element and one or more switch elements configured to connect the capacitor to the driving element and the light-emitting element. The internal compensation circuit may include multiple switch elements and capacitors shown in FIGS. 11 and 12.

The display device of the present disclosure includes a sensing device configured to receive a feedback signal for a pulse supplied to a display panel and sense a pulse width of a scan signal and a driving device configured to supply a data voltage to data lines and generate a shift clock. In response to a pulse width of a feedback signal sensed by the sensing device in real time, the driving device changes one or both of a pulse width of a shift clock and a pulse voltage of the shift clock on the basis of screen positions of the display panel.

In the following aspect, the driving device will be described as a drive integrated circuit (IC). Also, in the following aspect, the feedback signal may be a feedback signal for a shift clock supplied to a shift clock line connected to the gate driving unit or a feedback signal for a pulse applied to a test data line.

Hereinafter, various aspects of the present disclosure will be described in detail with reference to the accompanying drawings.

Referring to FIGS. 1 to 4, the display device of the present disclosure includes a display panel 100 and display panel driving units 120 and 300.

The display panel driving units 120 and 300 write pixel data of an input image to pixels of a screen and display the image on the screen. The display panel driving units 120 and 300 include a gate driving unit 120 configured to supply a gate signal to gate lines GL1 and GL2 of the display panel 100, a data driving unit 306 configured to convert pixel data into a voltage of a data signal and supply the voltage to data lines through activated data output channels, and a timing controller 303 configured to control operation timing of the data driving unit 306 and the gate driving unit 120. The data driving unit 306 and the timing controller 303 may be integrated into a drive IC 300. The drive IC 300 may be referred to as "driving unit" 300.

The screen of the display panel 100 includes data lines DL1 to DL6, gate lines GL1 and GL2 intersecting the data lines DL1 to DL6, and a pixel array in which pixels P are arranged in a matrix form. The pixels P are arranged in the pixel array in a matrix form defined by the data lines DL1 to DL6 and the gate lines GL1 and GL2.

For color representation, each of the pixels P includes sub-pixels with different colors. The sub-pixels include a red sub-pixel RED (hereinafter referred to as an "R sub-pixel"), a green sub-pixel GREEN (hereinafter referred to as a "G sub-pixel"), and a blue sub-pixel BLUE (hereinafter referred to as a "B sub-pixel"). Although not shown, each of the pixels may further include a white sub-pixel. The sub-pixels are arranged in a matrix form defined by the data lines DL1 to DL6 and the gate lines GL1 and GL2. Hereinafter, a pixel may be interpreted as a sub-pixel.

Each of the sub-pixels may include an internal compensation circuit configured to sense electrical characteristics, e.g., the threshold voltage, of the driving element, and compensate for the gate voltage of the driving element.

Figure 2:
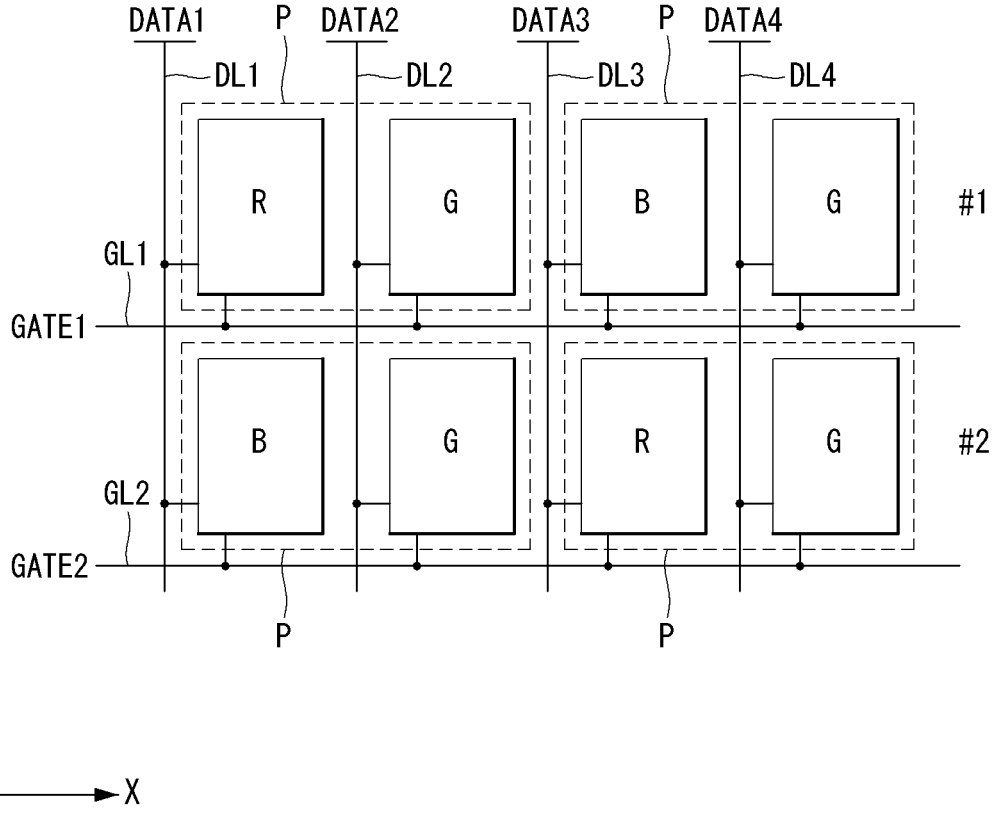
FIG. 2 is a diagram showing an example of a pentile pixel arrangement.

The pixels P may be arranged in the form of real color pixels or pentile pixels. The pentile pixels may implement higher resolution than the real color pixels by driving two sub-pixels with different colors as one pixel P, as shown in FIG. 2, by using a preset pentile pixel rendering algorithm. The pentile pixel rendering algorithm compensates for the lack of color in each pixel P with the color of light emitted in an adjacent pixel P.

Figure 3:
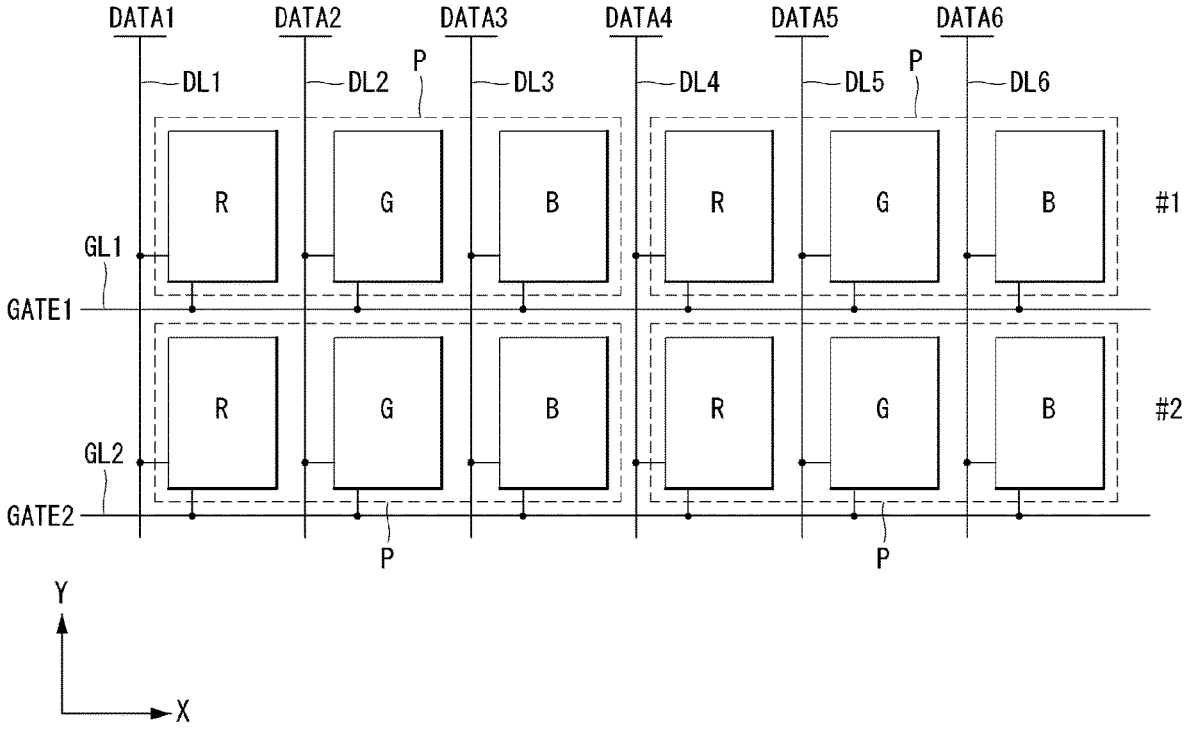
FIG. 3 is a diagram showing an example of a real pixel arrangement.

For the real color pixels, one pixel P is composed of R, G, and B sub-pixels, as shown in FIG. 3.

When the resolution of the pixel array is N*M, the pixel array includes N pixel columns COLUMN and M pixel lines intersecting the pixel columns. The pixel columns include pixels arranged in the y-axis direction. The pixel lines include pixels arranged in the x-axis direction. In FIGS. 2 and 3, #1 and #2 indicate pixel line numbers. One horizontal period 1H is a time period obtained by dividing one frame period by M, which is the number of pixel lines. The gate driving unit 120 may progressively scan the pixels in units of one line by outputting a gate signal in a sequence from a first pixel line to an $M^{th}$ pixel line. The pixels in one pixel lines may operate for initialization, sensing, and data writing within one horizontal period.

The pixel array of the display panel 100 may be formed on a glass substrate, a metal substrate, or a plastic substrate. A plastic OLED panel may be implemented as a flexible panel by forming the pixel array on the plastic substrate. The plastic OLED panel has a pixel array formed on an organic thin film adhered to a back plate. A touch sensor array may be formed above the pixel array.

The back plate may be a polyethylene terephthalate (PET) substrate. The organic thin film is formed on the back plate. A pixel array and a touch sensor array may be formed on the organic thin film. The back plate blocks permeation of moisture to the organic thin film so that the pixel array is not exposed to humidity. The organic thin film may be a thin polyimide (PI) film substrate. A multilayer buffer film may be formed on the organic thin film and formed of an insulating material (not shown). Lines for supplying power or signals applied to the pixel array and the touch sensor array may be formed on the organic thin film.

The gate driving unit 120 may be mounted on the substrate of the display panel 100 together with the pixel array. The gate driving unit 120 which is directly formed on the substrate of the display panel 100 is known as a gate-in-panel (GIP) circuit.

The gate driving unit 120 may be disposed at one of left and right bezels BEZEL of the display panel 100 to supply a gate signal to the gate lines GL1 and GL2 in a single-feeding manner. In this case, one of two gate driving units 120 shown in FIG. 1 is not required.

The gate driving units 120 may be disposed at left and right bezels of the display panel 100 to supply a gate signal to the gate lines GL1 and GL2 in a double-feeding manner. In the double-feeding manner, a gate signal may be simultaneously applied to both ends of one gate line.

The gate driving unit 120 is driven according to a gate timing signal supplied from the drive IC 300 using a shift register to sequentially supply gate signals GATE1 and GATE2 to gate lines GL1 and GL2. The shift register may sequentially supply the gate signals GATE1 and GATE2 to the gate lines GL1 and GL2 by shifting the gate signals GATE1 and GATE2. The gate signals GATE1 and GATE2 may include scan signals SCAN1, SCAN2, SCAN(N−1), and SCAN(N), emission control signals EM and EM(N), and the like shown in FIGS. 11 and 12. In the following description, an emission control signal is referred to as an EM signal.

The drive IC 300 is connected to the data lines DL1 to DL6 through data output channels to supply the voltage of the data signal (hereinafter referred to as "data voltage") to the data lines DL1 to DL6. The drive IC 300 may output a gate timing signal for controlling the gate driving unit 120 through gate timing signal output channels.

Figure 4:
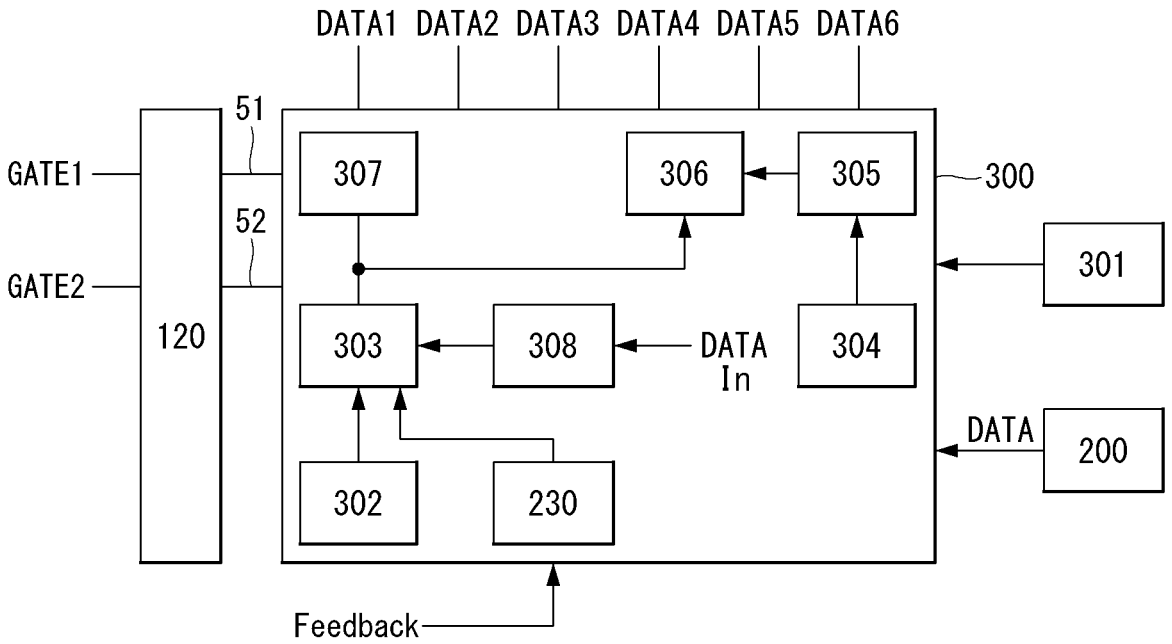
FIG. 4 is a block diagram showing a drive integrated circuit (IC) configuration shown in FIG. 1.

The drive IC 300 may be connected to a host system 200, a first memory 301, and the display panel 100 as shown in FIG. 4. The drive IC 300 may include data reception and computation unit 308, a timing controller 303, and a data driving unit 306. The drive IC 300 may further include a gamma compensation voltage generation unit 305, a power supply unit 304, a second memory 302, a level shifter 307, and the like. The drive IC 300 may further include a sensing unit 230 connected between the timing controller 303 and a feedback line 52 of the display panel 100.

The timing controller 303 provides pixel data of an input image received from the host system 200 to the data driving unit 306. The timing controller 303 may generate a gate timing signal for controlling the gate driving unit 120 and a source timing signal for controlling the data driving unit 306 to control operation timing of the gate driving unit 120 and the data driving unit 306.

The sensing unit 230 senses a sensing period for each position of the screen on the basis of the feedback signal received through the feedback line 52. The sensing period is defined by the pulse width of the scan signal. The pulse of the scan signal may be generated with the same pulse width and voltage as those of the pulse of the shift clock GCLK input to the gate driving unit 120. The sensing unit 230 senses the sensing period of the pixel for each position of the screen by measuring a resistor-capacitor (RC) delay of a pulse for each position of the screen from a feedback signal for a separate pulse signal or a pulse of the shift clock GCLK. The feedback signal is fed back to the sensing unit 230 through the feedback line 52 formed on the display panel 100.

The timing controller 303 may change the pulse width or voltage of the shift clock applied to the gate driving circuit in consideration of a sensing period deviation of a pixel P for each position of the screen which is sensed by the sensing unit 230 in real time. As a result, it is possible to realize uniform image quality across the screen by accurately sensing electrical characteristics of the driving element in all pixels of an even display panel having an RC delay of a shift clock line.

The drive IC 300 may generate gate timing signals for driving the gate driving unit 120 through the level shifter 307 and the timing controller 303. The gate timing signals include gate timing signals such as a start pulse VST, a shift clock GCLK, and the like and gate voltages such as a gate-on voltage VGL/VEL and a gate-off voltage VGH/VEH. The start pulse VST and the shift clock GCLK swing between the gate-on voltage VGL/VEL and the gate-off voltage VGH/VEH.

The data reception and computation unit 308 includes a reception unit configured to receive input data input as a digital signal from the host system 200 and a data computation unit configured to modulate pixel data of an input image signal input through the reception unit using a preset image quality algorithm to improve image quality. The data computation unit may include a data restoration unit configured to perform restoration by decoding compressed pixel data, an optical compensation unit configured to add a preset optical compensation value to the pixel data, etc. The optical compensation value may be set as a value for compensating for luminance of each pieces of pixel data on the basis of the luminance of the screen which is measured on the basis of a camera image captured in a manufacturing process.

The data driving unit 306 converts pixel data (a digital signal) received from the timing controller 303 into a gamma compensation voltage using a digital-to-analog converter (hereinafter referred to as "DAC") and outputs the voltage of data signals DATA1 to DATA6 (hereinafter referred to as data voltages). The data voltage output from the data driving unit 306 is supplied to the data lines DL1 to DL6 of the pixel array through an output buffer (a source AMP) connected to the data channels of the drive IC 300.

The gamma compensation voltage generation unit 305 generates a gamma compensation voltage for each grayscale level by dividing a gamma reference voltage received from the power supply unit 304 through a voltage divider circuit. The gamma compensation voltage is an analog voltage in which a voltage is set for each grayscale level of the pixel data. The gamma compensation voltage output from the gamma compensation voltage generation unit 305 is provided to the data driving unit 306.

The level shifter 307 converts the low-level voltage of the gate timing signal received from the timing controller 303 into the gate-on voltage VGL/VEL and converts the high-level voltage of the gate timing signal into the gate-off voltage VGH/VEH. The level shifter 307 outputs the gate timing signal and the gate voltages VGH/VEH and VGL/VEL through the gate timing signal output channels and supplies the gate timing signal and the gate voltages VGH and VGL to the gate driving unit 120.

The power supply unit 304 generates power necessary to drive the drive IC 300, the gate driving unit 120, and the pixel array of the display panel 100 using a DC-DC converter. The DC-DC converter may include a charge pump, a regulator, a buck converter, a boost converter, and the like. The power supply unit 304 may generate DC voltages such as a gamma reference voltage, a gate-on voltage VGL/VEL, a gate-off voltage VGH/VEH, a pixel driving voltage VDD, a low-potential power supply voltage ELVSS, an initialization voltage Vini, a reference voltage Vref, and the like by adjusting a DC input voltage received from the host system 200. The gamma reference voltage is supplied to the gamma compensation voltage generation unit 305. The gate-on voltage VGL and the gate-off voltage VGH are supplied to the level shifter 307 and the gate driving unit 120, respectively. The pixel power voltage such as the pixel driving voltage VDD, the low-potential power supply voltage ELVSS, and the initialization voltages Vini and Vref are supplied in common to the pixels P.

The gate voltages VGH/VEH and VGL/VEL may be set to be 8 V and −7 V, and the pixel power voltages VDD, VSS, and Vini (or Vref) may be set to be 4.6 V, −2 V to −3 V, and −3 V to −4 V, but the present disclosure is not limited thereto. The data voltage Vdata may be set to be 3 V to 6 V, but the present disclosure is not limited thereto.

Figure 41:
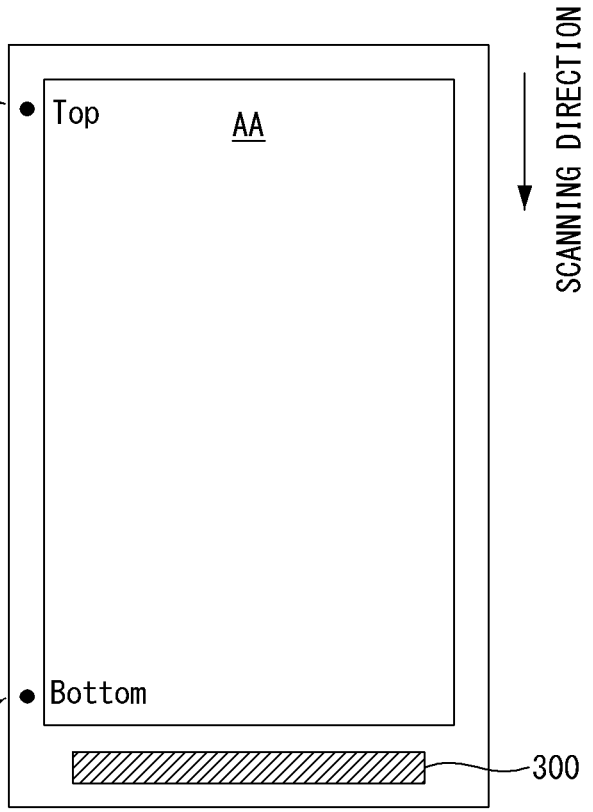
FIG. 41 is a diagram illustrating a gate-on voltage with a voltage level different for each position in a screen.

The power supply unit 304 may change the gate-on voltage VGL under the control of the timing controller 303. For example, the gate-on voltage VGL may be changed in the range of −7.5 V and −8.0 V, as shown in FIG. 41.

Vini or Vref is lower than VDD and is set to be a DC voltage lower than the threshold voltage of the light-emitting element (OLED) to suppress light emission of the light-emitting element (OLED).

When power is input to the drive IC 300, the second memory 302 stores a compensation value, register setting data, etc. which are received from the first memory 301. The compensation value may be applied to various algorithms for improving image quality. The compensation value may include an optical compensation value.

The register setting data defines operation of the data driving unit 306, the timing controller 303, the gamma compensation voltage generation unit 305, and the like. The first memory 301 may include a flash memory. The second memory 302 may include a static RAM (SRAM).

The host system 200 may be any one of a television (TV) system, a set-top box, a navigation system, a personal computer (PC), a home theater system, a mobile system, and a wearable system.

In the mobile system, the host system 200 may be implemented as an application processor (AP). The host system 200 may transmit the pixel data of the input image to the drive IC through a mobile industry processor interface (MIPI). The host system 200 may be connected to the drive IC 300 through a flexible printed circuit board, e.g., a flexible printed circuit (FPC) 310.

Figure 5:
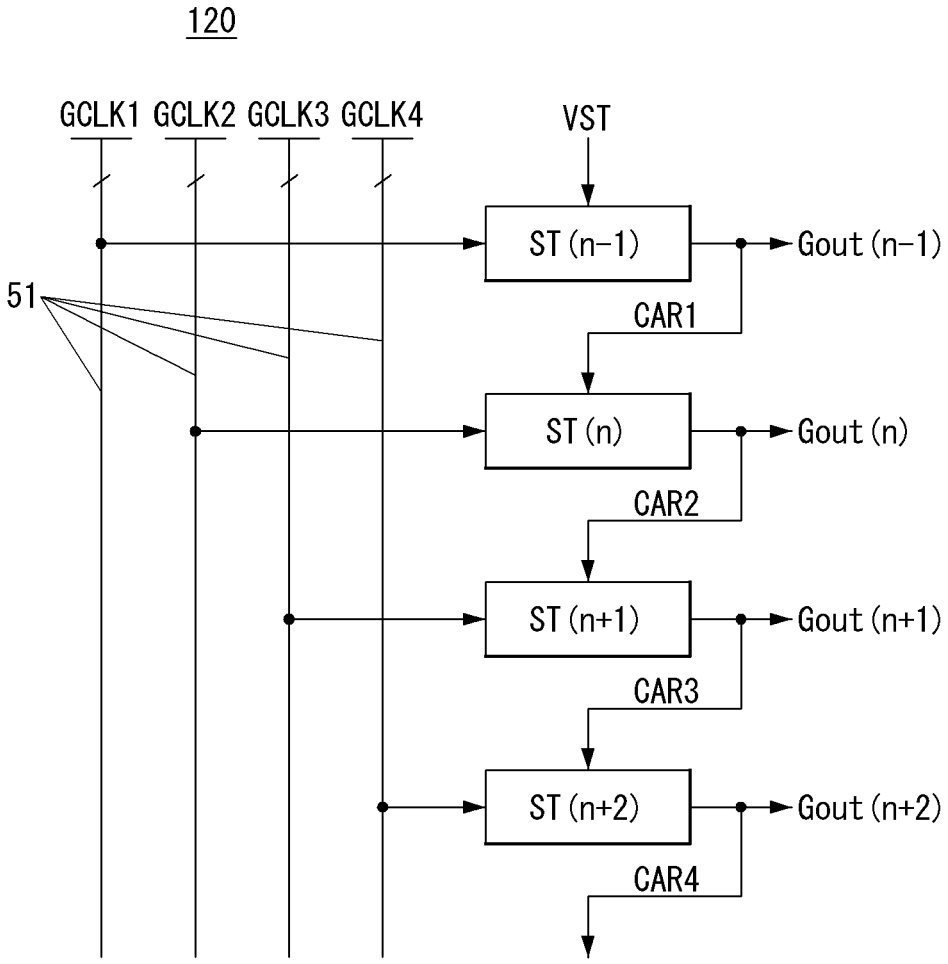
FIG. 5 is a diagram schematically showing a circuit configuration of a shift register in a gate driving unit.
Figure 6A:
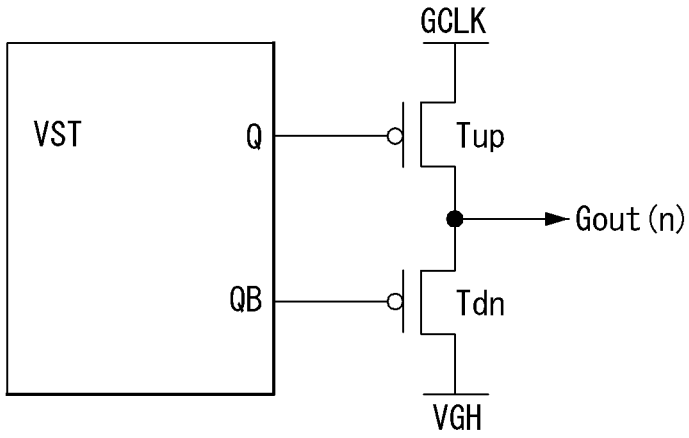
FIG. 6A is a diagram schematically showing a pass gate circuit and an edge trigger circuit.
Figure 6B:
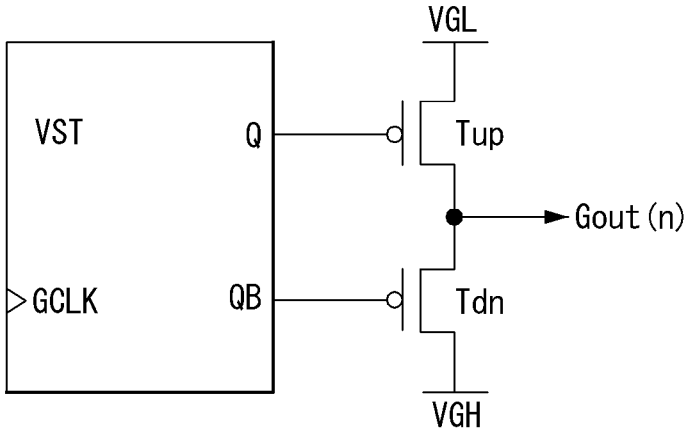
FIG. 6B is a diagram schematically showing a pass gate circuit and an edge trigger circuit.
Figure 7:
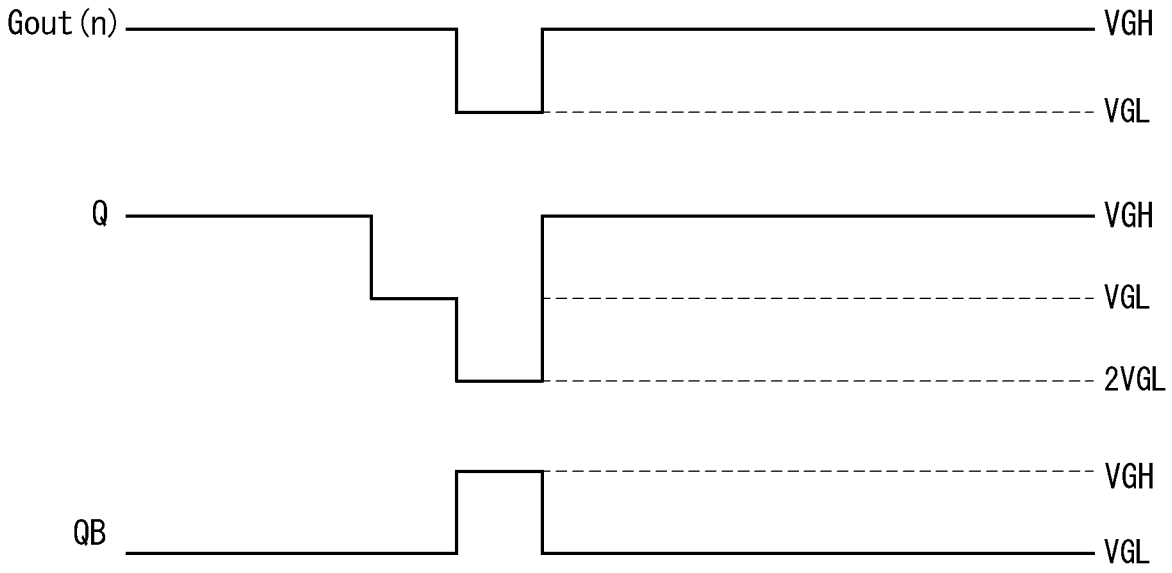
FIG. 7 is a waveform diagram showing a Q node voltage, a QB node voltage, and an output voltage of an $N^{th}$ stage shown in FIG. 6.

FIG. 5 is a diagram schematically showing a circuit configuration of a shift register in a gate driving unit. FIGS. 6A and 6B are diagrams schematically showing a pass gate circuit and an edge trigger circuit. FIG. 7 is a waveform diagram showing a Q node voltage, a QB node voltage, and an output voltage of an $N^{th}$ stage shown in FIG. 6.

Figure 11:
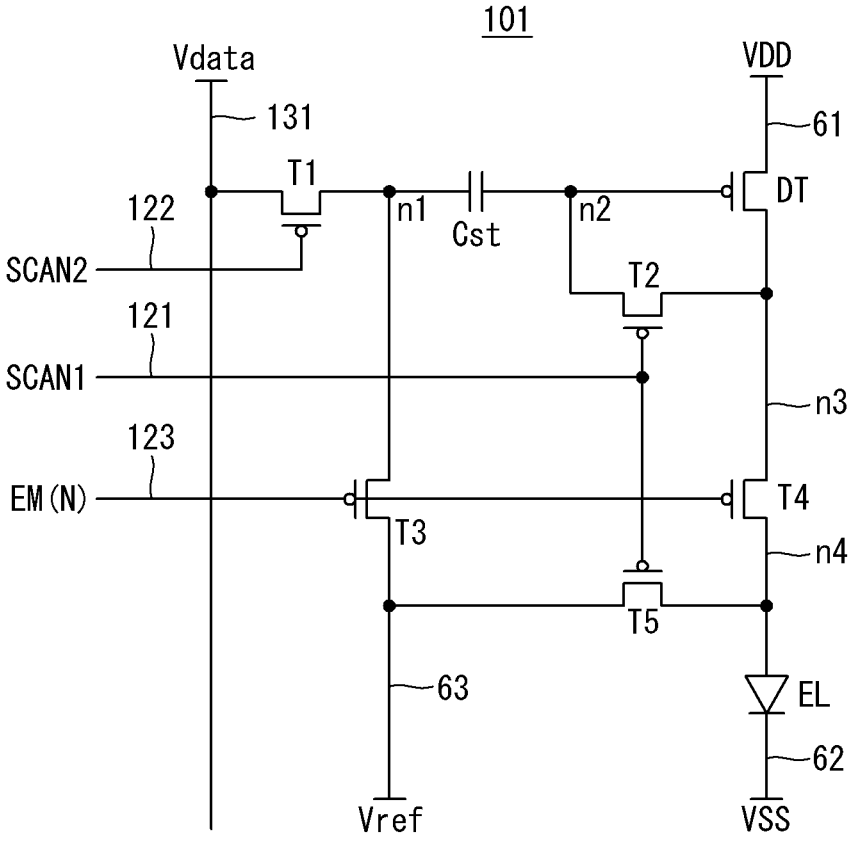
FIG. 11 is a circuit diagrams specifically showing a pixel circuit shown in FIG. 10.
Figure 12:
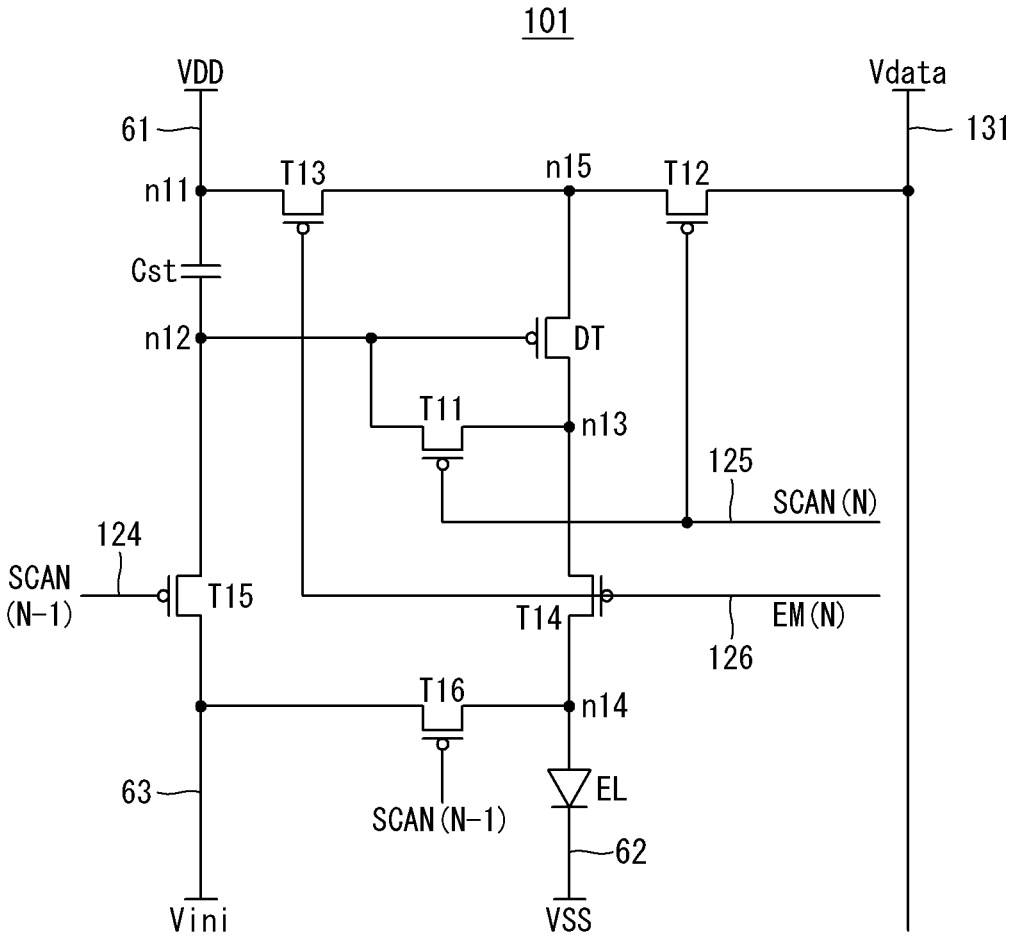
FIG. 12 is a circuit diagram specifically showing a pixel circuit shown in FIG. 10.

Referring to FIG. 5, the shift register of the gate driving unit 120 includes stages ST(n−1) to ST(n+2) which are connected in cascade. The shift register receives a start pulse VST or carry signals CAR1 to CAR4 received from the previous stage as a start pulse and generates outputs Gout (n−1) to Gout(n+2) in synchronization with rising edges of shift clocks GCLK1 to GCLK4. The shift clocks GCLK1 to GCLK4 are input to stages ST(n−1) to ST(n+2) through shift clock lines 51. In FIGS. 11 and 12, the output signals Gout(n−1) to Gout(n+2) of the shift register may be gate signals SCAN1, SCAN2, SCAN(N−1), SCAN(N), EM, and EM(N).

Each of the stages of the shift register may be implemented as a pass gate circuit as shown in FIG. 6A or an edge trigger circuit as shown in FIG. 6B.

In the pass gate circuit, a clock GCLK is input to a pull-up transistor Tup which is turned on or off according to the voltage of the Q node. In contrast, the gate-on voltage VGL is supplied to the pull-up transistor Tup of the edge trigger circuit, and the start pulse VST and the shift clocks GCLK to GCLK4 are input to the pull-up transistor Tup. A pull-down transistor Tdn is turned on or off according to the voltage of the QB node. In the pass gate circuit, the Q node is floating while the voltage of the Q node is changed to the gate-on voltage VGL according to the start pulse. When the shift clock GCLK is applied to the pull-up transistor Tup while the Q node is floating, the voltage of the Q node is changed to 2VGL higher than the gate-on voltage VGL shown in FIG. 7 by bootstrapping, and thus the pull-up transistor Tup is turned on. In this case, the voltage of the output signal Gout(n) is changed to the gate-on voltage VGL.

Since the edge trigger circuit is synchronized with the edge of the clock GCLK such that the voltage of the output signal Gout(n) is changed to the voltage of the start pulse, the output signal Gout(n) is generated in a waveform having the same phase as that of the start pulse. When the start pulse waveform is changed, the waveform of the output signal is changed accordingly. In the edge trigger circuit, the input signal may overlap the output signal.

Figure 8:
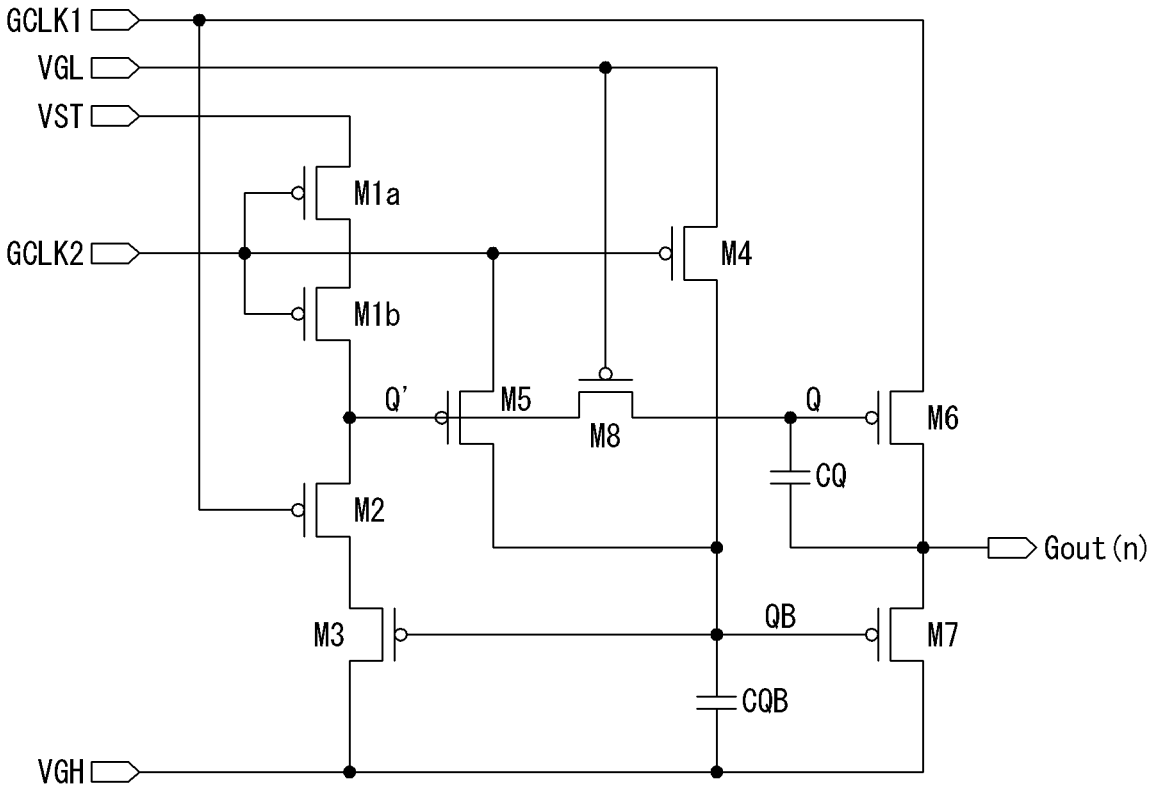
FIG. 8 is a circuit diagram showing one stage circuit in a gate driving unit according to an aspect of the present disclosure.
Figure 9:
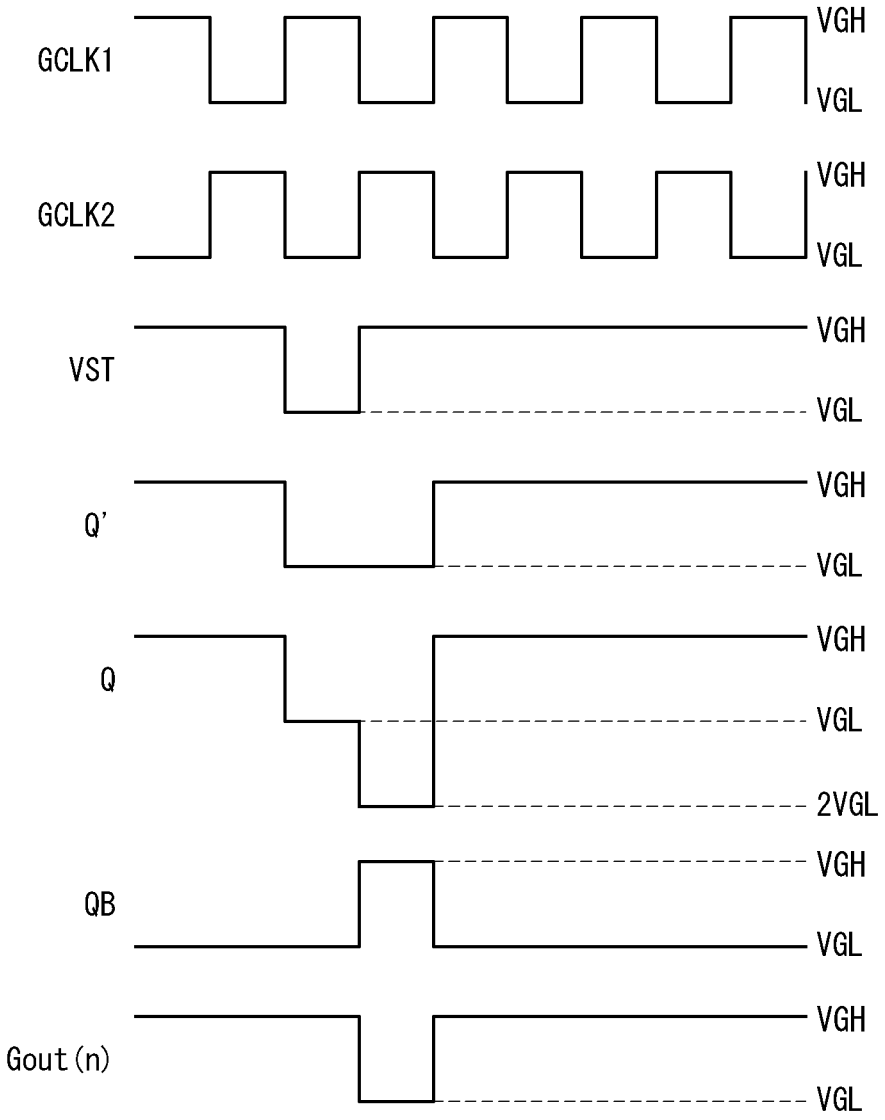
FIG. 9 is a waveform diagram showing input/output waveforms of a circuit shown in FIG. 8.

FIG. 8 is a circuit diagram showing one stage circuit in the gate driving unit 120 according to an aspect of the present disclosure. FIG. 9 is a waveform diagram showing input/output waveforms of a circuit shown in FIG. 8. The circuit of the gate driving unit 120 is not limited to the circuit shown in FIG. 8.

Referring to FIGS. 8 and 9, the gate driving unit 120 includes multiple transistors M1 to M7 and multiple capacitors CQ and CQB.

A first transistor M1*a* or M1*b* is turned on according to the gate-on voltage VGL of a second GCLK node, to which the second shift clock GCLK2 is supplied, to apply a voltage of a signal applied to a VST node to a Q' node. The carry signal received from the previous stage or the start pulse VST is supplied to the VST node. The Q' node and the Q node are charged with the gate-on voltage VGL applied from the first transistor M1*a* or M1*b*. When an eighth transistor M8 is on, the Q node is connected to the Q' node.

The first transistor M1*a* or M1*b* may include two transistors M1*a* and M1*b* connected to each other in a dual gate structure in order to reduce leakage current. The first-a transistor M1*a* includes a gate connected to the second GCLK node, a first electrode connected to the VST node, and a second electrode connected to the first-b transistor M1*b*. The first-b transistor M1*b* includes a gate connected to the second GCLK node, a first electrode connected to the second electrode of the first-a transistor M1*a*, and a second electrode connected to the Q' node.

The second transistor M2 is turned on according to the gate-on voltage VGL of a first GCLK node to which the first shift clock GCLK1 is applied. The third transistor M3 is turned on according to the gate-on voltage VGL of the QB node. When the voltage of the QB node is the gate-on voltage VGL and the voltage of the first GCLK node is the gate-on voltage VGL, the second and third transistors M2 and M3 are turned on. In this case, the Q node and the Q' node are connected to the VGH node, and thus the Q node and the Q' node are charged with the gate-off voltage VGH. The gate-off voltage VGH is supplied to the VGH node. The second transistor M2 includes a gate connected to the first GCLK node, a first electrode connected to the Q' node, and a second electrode connected to the first electrode of the third transistor M3. The third transistor M3 includes a gate connected to the QB node, a first electrode connected to the second electrode of the second transistor M2, and a second electrode connected to the VGH node.

The fourth transistor M4 is turned on according to the gate-on voltage VGL of the second GCLK node to connect the VGL node to the QB node and discharge the voltage of the QB node to VGL. The gate-on voltage VGL is supplied to the VGL node. The fourth transistor M4 includes a gate connected to the second GCLK node, a first electrode connected to the VGL node, and a second electrode connected to the QB node.

The fifth transistor M5 is turned on according to the gate-on voltage VGL of the Q' node to connect the second GCLK node to the QB node. The fifth transistor M5 includes a gate connected to the Q' node, a first electrode connected to the second GCLK node, and a second electrode connected to the QB node. When the gate voltage of the fourth transistor M4 is the gate-on voltage VGL and the gate voltage of the third transistor M3 is the gate-off voltage VGL, the VGL node and the QB node may be short-circuited. In this case, the fifth transistor M5 is turned on to connect to the gate node of the fourth transistor M4 to the VGH node. Thus, by turning off the fourth transistor M4, the short-circuiting of the VL node and the QB node is prevented.

The sixth transistor M6 is a pull-up transistor which is turned on when the voltage of the Q node is changed to a voltage (2VGL) higher than the gate-on voltage VGL by bootstrapping so that the voltage of the output signal Gout (n) is changed to the gate-on voltage VGL. The sixth transistor M6 includes a gate connected to the Q node, a first electrode connected to the first GCLK node, and a second electrode connected to an output node. The output node is connected to a gate line connected to the pixels.

The seventh transistor M7 is a pull-down transistor which is turned on when the voltage of the QB node is the gate-on voltage VGL so that the voltage of the output signal Gout(n) is changed to the gate-off voltage VGH. The seventh transistor M7 includes a gate connected to the QB node, a first electrode connected to an output node, and a second electrode connected to the VGH node.

The eighth transistor M8 is turned on according to the gate-on voltage VGL of the VGL node to connect the Q' node to the Q node. The eighth transistor M8 includes a gate connected to the VGL node, a first electrode connected to the QB node, and a second electrode connected to the Q node. When the voltage of the Q' node is VGL and the voltage of the Q node is 2VGL, the eighth transistor M8 is turned off to separate the Q' node and the Q node.

The first capacitor CQ is formed between the Q node and the output node. The first capacitor CQ is a capacitor for bootstrapping of the Q node. The first capacitor CQ connects the output node and the Q node through capacitor coupling to boost the Q node such that the Q node is charged with 2VGL when the voltage of the output node is charged with VGL of the shift clock GCLK. The second capacitor CQB is formed between the QB node and the VGH node. The second capacitor CQB maintains the voltage of the QB node at the gate-on voltage VGL when the seventh transistor M7 is turned on so that the voltage of the output node is maintained at the gate-off voltage.

The second shift clock GCLK2 may be generated as a clock with a phase opposite to that of the first shift clock GCLK2. As can be seen in FIG. 9, the circuit of the gate driving unit 120 shown in FIG. 8 changes the voltage of the Q node and the QB node to the gate-on voltage VGL when the second shift clock GCLK2 is the gate-on voltage VGL. When the voltage of the Q' node is the gate-on voltage VGL, the fourth and fifth transistors M4 and M5 are turned on, and thus the voltage of the QB node becomes the gate-on voltage VGL.

When the voltage of the Q node is the gate-on voltage VGL and the first shift clock GCLK is changed to the gate-on voltage VGL, the voltage Q of the Q node is changed to 2VGL, and the voltage of the output signal Gout(n) is changed to the gate-on voltage VGL. Subsequently, when the second shift clock GCLK2 is changed to the gate-on voltage VGL, the voltage of the QB node is changed to the gate-on voltage VGL, the voltages of the Q node, the QB node, and the output node are changed to the gate-off voltage VGH.

Figure 10:
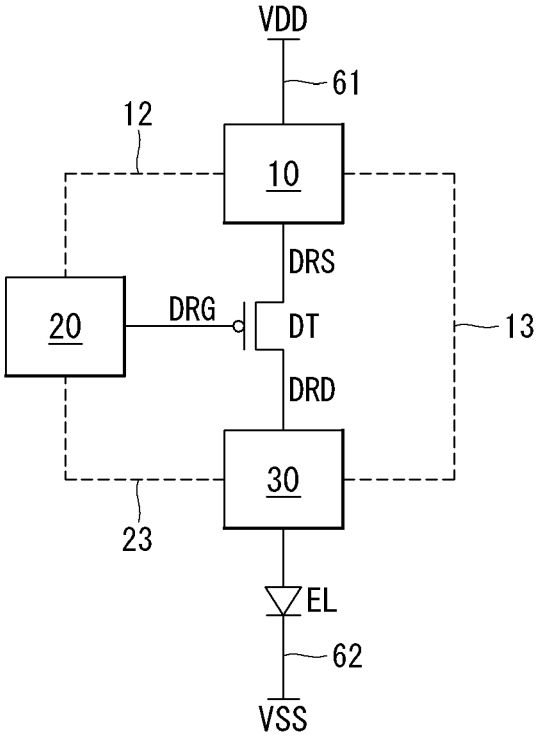
FIG. 10 is a diagram schematically showing a pixel circuit of the present disclosure.

FIG. 10 is a diagram schematically showing a pixel circuit of the present disclosure.

Referring to FIG. 10, the pixel circuit may include first to third circuit units 10, 20, and 30 and first to third connection units 12, 23, and 13. One or more elements may be omitted from or added to the pixel circuit.

The first circuit unit 10 supplies the pixel driving voltage VDD to a driving element DT. The driving element DT may be implemented as a transistor including a gate DRG, a source DRS, and a drain DRD. The second circuit unit 20 charges a capacitor CST connected to the gate DRG of the driving element DT and maintains the voltage of the capacitor CST during one frame period. The third circuit unit 30 provides current supplied from the pixel driving voltage VDD through the driving element DT to the light-emitting element EL to convert the current into light. The first connection unit 12 connects the first circuit unit 10 and the second circuit unit 20. The second connection unit 23 connects the second circuit unit 20 and the third circuit unit 30. The third connection unit 13 connects the third circuit unit 30 and the first circuit unit 10.

This pixel circuit may be implemented as a pixel circuit shown in FIG. 11 or FIG. 12.

FIGS. 11 and 12 are circuit diagrams specifically showing the pixel circuit shown in FIG. 10. The pixel circuits shown in FIGS. 11 and 12 are any sub-pixel circuits belonging to an $N^{th}$ pixel line. The pixel circuits may include an internal compensation circuit configured to sense the threshold voltage Vth of the driving element DT and compensate the threshold voltage Vth for the gate voltage of the driving element DT.

As shown in FIGS. 11 and 12, the display panel may further include a first power supply line 61 for supplying the pixel driving voltage VDD to the pixels P, a second power supply line 62 for supplying the low-potential power supply voltage VSS to the pixels P, and a third power supply line 63 for supplying the initialization/reference voltage Vini and Vref for initializing the pixel circuit to the pixels P. The power supply lines 61, 62, and 63 are connected to output channels of the power supply unit 304.

Referring to FIG. 11, a pixel circuit according to a first aspect of the present disclosure includes a light-emitting element EL, multiple transistors T1 to T5 and DT, a capacitor CST, etc.

The transistors T1 to T5 and DT may be implemented as P-channel transistors. The transistors T1 to T5 and DT includes switch elements T1 to T5 and a driving element DT.

The light-emitting element EL may be implemented with an OLED. The OLED includes an organic compound layer formed between an anode and a cathode. The organic compound layer may include a hole injection layer HIL, a hole transport layer HTL, a light emission layer EML, an electron transport layer ETL, an electron injection layer EIL, and the like, but the present disclosure is not limited thereto. The anode of the OLED is connected to the fourth and fifth switch elements T4 and T5 through a fourth node N4. The cathode of the OLED is connected to the second power supply line 62 through which the low-potential power supply voltage VSS is applied. The driving element DT drives the light-emitting element EL by adjusting the amount of current flowing through the light-emitting element EL according to the gate-source voltage Vgs. The current flowing through the light-emitting element EL may be switched by the fourth switch element T4.

The capacitor CST is connected between a first node n1 and a second node n2. The first node n1 is connected to the second electrode of the first switch element T1, the first electrode of the third switch element T3, and the first electrode of the capacitor CST. The second node n2 is connected to the second electrode of the capacitor CST, the gate of the driving element DT, and the first electrode of the second switch element T2. The capacitor CST is charged with the data voltage Vdata for which the threshold voltage Vth of the driving element DT is compensated.

The first switch element T1 supplies the data voltage Vdata to the first node n1 in response to the second scan signal SCAN2. The first switch element T1 includes a gate connected to the second gate line 122, a first electrode connected to the data line 131, and a second electrode connected to the first node n1.

The second scan signal SCAN2 is supplied to the pixels P through the second gate line 122. The second scan signal SCAN2 is generated as a pulse of the gate-on voltage VGL. The pulse of the second scan signal SCAN2 defines a sensing period Ts. The pulse width of the second scan signal SCAN2 may be set to be approximately one horizontal period 1H. The second scan signal SCAN2 is changed to the gate-on voltage VGL later than the first scan signal SCAN1 and is changed to the gate-off voltage VGH simultaneously with the first scan signal SCAN1. The pulse width of the second scan signal SCAN2 may be set to be smaller than that of the first scan signal SCAN1. During the initialization period Ti and the emission period Tem, the voltage of the second scan signal SCAN2 is maintained at the gate-off voltage VGH.

The second switch element T2 connects the gate of the driving element DT and the second electrode of the driving element DT to enable the driving element DT to operate as a diode in response to the first scan signal SCAN1. The second switch element T2 includes a gate connected to the first gate line 121, a first electrode connected to the second node n2, and a second electrode connected to the third node N3.

The first scan signal SCAN1 is supplied to the pixels P through the first gate line 121. The first scan signal SCAN1 may be generated as a pulse of the gate-on voltage VGL. The pulse of the first scan signal SCAN1 defines the initialization period Ti and the sensing period Ts. During the emission period Tem, the voltage of the first scan signal SCAN1 is maintained at the gate-off voltage VGH.

The third switch element T3 supplies a predetermined reference voltage Vref to the first node n1 in response to an EM signal EM(N). The reference voltage Vref is supplied to the pixels P through the third power supply line 63. The third switch element T3 includes a gate connected to a third gate line 123, a first electrode connected to the first node n1, and a second electrode connected to the third power supply line 63. The EM signal EM(N) defines on/off times of the light-emitting element EL.

During the sensing period Ts, a pulse of the EM signal EM(N) may be generated as the gate-off voltage VGH in order to block a current path between the first node n1 and the third power supply line 63 and block a current path of the light-emitting element EL. The EM signal EM(N) may be inverted into the gate-off voltage VGH when the second scan signal SCAN2 is inverted into the gate-on voltage VGL and may be inverted into the gate-on voltage VGL after the first scan signal SCAN1 and the second scan signal SCAN2 are inverted into the gate-off voltage VGH. In order to precisely express low-grayscale luminance, the EM signal EM(N) may swing between the gate-on voltage VGL and the gate-off voltage VGH at a predetermined duty ratio during the emission period Tem.

The fourth switch element T4 switches the current path of the light-emitting element EL in response to the EM signal EM(N). The fourth switch element T4 has a gate connected to the third gate line 123. The fourth switch element T4 has a first electrode connected to the third node N3 and a second electrode connected to the fourth node N4.

The fifth switch element T5 is turned on according to the gate-on voltage VGL of the first scan signal SCAN1 to supply the reference voltage Vref to the fourth node N4 during the initialization period Ti and the sensing period Ts. During the initialization period Ti and the sensing period Ts, the anode voltage of the light-emitting element EL is discharged to the reference voltage Vref. In this case, the light-emitting element EL does not emit light because a voltage between the anode and the cathode is smaller than the threshold voltage of the light-emitting element EL. The fifth switch element T5 includes a gate connected to the first gate line 121, a first electrode connected to the third power supply line 63, and a second electrode connected to the fourth node N4.

The driving element DT drives the light-emitting element EL by adjusting current flowing through the light-emitting element EL according to the gate-source voltage Vgs. The driving element DT includes a gate connected to the second node n2, a first electrode connected to the first power supply line 61, and a second electrode connected to the third node N3. The pixel driving voltage VDD is supplied to the pixels P through the first power supply line 61.

Referring to FIG. 12, a pixel circuit according to a second aspect of the present disclosure includes a light-emitting element EL, multiple transistors T11 to T16 and DT, a capacitor CST, etc.

Each of the transistors T11 to T16 and DT may be implemented as P-channel transistors but is not limited thereto. The transistors T11 to T16 and DT includes switch elements T11 to T16 and a driving element DT.

A gate signal applied to this pixel circuit includes an $(N-1)^{th}$ scan signal SCAN(N−1), an $N^{th}$ scan signal SCAN(N), and an EM signal EM(N). The $(N-1)^{th}$ scan signal SCAN(N−1) is synchronized with a data voltage Vdata of an $(N-1)^{th}$ pixel line. The $N^{th}$ scan signal SCAN(N) is synchronized with a data voltage Vdata of an $N^{th}$ pixel line. A pulse of the $N^{th}$ scan signal SCAN(N) is generated with the same pulse width as that of the $(N-1)^{th}$ scan signal SCAN(N−1) and is generated later than a pulse of the $(N-1)^{th}$ scan signal SCAN(N−1).

The capacitor CST is connected between a first node n11 and a second node n12. The pixel driving voltage VDD is supplied to the pixel circuit through the first power supply line 61. The first node n11 is connected to the first power supply line 61, the first electrode of the third switch element T13, and the first electrode of the capacitor CST.

The second node n12 is connected to the second electrode of the capacitor CST, the gate of the driving element DT, the first electrode of the first switch element T11, and the first electrode of the fifth switch element T15.

The first switch element T11 is turned on according to the gate-on voltage VGL of the $N^{th}$ scan signal SCAN(N) to connect the gate and the second electrode of the driving element DT. The first switch element T11 includes a gate connected to the second gate line 125, a first electrode connected to the second node n12, and a second electrode connected to the third node n13. The $N^{th}$ scan signal SCAN(N) is supplied to the pixels P through the second gate line 125. The third node n13 is connected to the gate of the driving element DT, the second electrode of the first switch element T11, and the first electrode of the fourth switch element T14.

The second switch element T12 is turned on according to the gate-on voltage VGL of the $N^{th}$ scan signal SCAN(N) to apply the data voltage Vdata to the first electrode of the driving element DT. The second switch element T12 includes a gate connected to the second gate line 125, a first electrode connected to a fifth node n15, and a second electrode connected to the data line 131. The fifth node n15 is connected to the first electrode of the driving element DT, the first electrode of the second switch element T12, and the second electrode of the third switch element T13.

The third switch element T13 supplies the pixel driving voltage VDD to the first electrode of the driving element DT in response to the EM signal EM(N). The third switch element T13 includes a gate connected to a third gate line 126, a first electrode connected to the first power supply line 61, and a second electrode connected to the fifth node n15. The EM signal EM(N) is supplied to the pixels P through the third gate line 126.

The fourth switch element T14 is turned on according to the gate-on voltage VGL of the EM signal EM(N) to connect the second electrode of the driving element DT and the anode of the light-emitting element EL. The fourth switch element T14 has a gate connected to the third gate line 126. The fourth switch element T14 has a first electrode connected to the third node n13 and a second electrode connected to the fourth node n14. The fourth node n14 is connected to the anode of the light-emitting element EL, the second electrode of the fourth switch element T14, and the second electrode of the sixth switch element T16.

The fifth switch element T15 is turned on according to the gate-on voltage VGL of the $(N-1)^{th}$ scan signal SCAN(N−1) to connect the second node n12 to the third power supply line 63 so that the gate of the driving element DT and the capacitor CST are initialized during the initialization period Ti. The fifth switch element T15 includes a gate connected to the first gate line 124, a first electrode connected to the second node n12, and a second electrode connected to the third power supply line 63.

The $(N-1)^{th}$ scan signal SCAN(N−1) is supplied to the pixels P through the first gate line 124. The initialization voltage Vini is supplied to the pixels P through the third power supply line 63.

The sixth switch element T16 is turned on according to the gate-on voltage VGL of the $(N-1)^{th}$ scan signal SCAN (N−1) to connect the third power supply line 63 to the anode of the light-emitting element EL during the initialization period Ti. During the initialization period Ti, the anode voltage of the light-emitting element EL is discharged to the initialization voltage Vini through the sixth switch element T16. In this case, the light-emitting element EL does not emit light because a voltage between the anode and the cathode is smaller than the threshold voltage of the light-emitting element EL. The sixth switch element T16 includes a gate connected to the first gate line 124, a first electrode connected to the third power supply line 63, and a second electrode connected to the fourth node n14.

The driving element DT drives the light-emitting element EL by adjusting current flowing through the light-emitting element EL according to the gate-source voltage Vgs. The driving element DT includes a gate connected to the second node n12, a first electrode connected to the fifth node n15, and a second electrode connected to the third node n13.

Figure 13A:
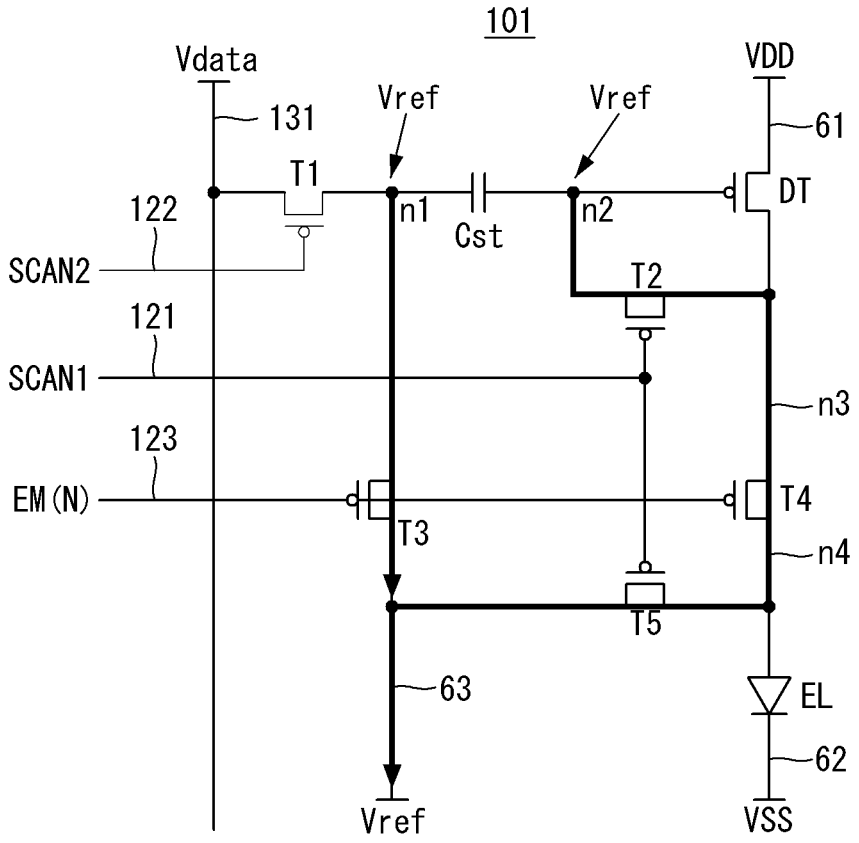
FIG. 13A is a diagram showing operation of the pixel circuit shown in FIG. 11 step by step.
Figure 13B:
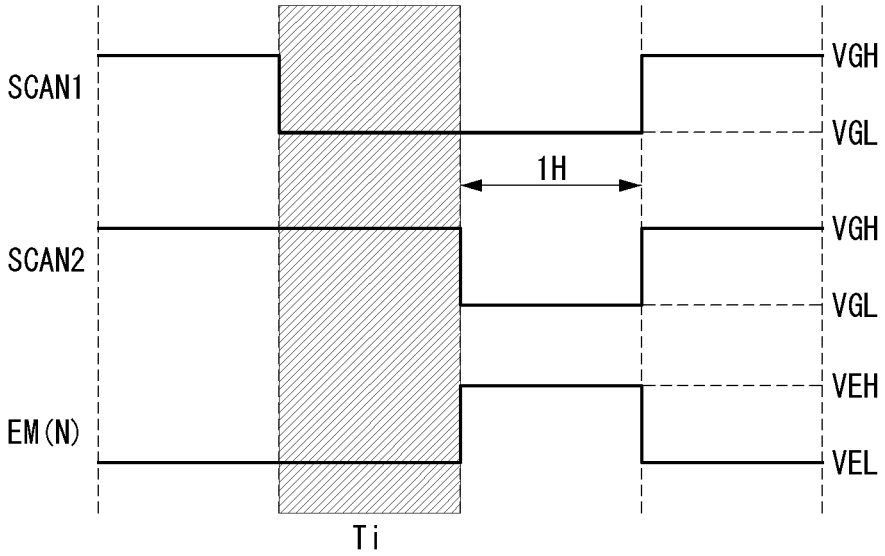
FIG. 13B is a diagram showing operation of the pixel circuit shown in FIG. 11 step by step.
Figure 14A:
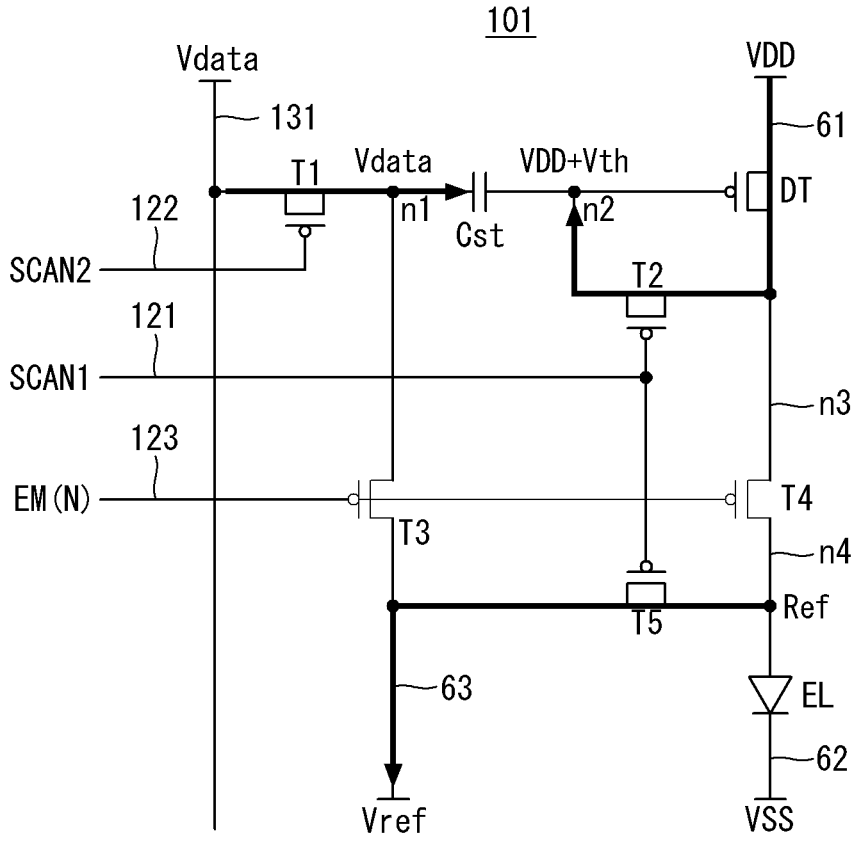
FIG. 14A is a diagram showing operation of the pixel circuit shown in FIG. 11 step by step.
Figure 14B:
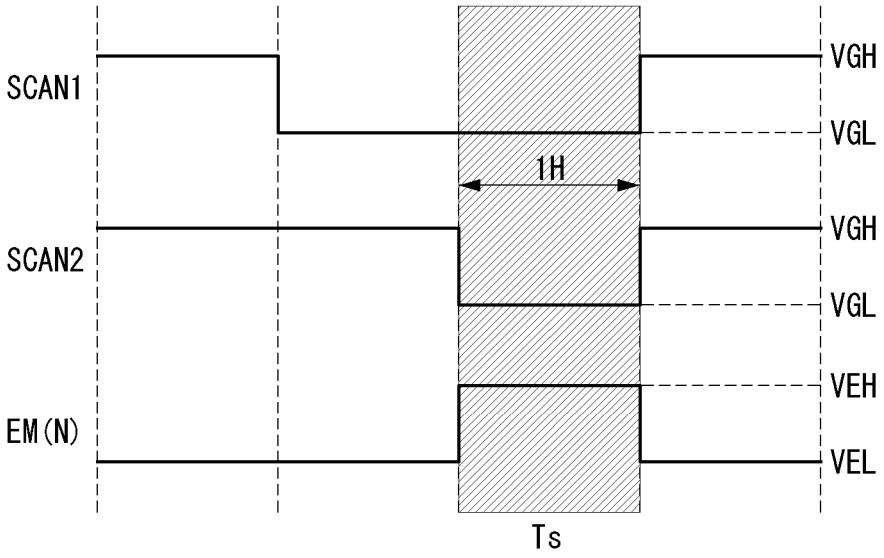
FIG. 14B is a diagram showing operation of the pixel circuit shown in FIG. 11 step by step.
Figure 15A:
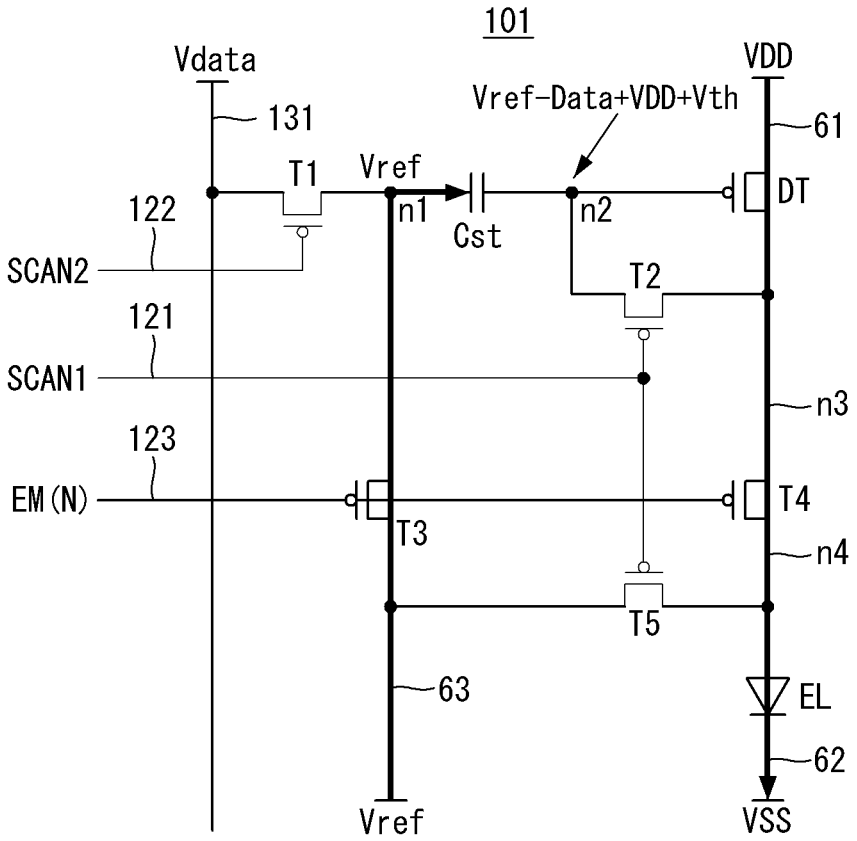
FIG. 15A is a diagram showing operation of the pixel circuit shown in FIG. 11 step by step.
Figure 15B:
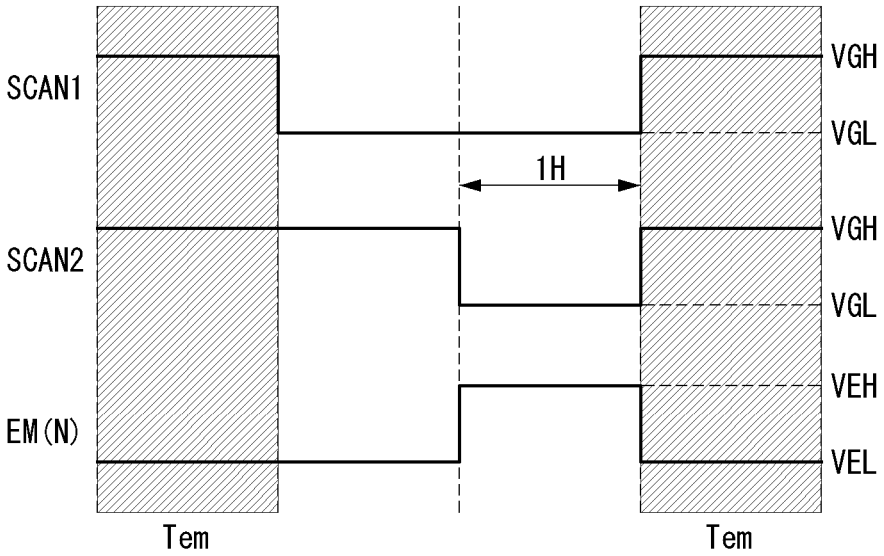
FIG. 15B is a diagram showing operation of the pixel circuit shown in FIG. 11 step by step.

FIGS. 13A to 15B are diagrams showing operation of the pixel circuit shown in FIG. 11 step by step. FIG. 13A is a diagram showing a path of current flowing through the pixel circuit during the initialization period Ti. FIG. 14A is a diagram showing a path of current flowing through the pixel circuit during the sensing period Ts. FIG. 15A is a diagram showing a path of current flowing through the pixel circuit during the emission period Tem. Transistors which are shown faintly in FIGS. 13A, 14A, and 15A are off. FIGS. 13B, 14B, and 15B are waveform diagrams showing gate signals applied to the pixel circuit shown in FIG. 11.

Referring to FIGS. 13A and 13B, the voltages of the EM signal EM(N) and the first scan signal SCAN1 during the initialization period Ti are the gate-on voltages VGL. The second to fifth switch elements T2 to T5 are turned on during the initialization period Ti to discharge the voltages of the first node n1, the second node n2, and the fourth node N4 to the reference voltage Vref. As a result, during the initialization period Ti, the capacitor CST, the gate voltage of the driving element DT, and the anode voltage of the light-emitting element EL are initialized to the reference voltage Vref.

Referring to FIGS. 14A and 14B, the voltages of the first scan signal SCAN1 and the second scan signal SCAN2 during the sensing period Ts are the gate-on voltages VGL. The first, second, and fifth switch elements T1, T2, and T5 are turned on during the sensing period Ts. In this case, the data voltage Vdata is applied to the first node n1, and the voltage of the second node n2 is changed to VDD+Vth. As a result, during the sensing period Ts, the threshold voltage Vth of the driving element DT is sensed, and the second node n2 is charged with the threshold voltage Vth. The capacitor CST is charged with the data voltage Vdata for which the threshold voltage Vth of the driving element DT is compensated during the sensing period Ts.

Referring to FIGS. 15A and 15B, the voltage of the EM signal EM(N) during the emission period Tem is the gate-on voltage VGL. The third and fourth switch elements T3 and T4 are turned on during the emission period Tem. In this case, the voltage of the first node n1 is changed to the reference voltage Vref, and the voltage of the second node n2 is changed to Vref−Vdata+VDD+Vth. The light-emitting element EL may emit light due to current flowing through the light-emitting element EL through the driving element DT during the emission period Tem.

The current flowing through the light-emitting element EL may be adjusted according to the gate-source voltage Vgs of the driving element DT. The gate-source voltage Vgs of the driving element DT is Vref−Vdata+Vth during the emission period Tem.

Figure 16A:
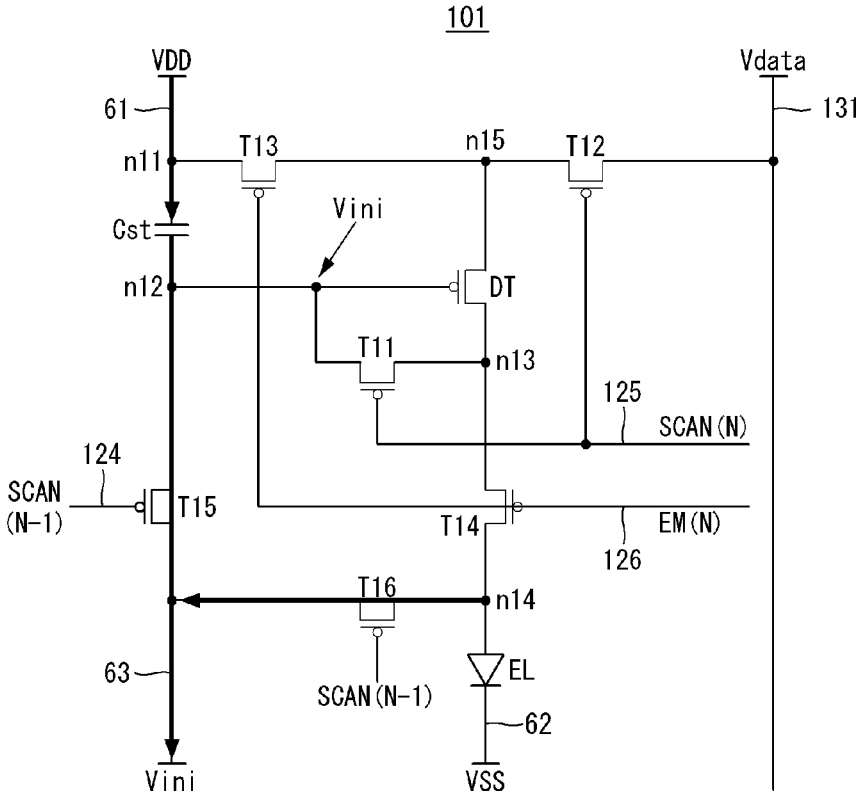
FIG. 16A is a diagram showing operation of the pixel circuit shown in FIG. 12 step by step.
Figure 16B:
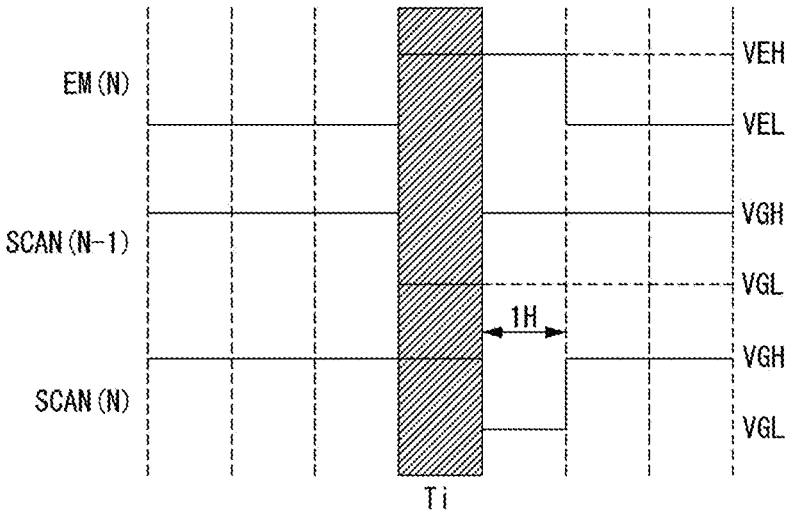
FIG. 16B is a diagram showing operation of the pixel circuit shown in FIG. 12 step by step.
Figure 17A:
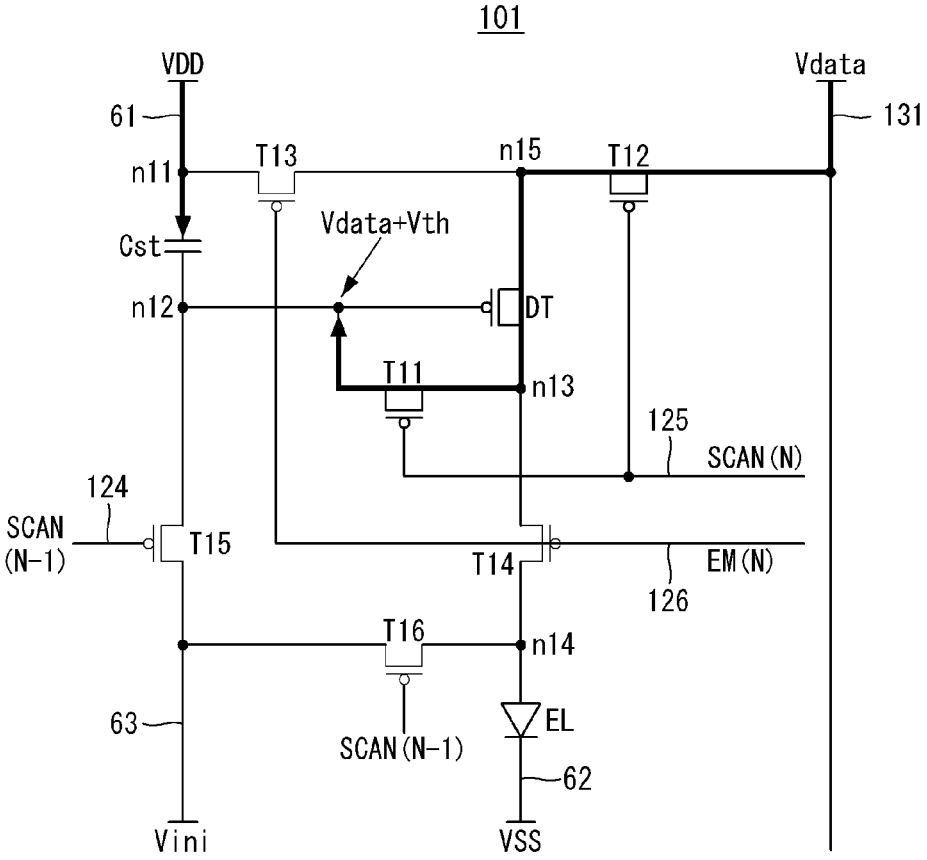
FIG. 17A is a diagram showing operation of the pixel circuit shown in FIG. 12 step by step.
Figure 17B:
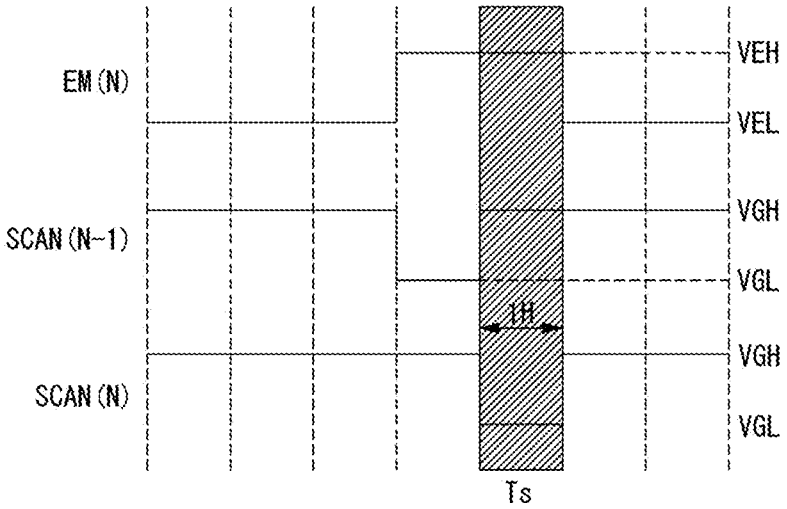
FIG. 17B is a diagram to 18B are diagrams showing operation of the pixel circuit shown in FIG. 12 step by step.
Figure 18A:
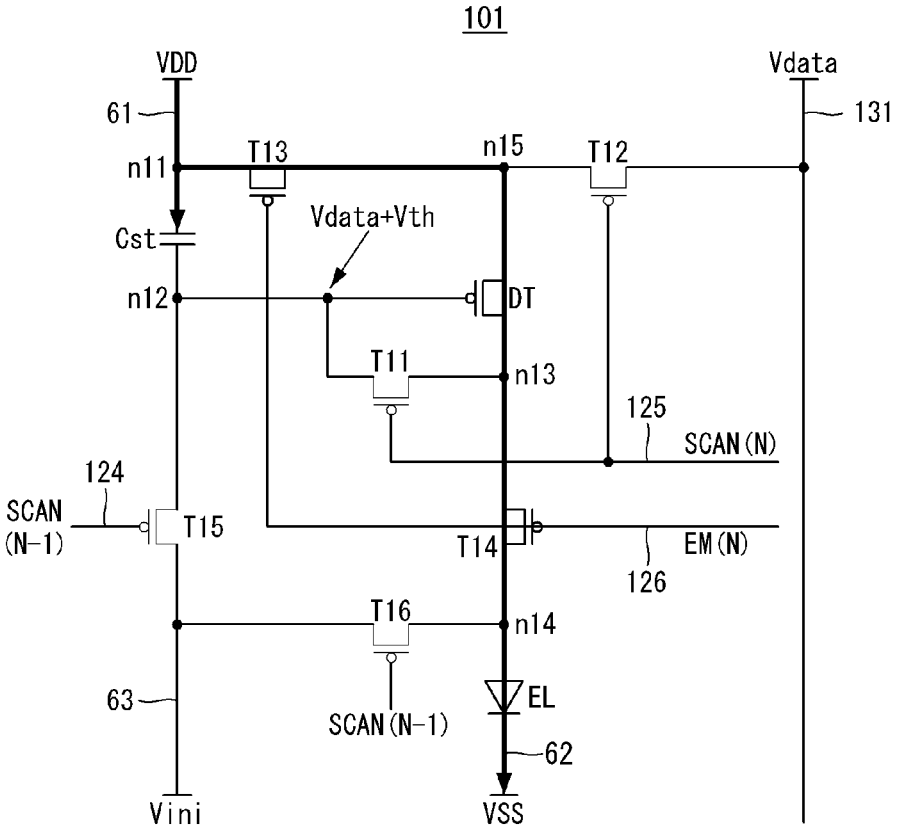
FIG. 18A is a diagram to 18B are diagrams showing operation of the pixel circuit shown in FIG. 12 step by step.
Figure 18B:
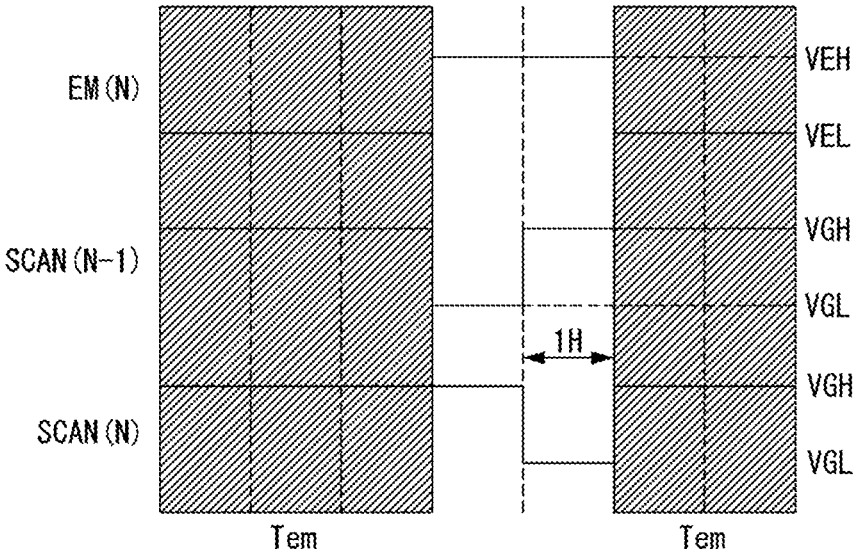
FIG. 18B are diagrams showing operation of the pixel circuit shown in FIG. 12 step by step.

FIGS. 16A to 18B are diagrams showing operation of the pixel circuit shown in FIG. 12 step by step. FIG. 16A is a diagram showing a path of current flowing through the pixel circuit during the initialization period Ti. FIG. 17A is a diagram showing a path of current flowing through the pixel circuit during the sensing period Ts. FIG. 18A is a diagram showing a path of current flowing through the pixel circuit during the emission period Tem. Transistors which are shown faintly in FIGS. 16A, 17A, and 18A are off. FIGS. 16B, 17B, and 18B are waveform diagrams showing gate signals applied to the pixel circuit shown in FIG. 12.

Referring to FIGS. 16A and 16B, the voltage of the $(N-1)^{th}$ scan signal SCAN(N−1) during the initialization period Ti is the gate-on voltage VGL. The fourth and fifth switch elements T14 and T15 are turned on during the initialization period Ti so that the voltages of the second and fourth nodes n12 and n14 are discharged to the initialization voltage Vini. As a result, during the initialization period Ti, the capacitor CST, the gate voltage of the driving element DT, and the anode voltage of the light-emitting element EL are initialized to the initialization voltage Vini.

Referring to FIGS. 17A and 17B, the voltage of the $N^{th}$ scan signal SCAN(N) during the sensing period Ts is the gate-on voltage VGL. The first and second switch elements T11 and T12 are turned on during the sensing period Ts. In this case, the data voltage Vdata is applied to the fifth node n15, and the voltage of the second node n12 is changed to Vdata+Vth. As a result, during the sensing period Ts, the threshold voltage Vth of the driving element DT is sensed, and the second node n12 is charged with the threshold voltage Vth. The capacitor CST is charged with the data voltage Vdata for which the threshold voltage Vth of the driving element DT is compensated during the sensing period Ts.

Referring to FIGS. 18A and 18B, the voltage of the EM signal EM(N) during the emission period Tem is the gate-on voltage VGL. The third and fourth switch elements T13 and T14 are turned on during the emission period Tem. The light-emitting element EL may emit light due to current flowing through the light-emitting element EL through the driving element DT during the emission period Tem.

The current flowing through the light-emitting element EL may be adjusted according to the gate-source voltage Vgs of the driving element DT. The gate-source voltage Vgs of the driving element DT is Vdata+Vth−VDD during the emission period Tem.

The present inventors measured different luminance values of an organic light-emitting display device in the same grayscale level depending on positions in the screen of the display panel 100 and revealed a cause thereof. This will be described in conjunction with FIGS. 19 to 22.

Figures 19, 20:
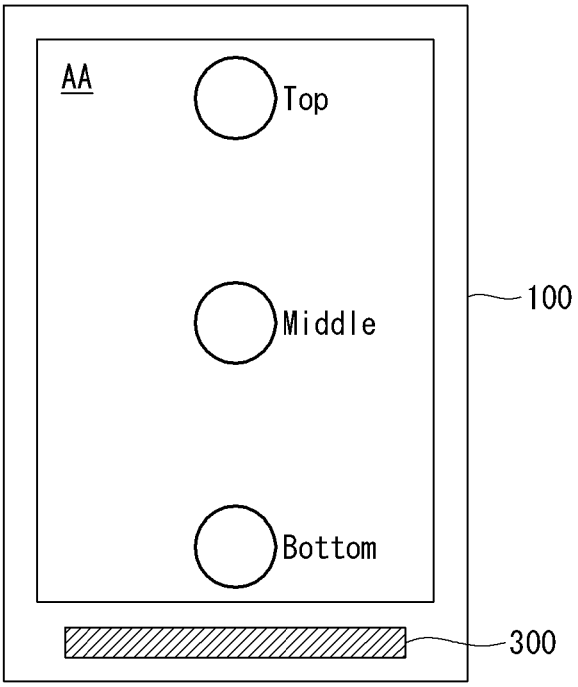
FIG. 19 is a diagram showing grayscale-based luminance measurement positions on a screen.
FIG. 20 is a diagram showing grayscale-based luminance values measured at the measurement positions shown in FIG. 19.

FIG. 19 is a diagram showing a luminance measurement position on the screen AA of the display panel 100 according to embodiments of the present disclose. FIG. 20 shows grayscale-based luminance values measured at positions "Top," "Middle," and "Bottom" shown in FIG. 19. In FIG. 20, 255G indicates a grayscale value of 255 of pixel data. 127G indicates a grayscale value of 277 of pixel data, and 31G indicates a grayscale value of 31 of pixel data.

Referring to FIGS. 19 and 20, the voltage of the shift clock GCLK and the pixel driving voltage VDD output from the drive IC 300 may be changed by IR drop depending on the positions Top, Middle, and Bottom of the screen AA. The pixel driving voltage VDD and the shift clock GCLK affect the gate-source voltage Vgs and the drain-source voltage Vdas of the driving elements DT. The shift clock GCLK affects the sensing period Ts defined by a scan signal supplied to the gate lines of the pixels P.

A sample used in this experiment is an organic light-emitting display device in which VDD and GCLK output from the drive IC 300 are fixed. Since the position Bottom is close to the drive IC 300, the amount of IR drop is small. Since the position Top is far from the drive IC 300, the amount of IR drop is largest. The luminance measurement result is that the current I of the pixels P is large in the case of a high grayscale level (255G). Thus, due to a difference in the amount of IR drop, the luminance decreases in a direction toward the position Top. However, the current of the pixels P is small in the case of a low grayscale level (31G). Thus, the effect of the IR drop is reduced, and the luminance tends to increase in a direction away from the drive IC 300 due to other causes. In FIG. 20, the luminance of the low grayscale level (31G) measured at the position Bottom close to the drive IC 300 is 4.80 [nit] while the luminance of the lower grayscale level (31G) measured at the position Top far from the drive IC 300 is rather increased to 6.20 [nit].

The present inventors confirmed that in the case of low grayscale levels, the difference in sensing period Ts has a greater effect on luminance non-uniformity than the effect of IR drop of VDD. The sensing period Ts is defined by the pulse width of the scan signal. However, due to an RC delay of the shift clock GCLK(n) input to the gate driving unit 120, a delay of the shift clock waveform causes a delay of the scan signal. As a result, at low grayscale levels, the gate-source voltage Vgs of the driving element increases in pixels far from the drive IC 300, and thus luminance increases more in pixels far from the drive IC 300 than in pixels close to the drive IC 300.

Figure 21:
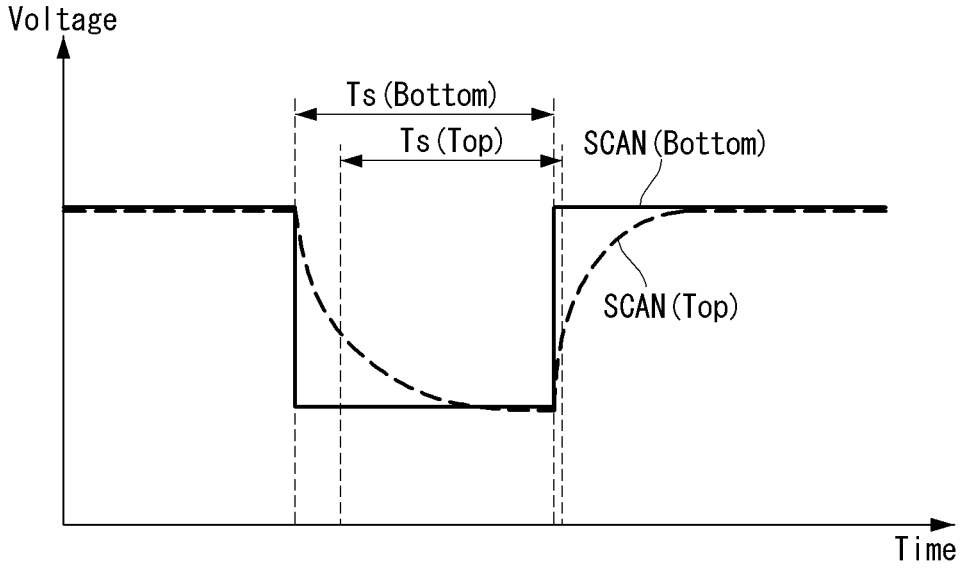
FIG. 21 is a diagram showing sensing periods corresponding to positions in a screen.

Referring to FIG. 21, the waveforms of the scan signals SCAN(Top) and SCAN(Bottom) supplied to gate lines of the position Top and the position Bottom on the screen AA have different RC delays. Since the resistance and parasitic capacitance of the shift clock lines 51 are large at the position Top, the RC delay of the shift clock GCLK(n) increases. Thus, the waveform delay of the scan signal SCAN(Top) supplied to the gate line at the position Top increases. As a result, the sensing period Ts(Top) actually applied to the pixels at the position Top is smaller than the sensing period Ts(Bottom) at the position Bottom.

Figure 22:
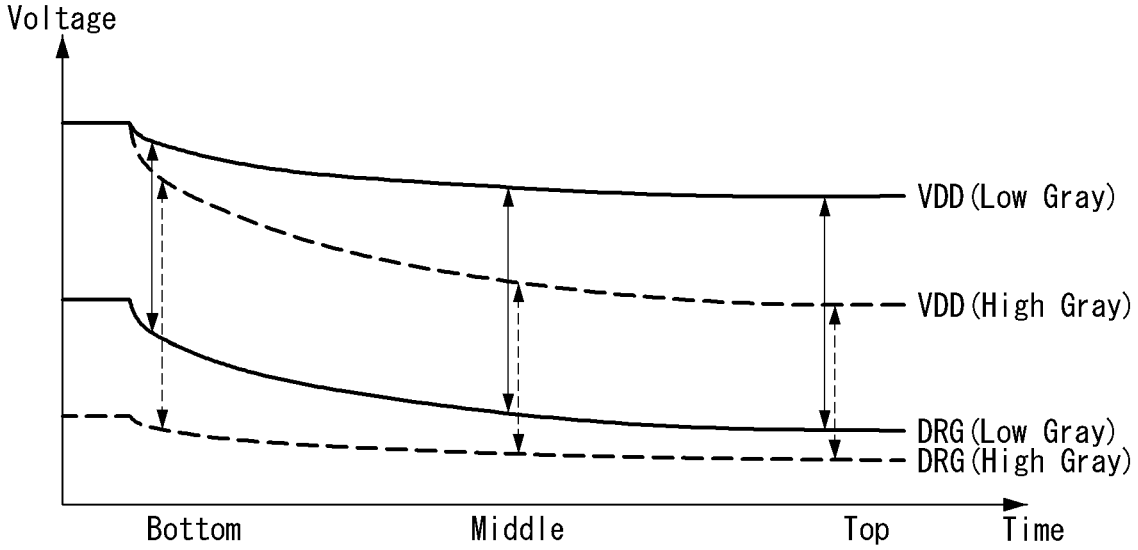
FIG. 22 is a diagram showing the change in gate-source voltage of a driving element which is measured according to positions and grayscale levels in a screen.

FIG. 22 is a diagram showing the change in gate-source voltage of a driving element which is measured according to positions and grayscale levels in a screen.

Referring to FIG. 22, for high grayscale levels HIGH GRAY, the amount of current flowing through the pixels P is large, and thus the amount of IR drop of VDD increases to the maximum in a direction farther from the drive IC 300. Therefore, for high grayscale levels HIGH GRAY, a decrease in luminance is greater than an increase in luminance due to a decrease in the sensing period Ts, and thus the measurement result shows that the luminance decreases in a direction farther from the position Top.

For low grayscale levels LOW GRAY, the amount of current flowing through the pixels P is small, and thus the IR drop of VDD is minimized. For low grayscale levels LOW GRAY, an increase in luminance due to a decrease in the sensing period Ts is larger than a decrease in luminance due to the IR drop of VDD in a direction farther from the drive IC 300. In the luminance measurement result shown in FIG. 20, it was confirmed that the luminance tended to increase in a direction toward the position Top which is far from the drive IC 300. Accordingly, although the effect of the IR drop of VDD is minimized in a screen AA to which an internal compensation technique is applied, luminance may increase in pixels far from the drive IC 300 at low grayscale levels.

According to the present disclosure, the voltage of the pulse and/or the pulse width of the shift clock GCLK(n), that is, the gate-on voltage VGL, is changed in consideration of the RC delay sensing result of the shift clock GCLK(n) according to the position in the screen AA in real time. The pulse width and the voltage of the scan signal defining the sensing signal are substantially the same as those of the shift clock GCLK. According to the present disclosure, the pulse width or voltage of the scan signal is changed by changing the voltage of the pulse of shift clock GCLK, i.e. the gate-on voltage VGL or the pulse width of the shift clock GCLK.

According to the present disclosure, by modulating the voltage of the pulse and/or the pulse width of the shift clock GCLK(n) for each position in the screen AA, control is performed such that the sensing periods of the pixels of the entire screen are equal. As a result, the problem of the luminance non-uniformity at the low grayscale levels, which cannot be solved using only a technique of compensating for the IR drop of the pixel driving voltage VDD, can be solved according to the present disclosure.

Figure 23:
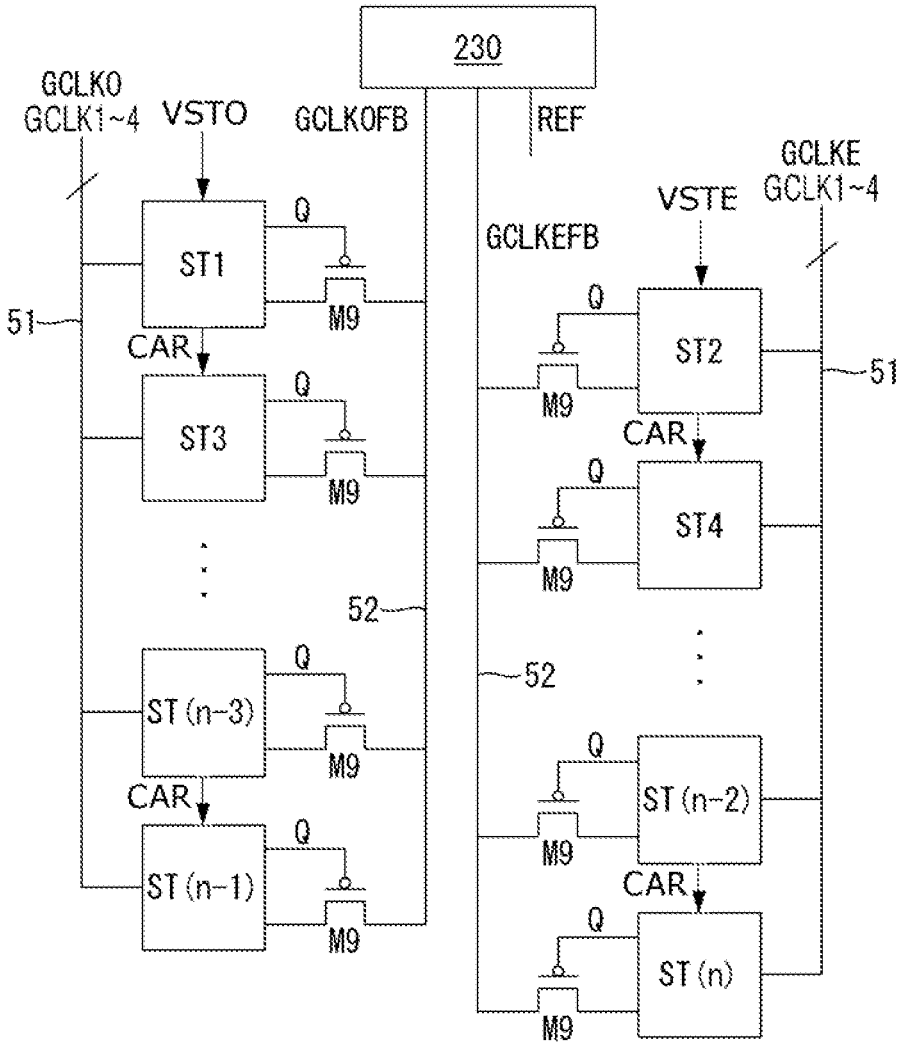
FIG. 23 is a diagram showing a sensing device according to a first aspect of the present disclosure.

FIG. 23 is a diagram showing a sensing device according to a first aspect of the present disclosure.

Referring to FIG. 23, the sensing device includes a feedback transistor M9 connected to a gate driving unit 120, a feedback line 52 connected to the feedback transistor M9, and a sensing unit 230.

The gate driving unit 120 includes stages ST1 to ST(n) which are connected in cascade. In FIG. 23, "VSTO" and "GCLKO" denote a start pulse and a shift clock input to the left shift register of the gate driver, respectively. "VSTE" and "GCLKE" denote the start pulse and shift clock input to the right shift register of the gate driver, respectively. "CAR" denotes a carry signal sequentially transmitted to the stages of the shift register.

Figure 24:
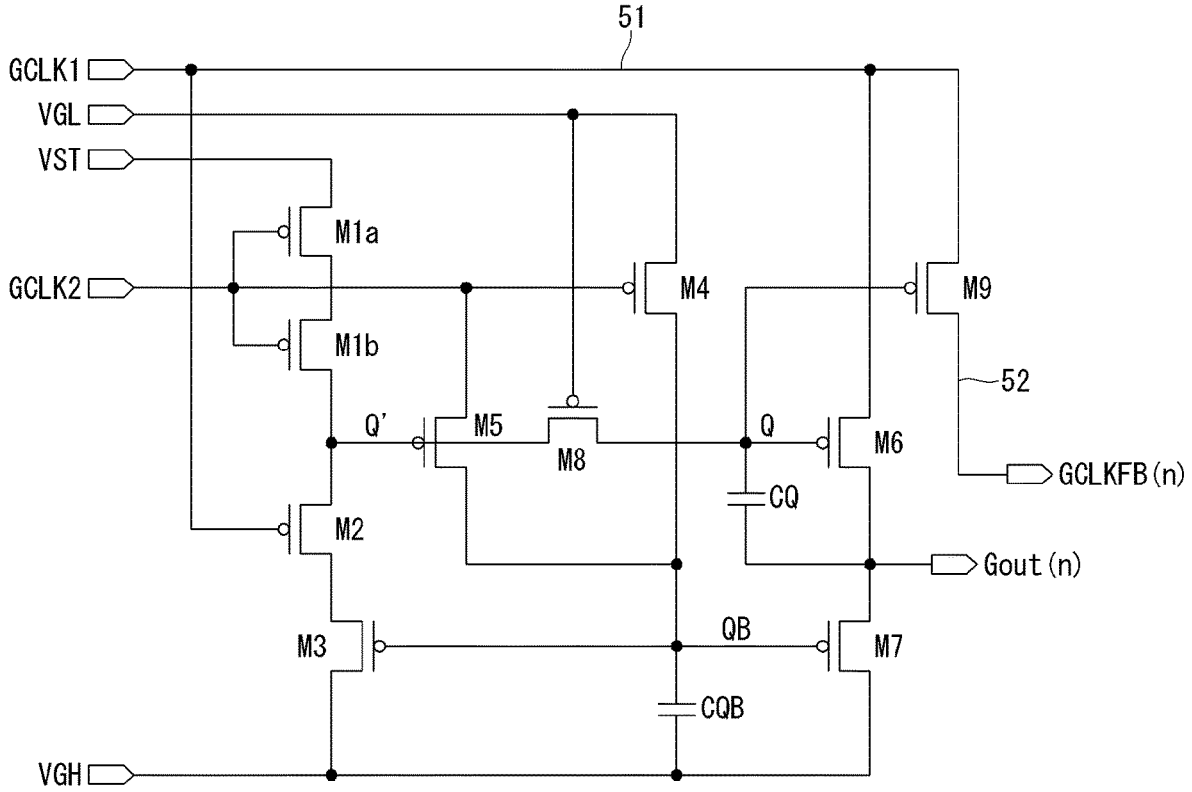
FIG. 24 is a circuit diagram specifically showing an $N^{th}$ stage in a gate driving unit shown in FIG. 23.

The feedback transistor M9 is connected to each of the stages ST1 to ST(n) or is connected to at least two stages spaced a predetermined distance from each other. As shown in FIG. 24, the feedback transistor M9 is turned on according to the gate-on voltage VGL of the Q node to connect a shift clock line 51 to the feedback line 52. For example, as shown in FIGS. 19 and 24, the feedback transistor M9 may be connected to a stage connected to a gate line at the position Top and a stage connected to a gate line at the position Bottom.

The sensing unit 230 compares feedback signals or feedback voltages GCLKOFB and GCLKEFB in the feedback line 52 to a predetermined reference voltage REF and detects, as a pulse width, a voltage interval having voltages less than or equal to the reference voltage REF from the feedback voltages GCLKOFB and GCLKEFB.

Whenever the shift clock GCLK(n) is input to the shift clock line 51 while the Q node is charged with the gate-on voltage VGL, the sensing unit 230 may measure the pulse widths of the feedback signals or feedback voltages GCLKOFB and GCLKEFB of the shift clock at a corresponding position and sense an RC delay of the shift clock GCLK(n). Accordingly, the sensing unit 230 may sense the amount of RC delay of the shift clock GCLK(n) for each position in the screen AA in real time. In other words, the feedback signals received through the feedback line 52 are based on the shift clock GCLK(n) input to the shift clock line 51.

The timing controller 303 may determine an actual sensing period Ts which is applied for each position in the screen AA using the output signal of the sensing unit 230, that is, the pulse width of the shift clock GCLK(n) actually applied to the gate lines of the screen AA. The timing controller 303 may perform control such that the sensing periods TS of all the pixels of the screen AA are equal by changing the voltage VGL of the pulse and/or the pulse width of the shift clock GCLK(n) for each position in the screen AA on the basis of the pulse width of the shift clock GCLK(n) for each position, which is input from the sensing unit 230.

FIG. 24 is a circuit diagram specifically showing an $N^{th}$ stage in the gate driving unit shown in FIG. 23.

Referring to FIG. 24, the feedback transistor M9 is turned on according to the gate-on voltage VGL of the Q node at a corresponding stage to connect the shift clock line 51 to the feedback line 52.

The feedback transistor M9 shares the Q node with the sixth transistor M6 at the corresponding stage in order to sense the pulse width of the shift clock Gout(n) which is actually applied to gate lines. The feedback transistor M9 includes a gate connected to the Q node, a first electrode connected to the shift clock line 51, and a second electrode connected to the feedback line 52.

The feedback transistor M9 should be connected to a separate feedback line 52 separated from the output node of the stage such that the output nodes of the stages are not short-circuited.

Figure 25:
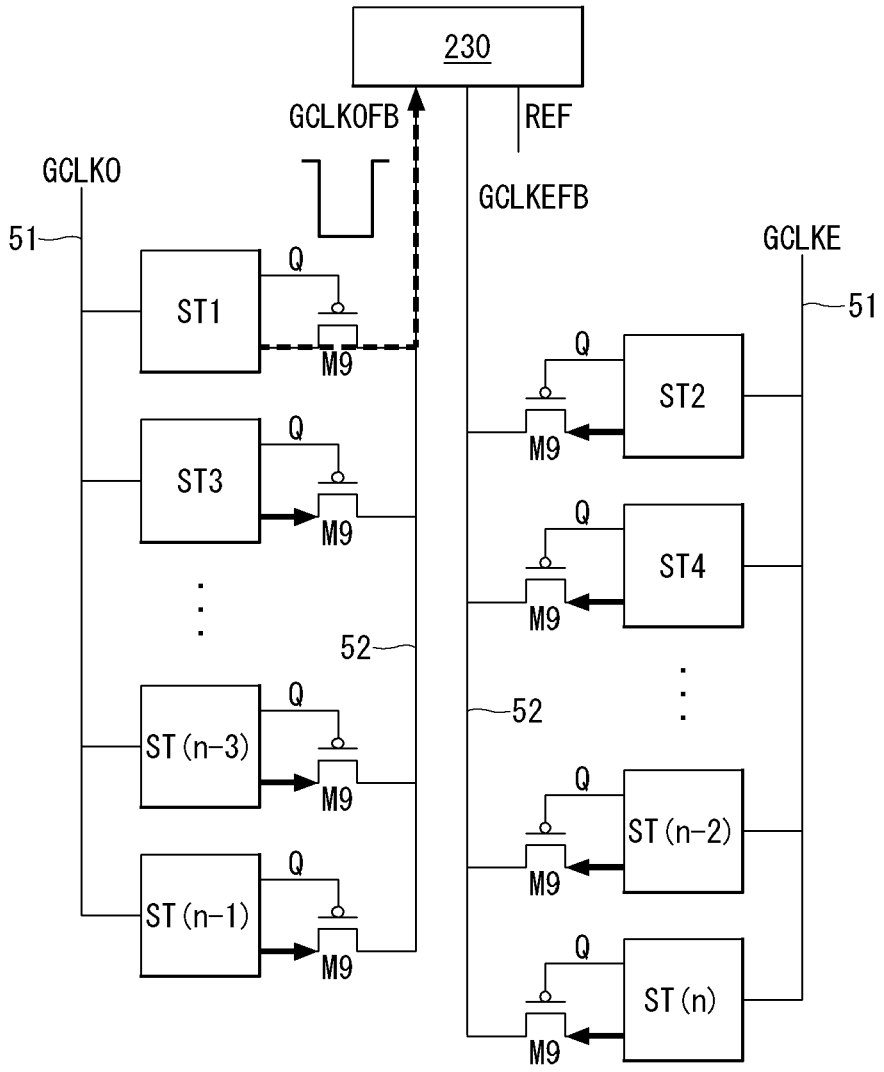
FIG. 25 is a diagram of comparing sensing operations according to the presence or absence of a ninth transistor shown in FIG. 24.
Figure 26:
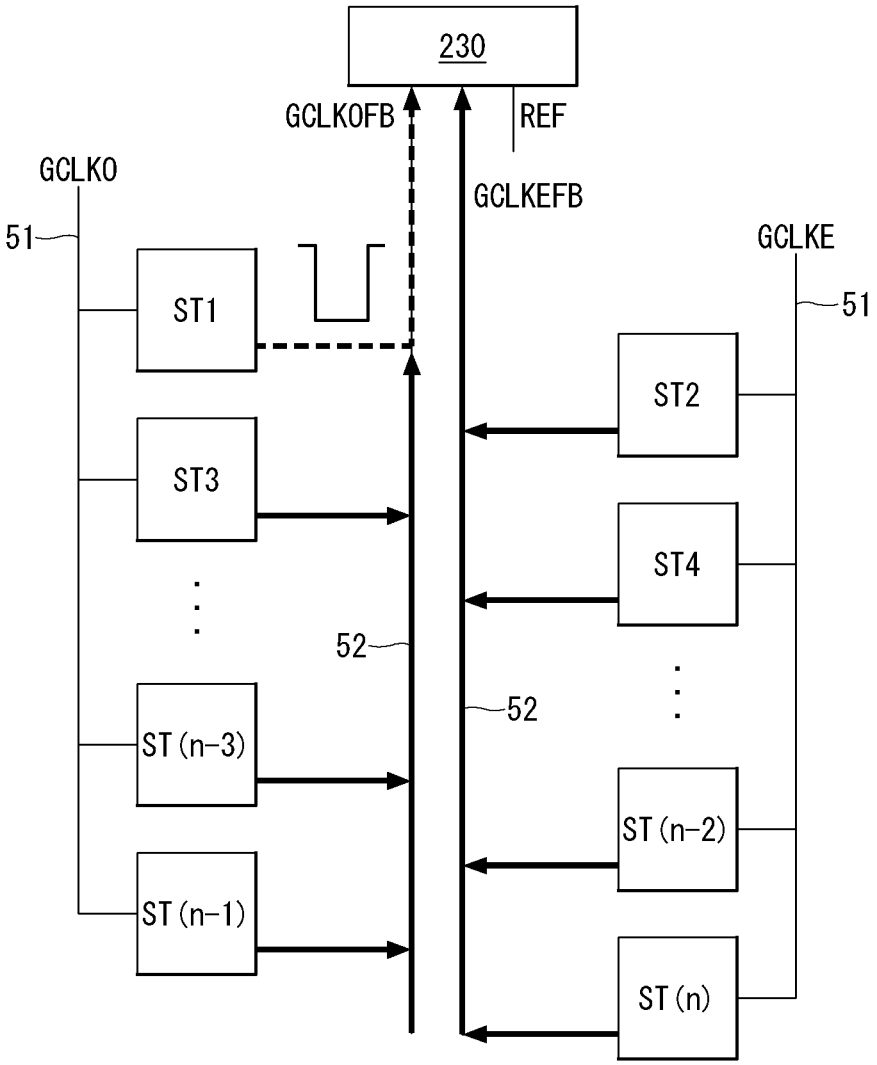
FIG. 26 is a diagram of comparing sensing operations according to the presence or absence of a ninth transistor shown in FIG. 24.

FIGS. 25 and 26 are diagrams of comparing sensing operations according to the presence or absence of a ninth transistor shown in FIG. 24.

Referring to FIG. 25, the feedback transistor M9 is turned on to supply the voltage of the shift clock GCLK(n) to the feedback line 52 only when the voltage of the Q node is the gate-on voltage VGL. At other stages, feedback transistors M9 connected to the other stages at other positions are off because the voltage of the Q node is the gate-off voltage VGH. For example, when the feedback transistor M9 connected to the first stage ST1 is turned on to supply the voltage of the shift clock GCLK input to the first stage STA to the feedback line 52, the feedback transistors M9 connected to the other stages ST2 to ST(n) are off.

In order to prevent output nodes through which the gate signals Gout(n) are output from the stages ST1 to ST(n) through the feedback line 52 from being short-circuited, the feedback transistors M9 should be connected to the feedback line 52 separated from the output nodes. The sensing device using the feedback transistor M9 can sense, in real time, the RC delay of the shift clock GCLK(n) in an active interval (see FIG. 30) in which an input image is displayed on the screen AA.

When a feedback transistor M9 shares the output node with the sixth transistor M6, as shown in FIG. 26, the output nodes of all stages to which the feedback transistor M9 is connected are short-circuited through the feedback line 52, and thus gates signals cannot be sequentially output.

The sensing device of the present disclosure may use a pixel array inspection circuit formed on the display panel 100. An auto-probe inspection process may inspect signal line defects or thin-film pattern defects of a substrate by performing electrical inspections on the lines of the pixel array using an AP inspection circuit formed on the display panel 100 before a process of mounting the drive IC 300. According to the present disclosure, an RC delay of an enable signal corresponding to the shift clock GCLK(n) may be sensed in real time using an AP inspection circuit in the display panel 100 on which the drive IC 300 is mounted.

Figure 27:
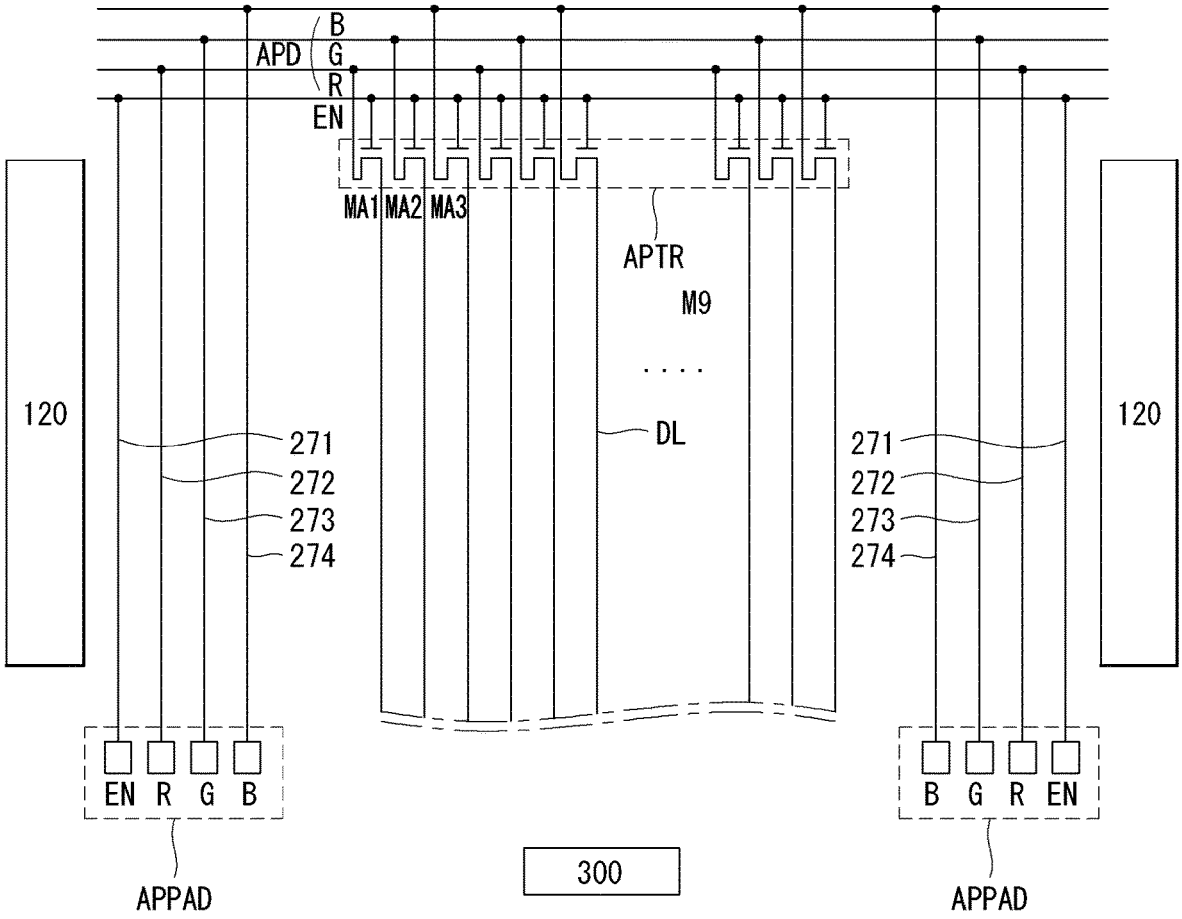
FIG. 27 is a diagram showing an AP inspection circuit on a display panel connectable to a sensing device of the present disclosure.

FIG. 27 is a diagram showing an AP inspection circuit on a display panel connectable to a sensing device of the present disclosure.

Referring to FIG. 27, the AP inspection circuit may be disposed in a bezel area of the display panel 100 that is present outside the screen AA where an image is displayed. In FIG. 27, "DL" indicates data lines connected to the pixels P.

The AP inspection circuit includes an AP pad (APPAD), AP lines 271 to 274, and an AP switch element APTR.

The AP lines include an enable line 271, a first test data line 272, a second test data line 273, and a third test data line 274. The AP pads APPAD and the AP switch elements APTR may be disposed on opposite sides of each other with a screen AA displaying an image on the display panel 100. For example, the AP pads APPAD may be disposed closer to the drive IC 300. In this case, the AP switch elements APTR may be disposed in an upper bezel area far from the mounting position of the drive IC 300.

The AP switch elements APTR may include a first transistor MA1, a second transistor MA2, and a third transistor MA3. The transistors MA1, MA2, and MA3 may be implemented as P-channel TFTs such as the transistors T1 to T16 (see FIGS. 11 and 12) constituting the pixel array. The first transistor MA1 includes a gate connected to the enable line 271, a first electrode connected to the first test data line 272, and a second electrode connected to a first data line. The first data line may be connected to red sub-pixels. The second transistor MA2 includes a gate connected to the enable line 271, a first electrode connected to the second test data line 273, and a third electrode connected to a second data line. The second data line may be connected to green sub-pixels. The third transistor MA3 includes a gate connected to the enable line 271, a first electrode connected to the third test data line 274, and a second electrode connected to a third data line. The third data line may be connected to blue sub-pixels.

In an auto-probe inspection process, the first transistor MA1 supplies a first test data signal to the first data line in response to an enable signal EN. The first test data signal may be supplied to the first test data line 272 through a needle of an inspection apparatus in the auto-probe inspection process. The second transistor MA2 supplies a second test data signal to the second data line DL in response to an enable signal EN. The second test data signal is supplied to the second test data line 273 through a needle of an inspection apparatus in the auto-probe inspection process. The third transistor MA3 supplies a third test data signal to the third data line DL in response to an enable signal EN. The third test data signal is supplied to the third test data line 274 through a needle of an inspection apparatus in the auto-probe inspection process.

The inspection apparatus may supply an enable signal and an RGB test data signal through the AP pads APPAD and may supply a gate test signal to gate lines through gate pads (not shown). In the auto-probe inspection process, whether the pixel array has a defect may be inspected without mounting the drive IC (DIC) on the display panel 100.

Figure 28:
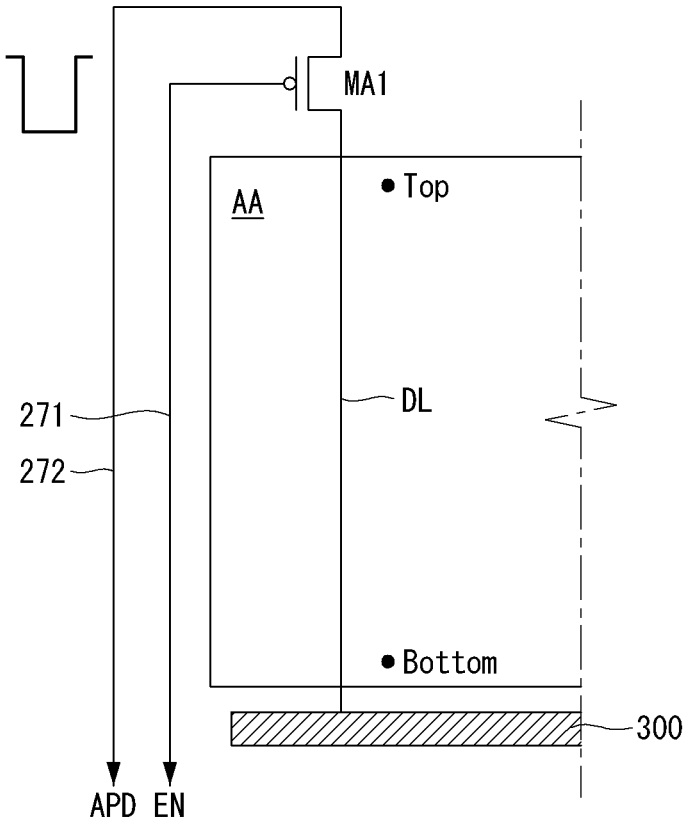
FIG. 28 is a diagram showing a sensing device according to a second aspect of the present disclosure.

As shown in FIG. 28, the sensing device of the present disclosure may be connected to the AP inspection circuit when the drive IC 300 is mounted on the display panel 100.

Figure 29:
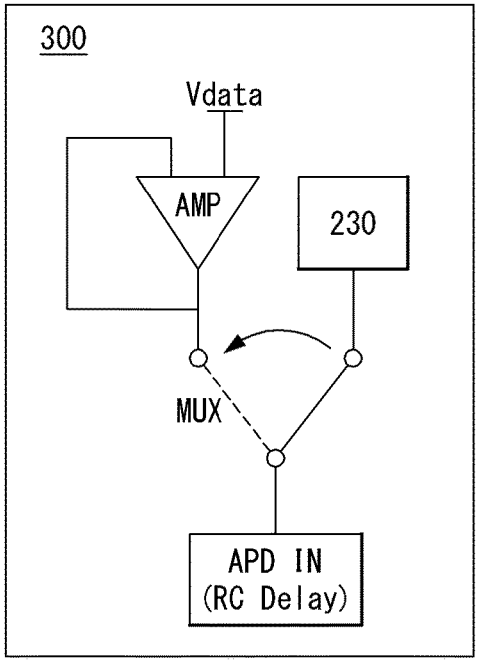
FIG. 29 is a diagram showing a multiplexer connected between a pixel array and a sensing unit.

Referring to FIGS. 28 and 29, the sensing device includes the sensing unit 230 connected to the data line through a multiplexer MUX.

Figure 30:
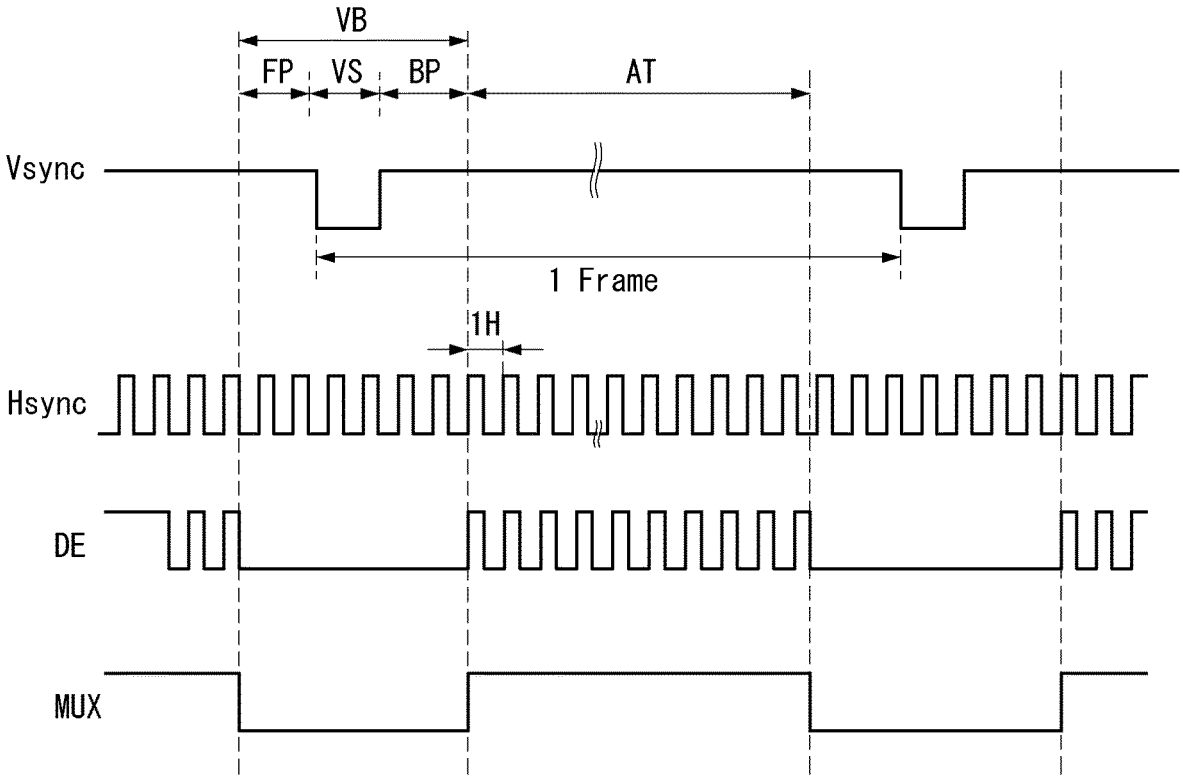
FIG. 30 is a diagram specifically showing a vertical blank period and an active interval in one frame period.

The multiplexer MUX connects the output buffer AMP of the data driving unit 306 to the data line DL when the data voltage Vdata is output from the data driving unit 306, i.e., during an active interval AT of FIG. 30. The multiplexer MUX connects the sensing unit 230 to the data line DL during a blank period during which the data voltage Vdata is not output from the data driving unit 306, for example, during a vertical blank period VB of FIG. 30.

The drive IC 300 supplies the data voltage Vdata of the pixel data to the data line DL during the active interval AT. The drive IC 300 supplies a signal output from the timing controller 303 during the vertical blank period VB to the enable line 271 and the test data line 272 to 274 in the form of a pulse signal. A pulse signal of the gate-on voltage VGL for turning on the AP switch elements MA1 to MA3 is applied to the enable line 271 as the enable signal EN, and a pulse signal is applied to the test data lines 272 to 274. These pulse signals may be generated as pulse signals swinging between the gate-on voltage VGL and the gate-off voltage VGH like the shift clock GCLK(n). These pulse signals are supplied to the enable line 271 and the test data lines 272 to 274 through the timing controller 303 and the level shifter 307.

The AP switch elements MA1 to MA3 are turned on according to the gate-on voltage VGL of the enable signal EN during the vertical blank period VB to connect the test data lines 272 to 274 to the data line DL. As a result, feedback signals for the pulse signals applied to the test data lines 272 to 274 during the vertical blank period VB are supplied to the sensing unit 230 through the data line DL. In other words, the feedback signal received through eh data line DL are based on the pulse signals applied to the test data lines 272 to 274.

The sensing unit 230 compares the voltage each of the feedback signals received through the data line DL during the vertical blank period VB to the predetermined reference voltage REF and detects a voltage period or interval of the voltage of the feedback signal less than or equal to the data reference voltage REF as the pulse width.

The timing controller 303 receives raw data output from the sensing unit 230 during the vertical blank period VB. The timing controller 303 is aware of the pulse widths of the pulse signals supplied to the test data lines 272 to 274 by utilizing register setting values. The raw data output from the sensing unit 230 indicates a pulse width value delayed by reflecting an RC delay due to the resistance and parasitic capacitance of the test data lines 272 to 274. Accordingly, the timing controller 303 may compare the pulse width of the pulse signal generated during the vertical blank period VB and the pulse width of the feedback signal which is received through the data line DL and in which the RC delay is reflected and may determine an RC delay deviation of the pulse signal on the screen AA.

The pulse signal output from the timing controller 303 has no RC delay while the feedback signal received by the sensing unit 230 has the maximum amount of RC delay. In order to compensate for the RC delay deviation of the pulse signal on the screen AA, the timing controller 303 gradually increases the pulse width of the shift clock GCLK(n) or gradually decreases the pulse voltage of the shift clock GCLK(n) in a direction toward the position Top which is farthest from the drive IC 300. Accordingly, during the vertical blank period VB, the timing controller 303 may perform control such that the sensing periods of all the pixels of the screen AA are equal by modulating the pulse voltage and/or the pulse width of the shift clock GCLK(n) on the basis of the RC delay deviation of the screen AA sensed from the feedback signals of the pulse signals. The pulse voltage of the shift clock GCLK(n) is the gate-on voltage VGL.

The sensing device shown in FIGS. 28 and 29 may measure the RC delay of the shift clock Gout(n) without a separate design change because the sensing device uses an AP inspection circuit. In particular, this sensing device measures the RC delay of the shift clock Gout(n) at every frame in real time, and thus it is possible to compensate for a condition change of the display panel 100 such as pixel deterioration in real time.

FIG. 30 is a diagram specifically showing a vertical blank period and an active interval in one frame period.

Referring to FIG. 30, one frame period is divided into an active interval in which pixel data is input and a vertical blank period VB in which no pixel data is input.

During the active interval AT, pixel data corresponding to one frame to be written to all the pixels on the screen AA of the display panel 100 is received by the drive IC 300 and written to the pixels P.

The vertical blank period VB is a blank period which is between the active interval AT of an $(N-1)^{th}$ frame period (N is a natural number) and the active interval AT of an $N^{th}$ frame period and in which no pixel data is received by the drive IC 300. The vertical blank period VB includes a vertical sync time VS, a vertical front porch FP, and a vertical back porch BP.

The vertical blank period VB is a time period from the falling edge of the last pulse in a data enable signal DE received during the $(N-1)^{th}$ frame period to the rising edge of the first pulse in a data enable signal DE received during the $N^{th}$ frame period. The start point of the $N^{th}$ frame period is a rising timing of the first pulse of the data enable signal DE.

The vertical sync signal VSYNC defines one frame period. The horizontal sync signal HSYNC defines one horizontal period (1H). The data enable signal DE defines a valid data period including pixel data to be displayed on a screen. A pulse of the data enable signal DE is synchronized with pixel data to be written to the pixels of the display panel 100. One pulse period of the data enable signal DE is one horizontal period (1H).

Figure 31:
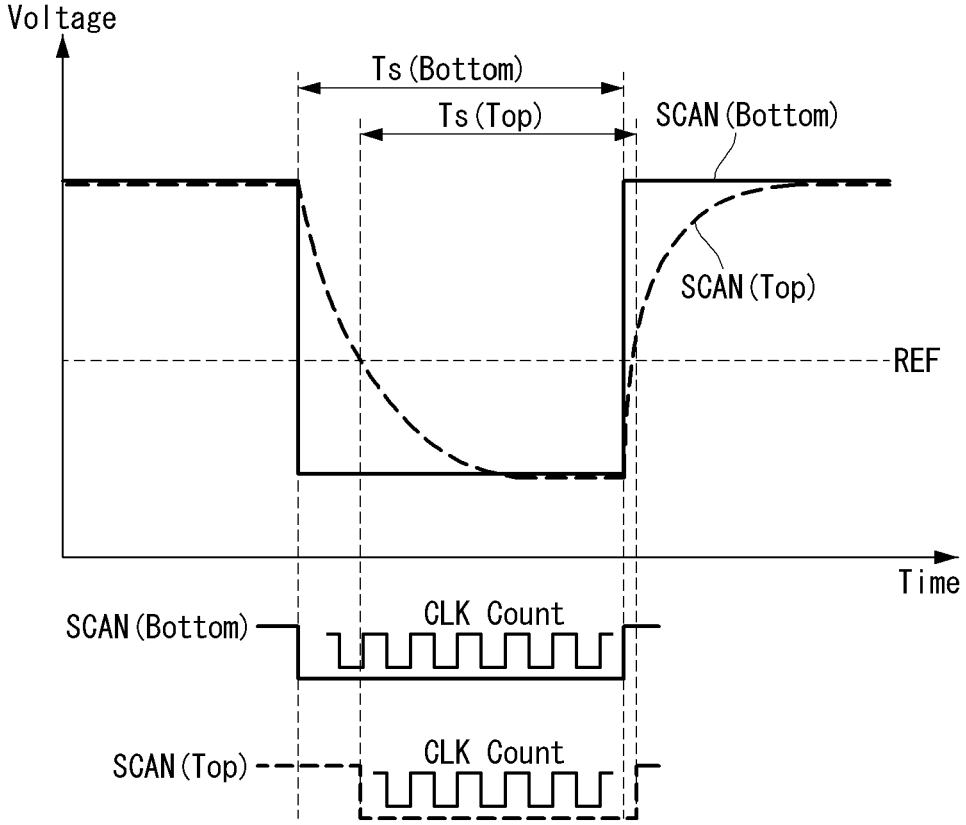
FIG. 31 is a waveform diagram showing a sensing method of a sensing period for each position in a screen.

FIG. 31 is a waveform diagram showing a sensing method of a sensing period for each position in a screen.

Referring to FIG. 31, scan signals SCAN(Top) and SCAN (Bottom) define sensing periods TS(Top) and TS(Bottom) of pixels. The pulse width of the scan signals SCAN(Top) and SCAN(Bottom) is determined according to the pulse width of the shift clock GCLK.

The waveform of the shift clock GCLK is delayed due to the resistance and parasitic capacitance of the shift clock line 51 according to a position on the shift clock line 51. The shift clock GCLK being applied to the shift clock line 51 on the display panel 100 causes a delay in the waveforms of the scan signals SCAN(Top) and SCAN(Bottom) depending on the position in the screen AA. Accordingly, the RC delay deviation of the shift clock GCLK causes a difference in the sensing periods TS(Top) and TS(Bottom) between positions in the screen AA.

The sensing unit 230 receives the shift clock GCLK through a line on the display panel 100 as a feedback input or signal and compares the received shift clock GCLK to the predetermined reference voltage REF. The sensing unit 230 may output raw data, which is digital data, through an analog-to-digital converter (hereinafter referred to as "ADC").

The sensing unit 230 converts a low-level interval of the feedback input voltage, i.e. feedback signal voltage, less than or equal to the reference voltage REF into a first logical value through the ADC and converts a high-level interval of the feedback input voltage, i.e. feedback signal voltage, higher than the reference voltage REF into a second logical value to generate a one-bit signal indicating a pulse width. The first logical value may be HIGH (=1) or LOW (=0), and the second logical value may be opposite to the first logical value.

The sensing unit 230 may convert the deviation of the pulse width caused by the RC delay of the shift clock GCLK into digital data by counting the low-level logical interval as a clock CLK in the one-bit signal. Accordingly, the sensing unit 230 may precisely quantify the pulse width deviation of the shift clock GCLK for each screen position in a clock CLK period.

According to the present disclosure, the RC delay of the shift clock GCLK for each position in the screen AA is sensed in real time, and the voltage and/or the pulse of the shift clock GCLK is automatically adjusted on the basis of the sensing result. Accordingly, according to the present disclosure, it is possible to perform self-compensation on the sensing periods TS(Top) and TS(Bottom) adaptively to a condition change of the display panel 100 although conditions such as ambient temperature and element deterioration of the display panel 100 are changed.

FIGS. 32 to 36 are diagrams showing a screen-position-based sensing period control method according to a first aspect of the present disclosure.

Figure 32:
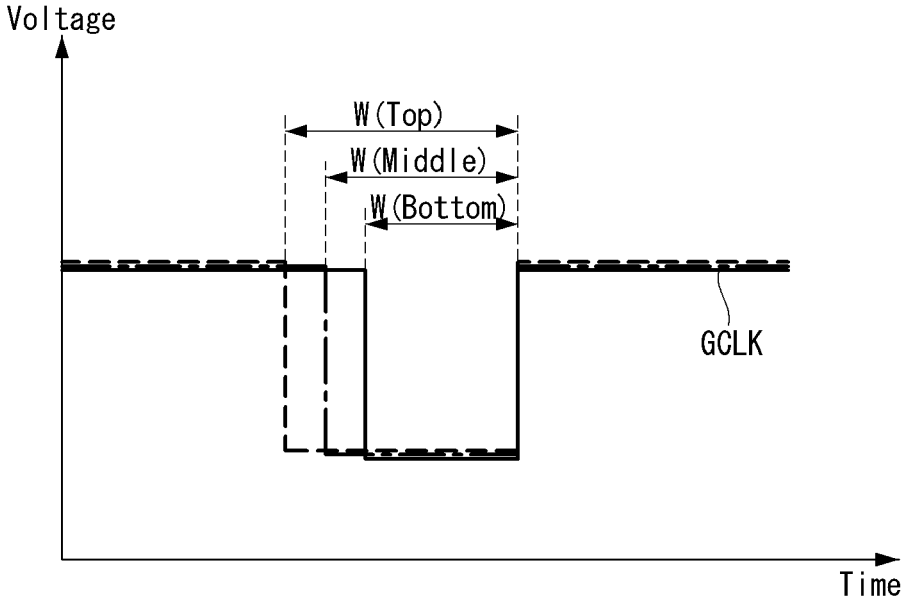
FIG. 32 is a waveform diagram showing an example of a pulse width modulation method of a shift clock for reducing a deviation of a sensing period in all pixels of a screen.
Figure 32:
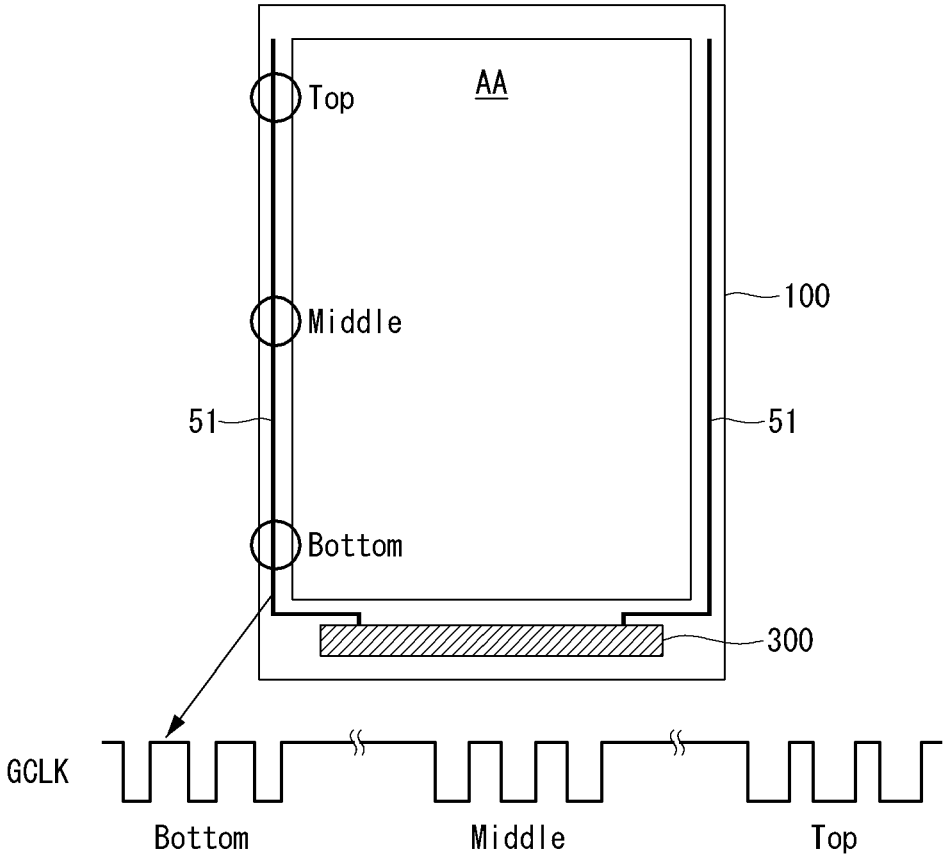

FIG. 32 is a waveform diagram showing an example of a pulse width modulation method of a shift clock GCLK for reducing a deviation of a sensing period Ts in each of the pixels P of the screen AA.

Referring to FIG. 32, the timing controller 303 may receive raw data from the sensing unit 230 and determine a difference between the sensing periods TS for the positions in the screen AA.

The timing controller 303 may change the pulse width of the scan signal supplied to the pixels on the basis of a result obtained by sensing the sensing period Ts in real time. In response to the raw data received from the sensing unit 230, the timing controller 303 reduces the pulse width of the shift clock GCLK synchronized with the scan signal supplied to pixels close to the drive IC 300 to be smaller than the pulse width of the shift clock GCLK synchronized with the scan signal supplied to pixels far from the drive IC 300.

The position of a pixel having the smallest sensing period Ts may be farthest from the drive IC 300 and may be the position Top of the screen AA where the RC delay of the shift clock GCLK is largest. Conversely, the position of a pixel having the largest sensing period Ts may be closest to the drive IC 300 and may be the position Bottom of the screen AA where the RC delay of the shift clock GCLK is smallest. The timing controller 303 gradually decreases the pulse width of the shift clock GCLK in a direction from the position Top of the screen AA to the position Bottom of the screen AA. The pulse width of the shift clock GCLK defines the sensing period Ts. Accordingly, the timing controller 303 may perform control such that the sensing periods TS of all the pixels of the screen AA are equal by receiving a sensing result of the sensing period input from the sensing unit 230 and changing the pulse width of the shift clock GCLK.

The level shifter 307 converts the low-level voltage of the shift clock GCLK input from the timing controller 303 into the gate-on voltage VGL, converts the high-level voltage of the shift clock GCLK into the gate-off voltage VGH, and supplies the shift clock GCLK to the shift clock line 51. When the shift clock GCLK is input through the shift clock line 51, the gate driving unit 120 outputs a gate signal to the gate lines. The gate signal includes a scan signal defining the sensing period Ts.

The timing controller 303 may change the pulse width of the shift clock GCLK using a lookup table (LUT).

Figure 33:
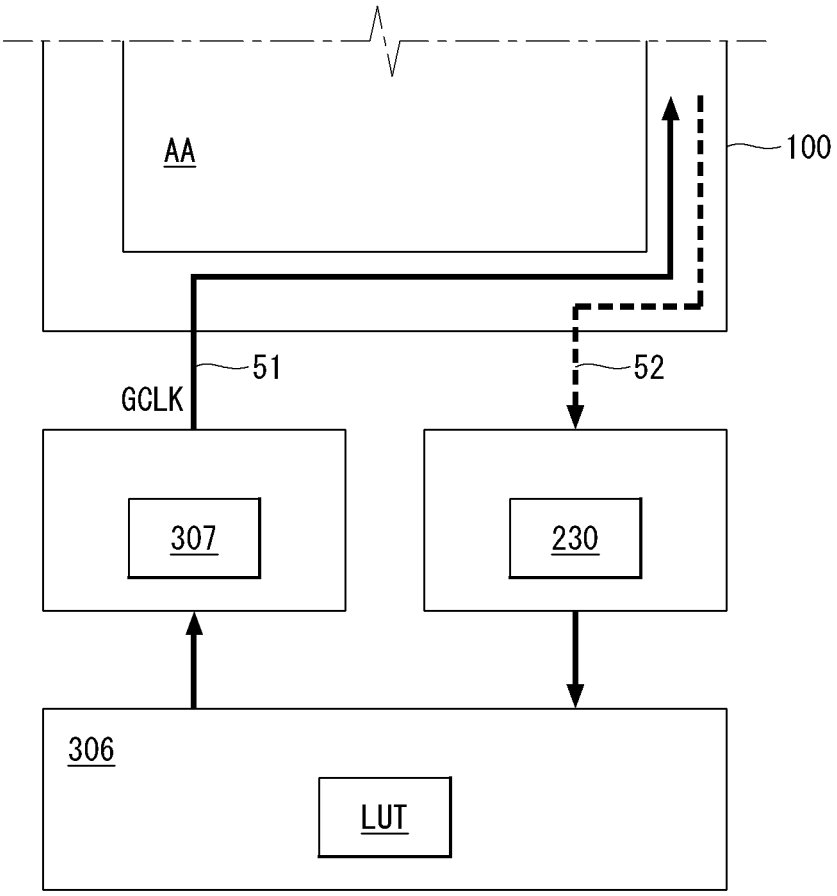
FIG. 33 is a diagram showing a device that modulates a pulse width of a shift clock using a lookup table and a sensing unit.
Figure 34:
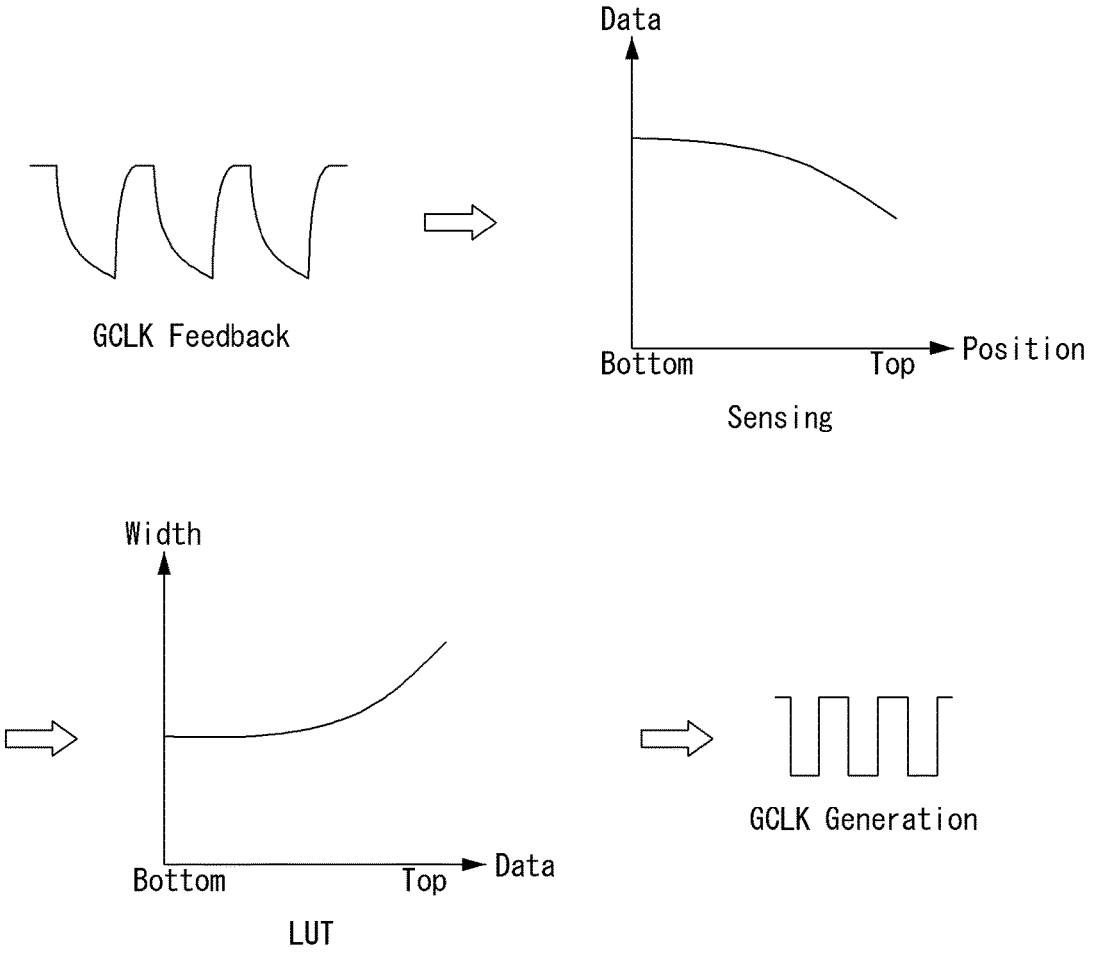
FIG. 34 is a diagram showing a device that modulates a pulse width of a shift clock using a lookup table and a sensing unit.

FIGS. 33 and 34 are diagrams showing a device that modulates a pulse width of a shift clock GCLK using the lookup table LUT and the sensing unit 230.

Referring to FIGS. 33 and 34, the timing controller 303 may include the lookup table LUT.

The raw data output from the sensing unit 230 indicates the pulse width of the shift clock GCLK in which the RC delay is reflected. In FIG. 34, "SENSING" represents the input and output of the sensing unit 230. The x-axis represents a screen position, and the y-axis represents raw data output from the sensing unit 230.

The raw data has the smallest value at the position Top because the low-level interval of the shift clock GCLK is smallest at the position Top where the RC delay is largest. The raw data has the largest value at the position Bottom because the low-level interval of the shift clock GCLK is largest at the position Bottom where the RC delay is smallest. Accordingly, the raw data input from the sensing unit 230 to the lookup table LUT has a smaller value as the raw data is farther from the drive IC 300.

As shown in FIG. 34, the lookup table LUT receives the raw data from the sensing unit 230 and outputs a compensation pulse width. In a graph defining the input and output of the lookup table LUT, the x-axis represents raw data input to the lookup table LUT, and the y-axis represents a compensation pulse width output from the lookup table LUT.

When the raw data is input from the sensing unit 230, the lookup table LUT outputs a compensation pulse width which is indicated by the value of the raw data. Since the pulse of the shift clock GCLK has substantially the same pulse width as the scan signal SCAN, the sensing periods TS of the pixels P are sensed. Accordingly, the lookup table LUT outputs a compensation pulse width for performing control such that the sensing periods TS of all the pixels P of the screen AA are equal in response to the sensing periods TS of the pixels P sensed by the sensing unit 230 in real time.

The timing controller 303 may generate the shift clock GCLK with the compensation pulse width output from the lookup table LUT.

Figure 35:
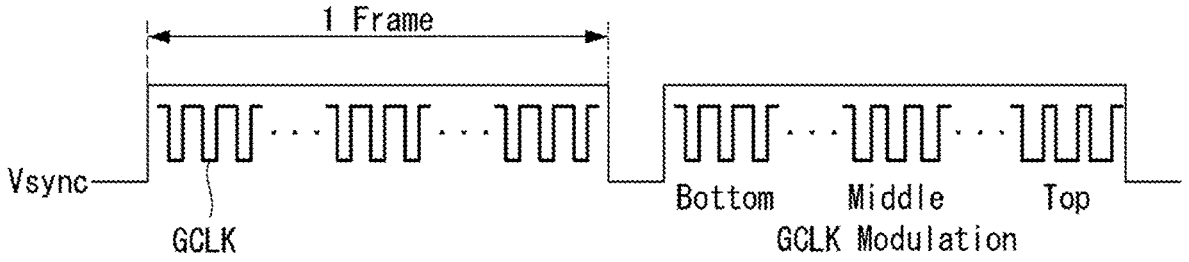
FIG. 35 is a waveform diagram showing an example of a shift clock with a pulse width modulated for each position in a screen during one frame period.

FIG. 35 is a waveform diagram showing an example of a shift clock with a pulse width modulated for each position in a screen during one frame period.

Referring to FIG. 35, during the active interval AT defining the vertical period of the screen AA in one frame period, the timing controller 303 changes the pulse width of the shift clock GCLK such that the sensing periods TS of the pixels P are equal. The shift clock GCLK increases in a direction farther from the drive IC 300. For example, the pulse width of the shift clock GCLK is smallest at the position Bottom and increases in a direction toward the position Top, as shown in FIGS. 32 and 35.

Figure 36:
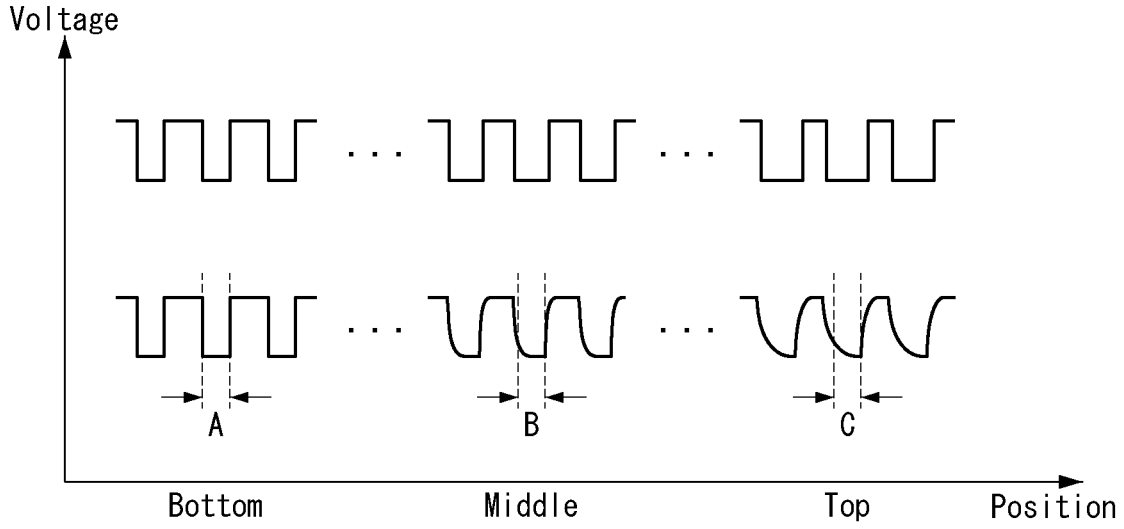
FIG. 36 is a waveform diagram showing a sensing period for each position in a screen and a shift clock applied to pixels.
Figure 36:
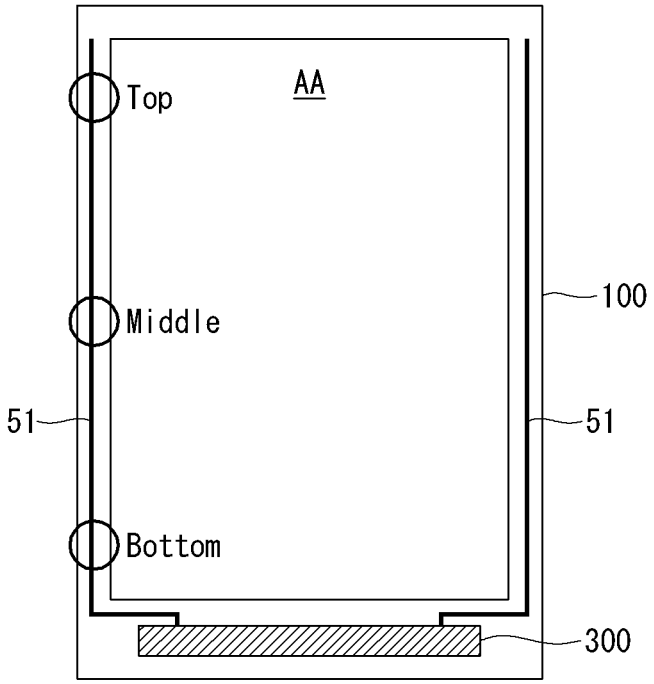

FIG. 36 is a waveform diagram showing sensing periods A, B, and C of positions in the screen AA and the shift clock GCLK applied to the pixels P. In FIG. 36, an upper waveform is an output waveform of the shift clock GCLK measured at the output node of the level shifter 307 which has no RC delay. A lower waveform is a waveform of the shift clock GCLK which is applied to the shift clock line 51 and in which the RC delay is reflected. A, B, and C indicate the sensing periods TS for the screen positions corresponding to the change in pulse width of the shift clock GCLK.

As can be seen in FIG. 36, according to the present disclosure, by adaptively changing the pulse width of the shift clock GCLK on the basis of a result of sensing the feedback signal in real time, it is possible to perform control such that the sensing periods A, B, and C of all the pixels P of the screen AA are substantially equal even if the RC delay deviation of the shift clock GCLK is large on the display panel 100. Accordingly, according to the present disclosure, it is possible to reduce an increase in luminance in a direction farther from the drive IC 300 in the screen AA.

By changing the gate-on voltage VGL of the shift clock GCLK on the basis of a result of sensing the feedback signal in real time, the timing controller 303 may accurately sense the threshold voltage Vth of the driving element DT in all the pixels P of the screen AA even if the sensing periods TS are insufficient.

FIGS. 37 to 42 are diagrams showing a screen-position-based sensing period control method according to a second aspect of the present disclosure.

Figure 37:
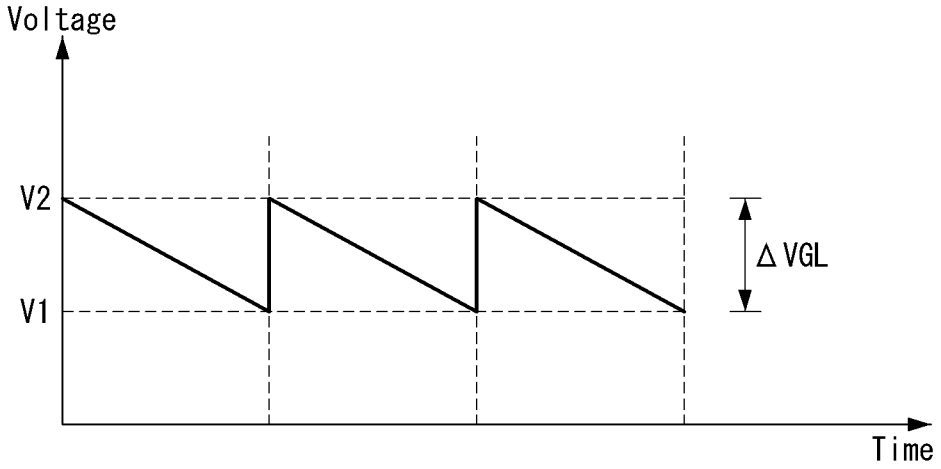
FIG. 37 is a waveform diagram showing a change in a gate-on voltage applied to a display panel along the time axis.

FIG. 37 is a waveform diagram showing a change in the gate-on voltage VGL applied to the display panel 100 along the time axis. The waveform of FIG. 37 indicates the gate-on voltage VGL input to the level shifter 307.

Referring to FIG. 37, when the gate-on voltage VGL of the shift clock GCLK decreases, on-current of the switch elements T2 and T11 increases as shown in FIGS. 14A and 17A. As a result, in FIGS. 14A and 17A, the voltages of the second nodes n2 and n12 quickly reach the threshold voltage Vth of the driving element DT, and thus the threshold voltage Vth of the driving element DT may be sensed even if the sensing period Ts is insufficient. Also, when the gate-on voltage VGL of the shift clock GCLK decreases, a rising edge time, which is the time it takes to reach the gate-on voltage VGL, decreases, and thus the sensing period Ts may increase. Accordingly, according to the present disclosure, by decreasing the gate-on voltage VGL of the shift clock GCLK, it is possible to sense the threshold voltage Vth of the driving element DT for all the pixels of the screen AA within the sensing period Ts even if there is a deviation in the sensing period Ts for each position in the screen AA.

The timing controller 303 gradually decreases (or increases) the gate-on voltage VGL of the shift clock GCLK within one frame period. The amount of RC delay of the shift clock GCLK increases and thus the sensing period decreases in a direction farther from the drive IC 300. Thus, the gate-on voltage VGL may be the lowest voltage V1 at the position Top. Since there is no RC delay of the shift clock GCLK at a position closest to the drive IC 300, the gate-on voltage VGL may be the highest voltage V2 at the position Bottom. In this example, a voltage difference ΔVGL of the gate-on voltage VGL input to the level shifter 307 is a maximum of V2−V1 within one frame period.

According to the scan direction of the screen AA, the gate-on voltage VGL may gradually rise or fall within one frame period. When the pixels of the screen AA are scanned from the position Bottom to the position Top, the gate-on voltage VGL as shown in FIG. 37 may gradually decrease from V2 to V1 during one frame period, and the change may be made in the same way at every frame. When the pixels of the screen AA are scanned from the position Top to the position Bottom, the gate-on voltage VGL may gradually increase from V1 to V2 during one frame period, and the change may be made in the same way at every frame.

Figure 38A:
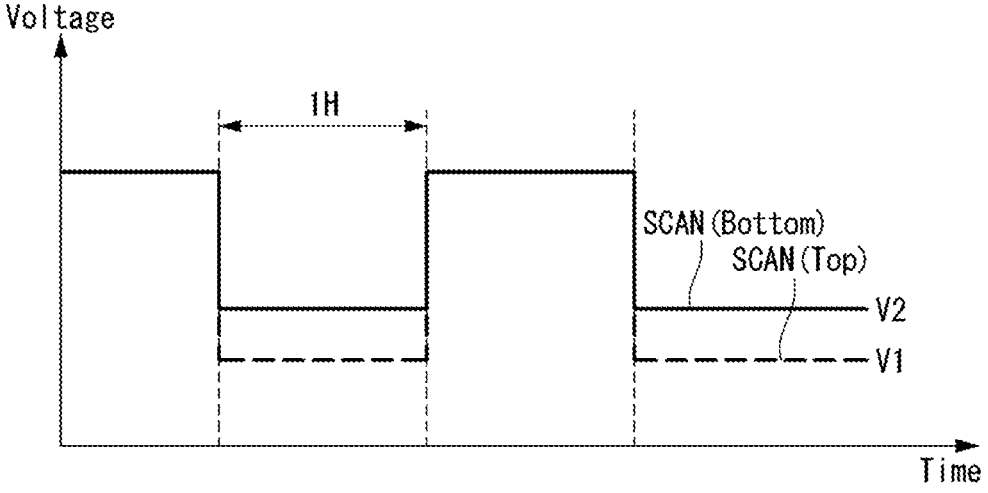
FIG. 38A is a waveform diagram showing a shift clock measured at an output node of a level shifter.
Figure 38B:
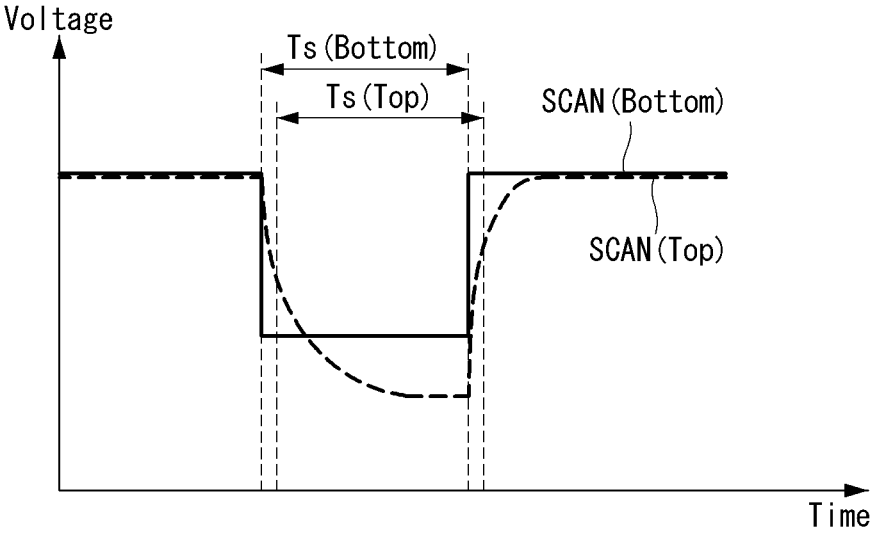
FIG. 38B is a waveform diagram showing a waveform of a shift clock in which a resistor-capacitor (RC) delay is reflected when a shift clock as shown in FIG. 38A is applied to a shift clock line on a display panel.
Figure 38B:
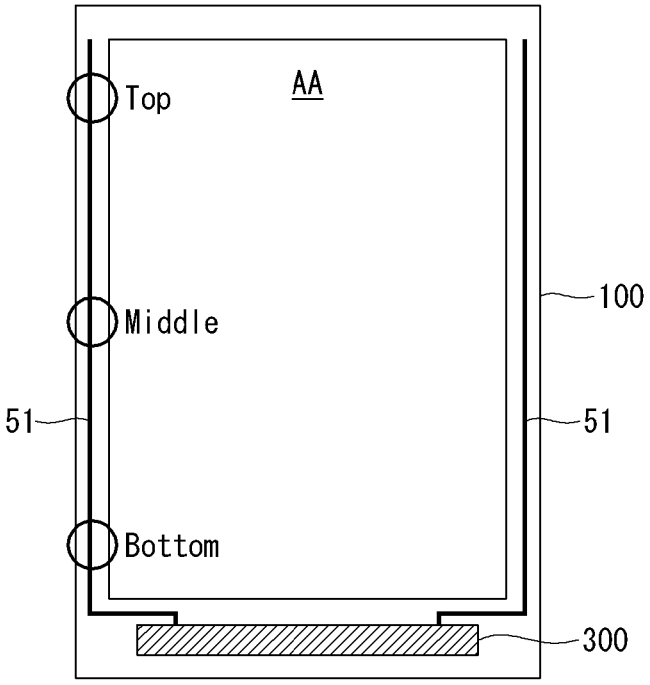

FIG. 38A is a waveform diagram showing a shift clock GCLK measured at an output node of the level shifter 307. FIG. 38B is a waveform diagram showing a waveform of the shift clock GCLK in which an RC delay is reflected when the shift clock GCLK as shown in FIG. 38A is applied to the shift clock line 51 of the display panel 100.

Referring to FIGS. 38A and 38B, the timing controller 303 may receive raw data from the sensing unit 230 and determine a difference between the sensing periods TS for the positions in the screen AA.

The timing controller 303 performs control such that the gate-on voltage VGL of the shift clock GCLK, which is synchronized with a scan signal supplied to pixels having the smallest sensing period Ts, is the lowest voltage on the basis of the result of sensing the sensing period Ts in real time. The timing controller 303 performs control such that the gate-on voltage VGL of the shift clock GCLK, which is synchronized with a scan signal supplied to pixels having large sensing periods Ts, is a relatively high voltage.

The position of a pixel having the smallest sensing period Ts may be farthest from the drive IC 300 and may be the position Top of the screen AA where the RC delay of the shift clock GCLK is largest. Conversely, the position of a pixel having the largest sensing period Ts may be closest to the drive IC 300 and may be the position Bottom of the screen AA where the RC delay of the shift clock GCLK is smallest. The timing controller 303 gradually decreases the gate-on voltage VGL of the shift clock GCLK in a direction from the position Bottom of the screen AA to the position Top of the screen AA. The timing controller 303 receives a result of sensing the sensing period input from the sensing unit 230 and changes the gate-on voltage VGL of the shift clock GCLK. As a result, the threshold voltage Vth of the driving element DT may be sensed within the sensing period Ts, and the sensing periods TS of all the pixels of the screen AA may be equal as shown in FIG. 38B.

The timing controller 303 may change the gate-on voltage VGL of the shift clock GCLK using the lookup table LUT and the DAC.

Figure 39:
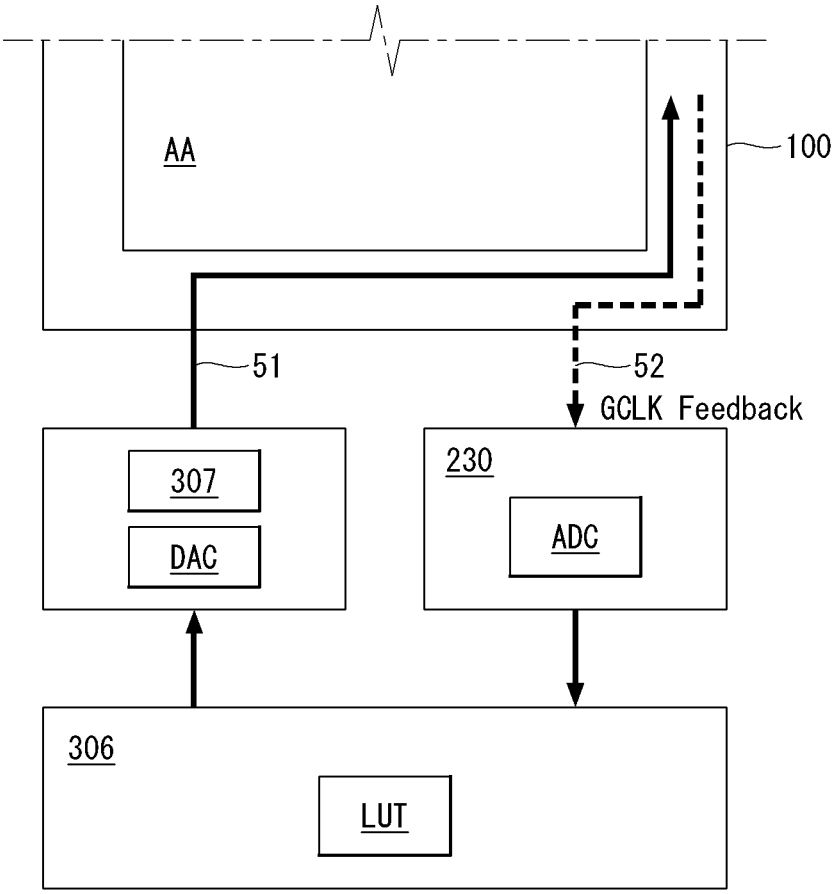
FIG. 39 is a diagram showing a device that modulates a gate-on voltage of a shift clock using a lookup table and a sensing unit.
Figure 40:
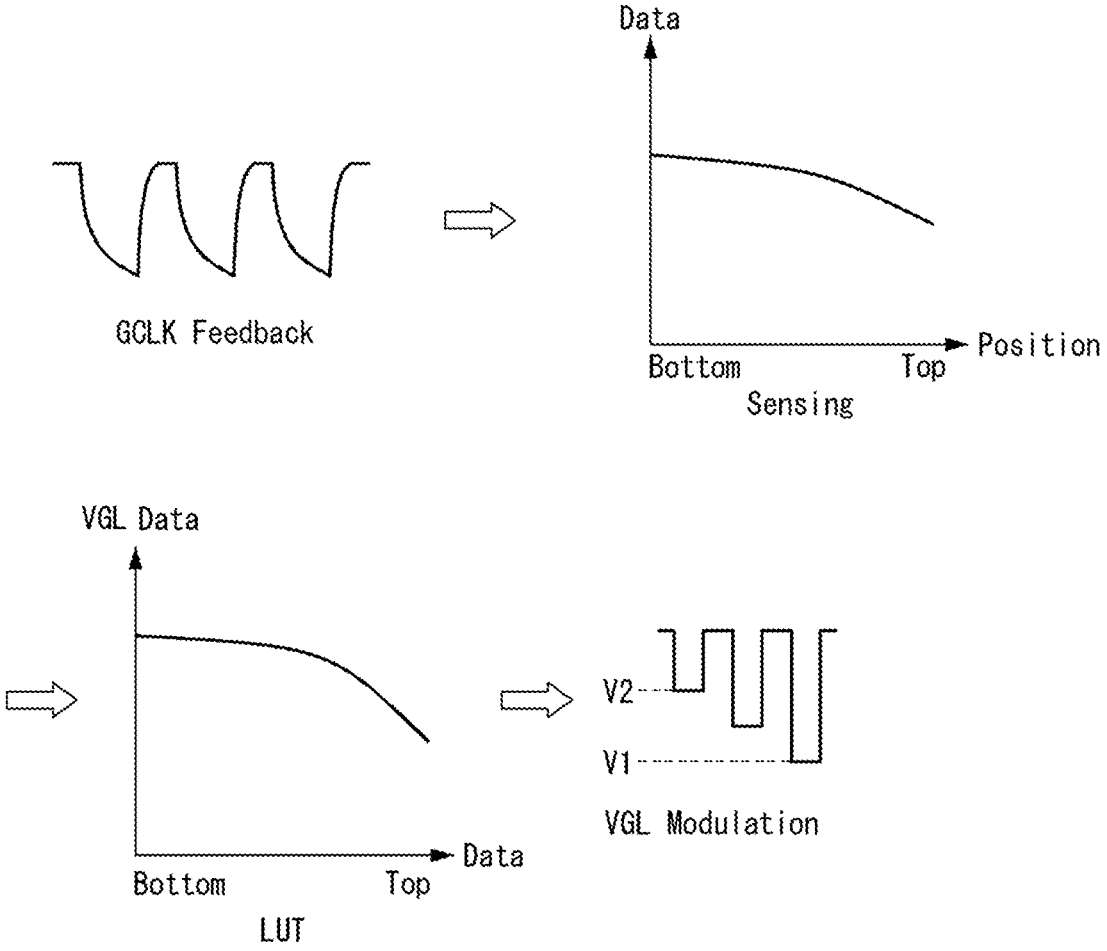
FIG. 40 is a diagram showing a device that modulates a gate-on voltage of a shift clock using a lookup table and a sensing unit.

FIGS. 39 and 40 are diagrams showing a device that modulates the gate-on voltage of the shift clock using a lookup table and a sensing unit.

Referring to FIGS. 39 and 40, the drive IC 300 may further include a DAC connected between the timing controller 303 and the level shifter 307. The timing controller 303 may include a lookup table LUT.

The sensing unit 230 converts a feedback signal received through the feedback line 52 into digital data through an ADC and outputs raw data. The raw data output from the sensing unit 230 indicates the pulse width of the shift clock GCLK in which the RC delay is reflected. The raw data has the smallest value at the position Top because the low-level interval of the shift clock GCLK is smallest at the position Top where the RC delay is largest. The raw data has the largest value at the position Bottom because the low-level interval of the shift clock GCLK is largest at the position Bottom where the RC delay is smallest. Accordingly, the raw data input from the sensing unit 230 to the lookup table LUT has a smaller value as the raw data is farther from the drive IC 300.

Since the pulse of the shift clock GCLK has substantially the same pulse width as the scan signal SCAN, the sensing periods TS of the pixels P are defined.

As shown in FIG. 40, the lookup table LUT receives the raw data from the sensing unit 230 and outputs VGL data defining the voltage level of the gate-on voltage VGL. In a graph defining the input and output of the lookup table LUT shown in FIG. 40, the x-axis represents raw data input from the sensing unit 230 to the lookup table LUT, and the y-axis represents VGL data output from the lookup table LUT. When the raw data is input from the sensing unit 230, the lookup table LUT outputs VGL data which is indicated by the value of the raw data.

The DAC converts the VGL data input from the lookup table LUT into an analog voltage. The analog voltage includes a high-level voltage and a low-level voltage lower than the high-level voltage. The low-level voltage has a voltage level within a voltage range corresponding to a data range of the VGL data output from the lookup table.

The level shifter 307 converts the low-level voltage of an input voltage received from the DAC into a variable gate-on voltage VGL. The level shifter 307 outputs a voltage closer to V1 when the low-level voltage of the input voltage is lower and outputs a voltage closer to V2 when the low-level voltage of the input voltage is higher. The level shifter 307 converts the high-level voltage of the input voltage into the gate-off voltage VGH higher than V2 and supplies the gate-off voltage VGH to the shift clock line 51. When the shift clock GCLK is input through the shift clock line 51, the gate driving unit 120 outputs a gate signal to the gate lines. The gate signal includes a scan signal defining the sensing period Ts.

Figure 42:
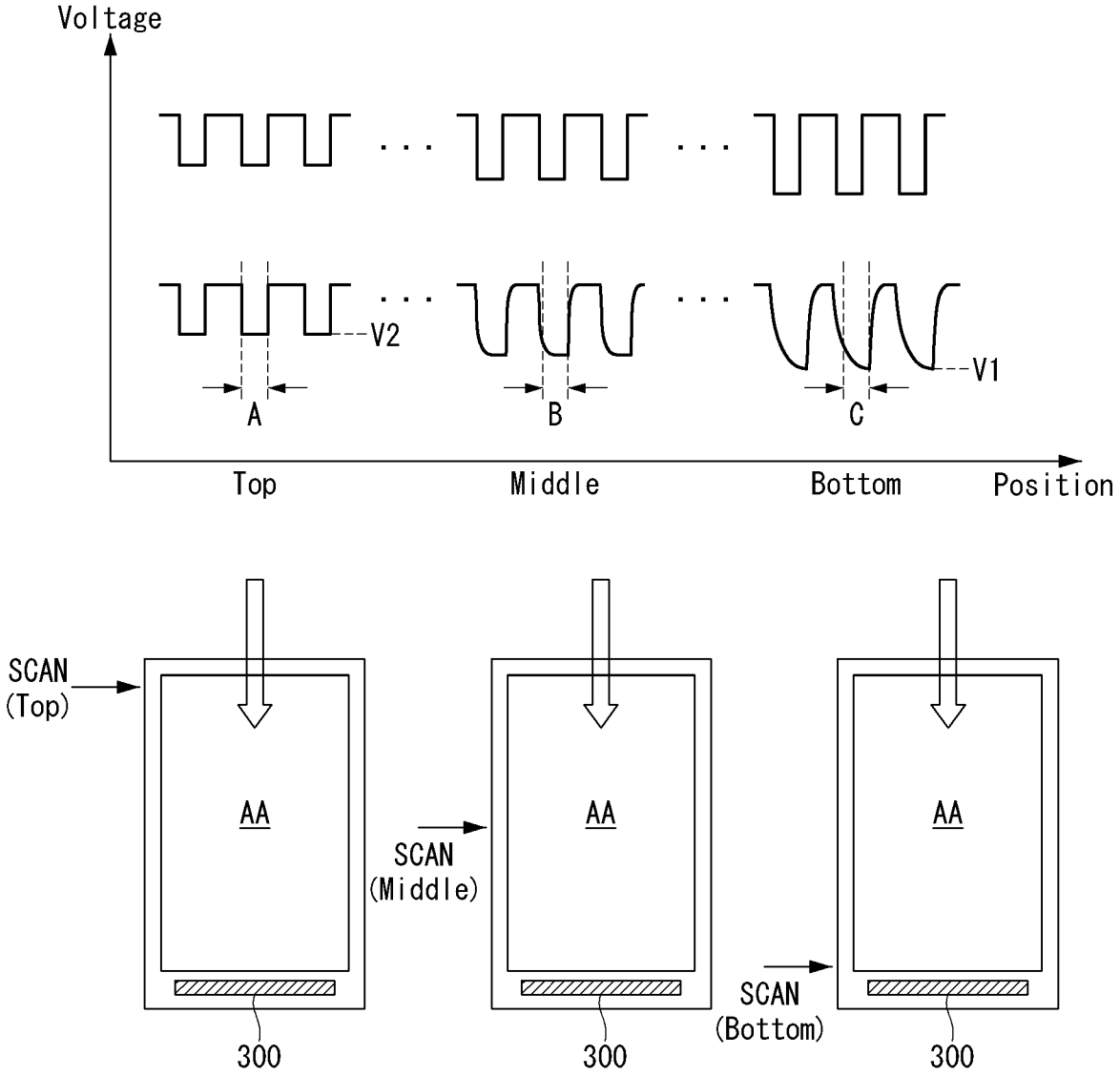
FIG. 42 is a diagram illustrating a gate-on voltage with a voltage level different for each position in a screen.

FIGS. 41 and 42 are diagrams illustrating a gate-on voltage with a voltage level varying depending on a screen position. In FIG. 41, Vertical Count of the left column represents a pixel line number of vertical resolution.

Referring to FIGS. 41 and 42, A, B, and C are sensing periods TS for positions in a screen. The gate-on voltage VGL of the scan signal applied to the pixels P varies depending on the position in the screen AA. The gate-on voltage VGL of the scan signal is substantially the same as the gate-on voltage VGL of the shift clock GCLK. According to the present disclosure, by changing the gate-on voltage VGL of the shift clock GCLK according to a sensing period which is sensed for each positioning the screen AA in real time on the basis of a feedback signal, the pulse width and the gate-on voltage VGL of the scan signal are changed.

The gate-on voltage VGL applied to pixels at the position Top farthest from the drive IC 300 is the lowest voltage V1. The gate-on voltage VGL applied to pixels at the position Bottom closest to the drive IC 300 is a relatively high voltage V2. The gate-on voltage VGL of the scan signal may gradually decrease in a direction from the position Bottom of the screen AA to the position Top of the screen AA. In FIG. 41, V1 and V2 may be −8.00 V and −7.50 V, respectively. However, the present disclosure is not limited thereto.

According to the present disclosure, by adaptively changing the gate-on voltage VGL of the shift clock GCLK on the basis of a result of sensing a feedback signal in real time, it is possible to minimize deviations of the sensing periods A, B, and C for all the pixels P of the screen AA even if an RC delay deviation of the shift clock GCLK is significantly great on the display panel 100. Accordingly, according to the present disclosure, it is possible to reduce an increase in luminance in a direction farther from the drive IC 300 in the screen AA.

According to another aspect of the present disclosure, by changing the pixel driving voltage VDD depending on grayscale levels as well as changing the voltage and/or the pulse width of the scan signal or the shift clock for each position in the screen AA, it is possible to further improve luminance uniformity.

Figure 43:
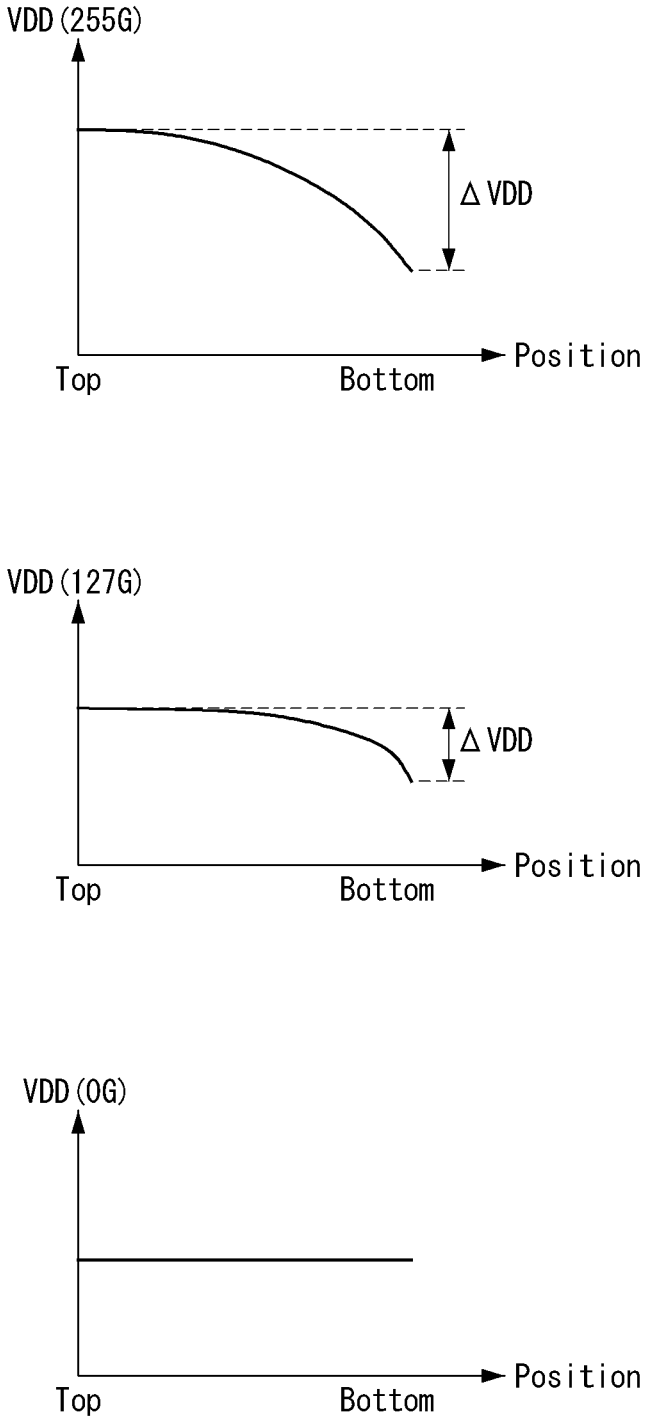
FIG. 43 is a diagram showing an example in which a pixel driving voltage varies depending on grayscale levels.

FIG. 43 is a diagram showing an example in which the pixel driving voltage VDD varies depending on grayscale levels.

Referring to FIG. 43, in the case of the high grayscale level of 255G in the organic light-emitting display device, the amount of IR drop of VDD increases because the amount of current flowing through the pixels P is large. In the high grayscale level of 255G, the amount of IR drop of VDD increases in a direction toward the position Top farthest from the drive IC 300. In the high grayscale level of 255G, the deviation of the amount of IR drop on the screen AA is large.

In order to compensate for the deviation of the amount of IR drop of VDD, the power supply unit 304 increases the voltage VDD in a direction toward the position Top as shown in the upper graph of FIG. 43 under the control of the timing controller 303. The timing controller 303 may control the voltage output from the power supply unit 304 by using the gain of VDD. The timing controller 303 may increase the voltage VDD by increasing the gain multiplied by VDD and may decrease the voltage VDD by decreasing the gain.

In the middle grayscale level of 127G, the amount of IR drop of VDD increases in a direction toward the position Top farthest from the drive IC 300. The deviation of the amount of IR drop on the screen AA is smaller in the middle grayscale level of 127G than in the high grayscale level of 255G. In order to compensate for the deviation of the amount of IR drop of VDD, the power supply unit 304 increases the voltage VDD in a direction toward the position Top as shown in the middle graph of FIG. 43 under the control of the timing controller 303. The timing controller 303 may control the voltage output from the power supply unit 304 by using the gain of VDD. The variable range of the gain is set to be smaller in the middle grayscale level of 127G than in the high grayscale level of 255G.

In the high grayscale level of 255G and the middle grayscale level of 127G, VDD output from the power supply unit 304 varies within one frame period. Accordingly, the gain used to adjust the voltage VDD varies within one frame period in the high grayscale level of 255G and the middle grayscale level of 127G.

In the case of the low grayscale level of 0G in the organic light-emitting display device, the amount of IR drop of VDD is small because the amount of current flowing through the pixels P is small. In particular, in the case of a grayscale level 0 (0G), the IR drop of VDD is minimized. In the low grayscale level of 0G, VDD output from the power supply unit 304 does not vary. Accordingly, in the case of the low grayscale level of 0G, the gain is fixed at a specific value.

Figure 46:
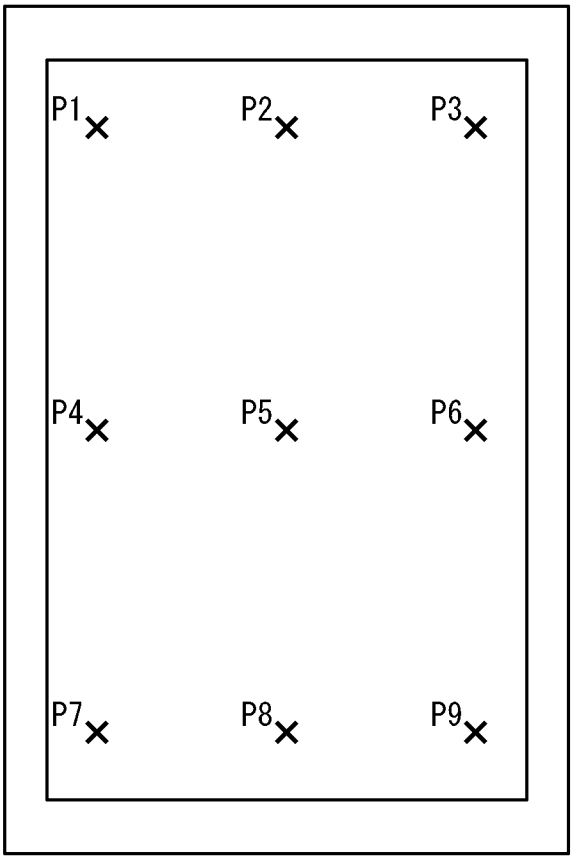
FIG. 46 is a diagram showing the luminance measurement positions of on a screen.

FIG. 44 is a diagram of a luminance measurement result showing an improvement in luminance uniformity of a screen at higher grayscale levels when the pixel driving voltage (VDD) and the gate-on voltage (VGL) are modulated in the same way as an aspect of the present disclosure. FIG. 45 is a diagram of a luminance measurement result showing an improvement in luminance uniformity of a screen at lower grayscale levels when the pixel driving voltage (VDD) and the gate-on voltage (VGL) are modulated in the same way as an aspect of the present disclosure. FIG. 46 is a diagram showing the luminance measurement positions of FIGS. 44 and 45 on a screen. In FIGS. 44 and 45, x and y are xy color coordinate values.

Referring to FIGS. 44 to 46, the present inventor measured luminance (NIT) and color coordinates of first and second target samples at nine positions P1 to P6 of the screen.

In FIGS. 44 and 45, "VDD & VGL Fixation" represents a first target sample (a comparative sample). "VDD+VGL Modulation" represents a second target sample (a sample to which the present disclosure is applied). The first and second target samples are display panels of the organic light-emitting display device. FIG. 44 shows the luminance and color coordinates measured at nine positions P1 to P9 when a white image pattern of the high grayscale level of 255G is displayed on a screen. FIG. 44 shows the luminance and color coordinates measured at nine positions P1 to P9 when an image pattern of the high grayscale level of 255G is displayed on a screen. FIG. 45 shows the luminance and color coordinates measured at nine positions P1 to P9 when an image pattern of the low grayscale level of 31G is displayed on a screen.

For the first target sample, the gate-on voltage VGL of the scan signal and the pixel driving voltage VDD were fixed regardless of the position and grayscale of the screen.

For the second target sample, the pixel driving voltage VDD varies depending on positions and grayscale levels in the screen AA, as shown in FIG. 43. Also, for the second target sample, the gate-on voltage VGL of the scan signal varies depending on positions and grayscale levels in the screen AA in the same way as shown in FIGS. 37 to 42. The luminance was measured at nine positions P1 to P6 of a sample to be used for luminance measurement.

As can be seen from FIG. 44, the luminance uniformity in the screen AA in the case of a comparative example at the high grayscale level (VDD & VGL Fixation) is 85.30%. On the other hand, in the case of the present disclosure (VDD+VGL Modulation), the luminance uniformity was increased to 95.02%. The luminance uniformity is a value obtained by dividing a minimal luminance value MIN by a maximal luminance value MAX.

As can be seen from FIG. 45, the luminance uniformity in the screen AA in the case of a comparative example at the low grayscale level (VDD & VGL Fixation) is 71.39%. On the other hand, in the case of the present disclosure (VDD+VGL Modulation), the luminance uniformity was increased to 95.05%. In particular, according to the present disclosure, it was possible to obtain an image enhancement effect in which luminance uniformity was almost similar for grayscale levels.

The display device and the driving method thereof according to the present disclosure may be described as follows.

The display device of the present disclosure includes a display panel in which data lines and gate lines intersect each other and in which pixels are disposed in a matrix form; a gate driving unit formed on the display panel and configured to supply a scan signal to the gate lines; a shift clock line formed on the display panel and configured to supply a shift clock to the gate driving unit; a sensing device configured to receive a feedback signal for a pulse signal supplied to the display panel and sense a pulse width of the scan signal; and a driving device configured to supply a data voltage to the data lines and generate the shift clock. The driving device changes one or both of a pulse width of the shift clock and a pulse voltage of the shift clock for each screen position of the display panel in response to a pulse width of the feedback signal sensed by the sensing device in real time.

The pulse voltage of the shift clock and a pulse voltage of the scan signal are the same gate-on voltage. Each of the pixels includes one or more pixel switch elements that are turned on according to the gate-on voltage.

The pulse signal supplied to the display panel includes the shift clock supplied to the shift clock line.

The sensing device includes a feedback line connected to the gate driving unit and includes a sensing unit configured to compare the feedback signal input through the feedback line to a predetermined reference voltage, detect a voltage interval having voltages less than or equal to the reference voltage from the feedback signal as the pulse width of the feedback signal, and output digital data indicating the pulse width of the feedback signal.

The gate driving unit includes a shift register configured to receive a start pulse and the shift clock and sequentially shift and output the scan signal. The shift register includes stages connected in cascade. The stages include a pull-up transistor turned on according to a voltage of a Q node and configured to charge an output node connected to the gate lines with a gate-on voltage. The pixels include one or more pixel switch elements that are turned on according to the gate-on voltage.

The sensing device further includes a feedback transistor turned on according to the voltage of the Q node and configured to connect the shift clock line to the feedback line.

The feedback transistor is connected to each of the stages or connected to at least two stages spaced a predetermined distance from each other.

The display panel further includes an enable line configured to receive an enable signal from the driving unit; a test data line configured to receive a pulse signal from the driving unit; and a switch element turned on in response to the enable signal and configured to supply the pulse signal to one of the data lines.

The pulse signal supplied to the display panel includes the pulse signal supplied to the test data line.

The sensing device includes a data line through which the pulse signal is supplied through a switch element and includes a sensing unit configured to compare the pulse signal input through the data line to a predetermined reference voltage, detect a voltage interval having voltage less than or equal to the reference voltage from the feedback signal as the pulse width of the feedback signal, and output digital data indicating the pulse width of the feedback signal.

The driving device includes a timing controller configured to reduce the pulse width of the shift clock synchronized with the scan signal supplied to pixels close to the driving device to be smaller than the pulse width of the shift clock synchronized with the scan signal supplied to pixels far from the driving device in response to digital data received from the sensing device.

The driving device includes a level shifter configured to convert the pulse voltage of the shift clock output from the timing controller into a gate-on voltage. The pixels include one or more pixel switches that are turned on according to the gate-on voltage.

The driving device changes the pulse width of the shift clock using a lookup table in which a compensation pulse width corresponding to a pulse width value of the digital data received from the sensing device is defined.

The driving device reduces a voltage of the shift clock synchronized with the scan signal supplied to pixels close to the driving device to be lower than a voltage of the shift clock synchronized with the scan signal supplied to pixels far from the driving device in response to digital data received from the sensing device.

The driving device includes a timing controller configured to output digital data changing the pulse voltage of the shift clock according to positions of the pixels in response to the digital data received from the sensing device.

The driving device includes a digital-to-analog converter configured to convert the digital data received from the timing controller into an analog voltage, and a level shifter configured to convert a voltage received from the digital-to-analog converter into a gate-on voltage. The pixels include one or more pixel switches that are turned on according to the gate-on voltage.

Each of the pixels includes a light-emitting element, a driving element configured to adjust current flowing through the light-emitting element according to a gate-source voltage, and an internal compensation circuit configured to sense a threshold voltage of the driving element in a sensing period defined by a pulse of the scan signal and configured to supply the threshold voltage to a capacitor.

The internal compensation circuit includes a capacitor connected to a gate of the driving element and includes one or more switch elements configured to connect the capacitor, the driving element, and the light-emitting element. The switch element is turned on according to the pulse voltage of the scan signal.

The driving device changes the pixel driving voltage according to positions of the pixels.

In a high grayscale level and a middle grayscale level of pixel data written to the pixels, the driving device increases and outputs a pixel driving voltage supplied to pixels far from the driving device to be larger than a pixel driving voltage supplied to pixels close to the driving device.

In a low grayscale level of the pixel data written to the pixels, the driving device outputs the pixel driving voltage supplied to the pixels far from the driving device to be equal to the pixel driving voltage supplied to the pixels close to the driving device.

A driving method of a display device including a display panel in which data lines and gate lines intersect each other and in which pixels are disposed in a matrix form, a gate driving unit formed on the display panel and configured to supply a scan signal to the gate lines, and a shift clock line formed on the display panel and configured to supply a shift clock to the gate driving unit includes receiving a feedback signal for a pulse signal supplied to the display panel and sensing a pulse width of the scan signal in real time; and changing one or both of a pulse width of the shift clock and a pulse voltage of the shift clock for each screen position of the display panel in response to the pulse width of the feedback signal sensed in real time.

The driving method further includes supplying a pixel driving voltage to the pixels and increasing a pixel driving voltage supplied to pixels far from the driving device to be larger than a pixel driving voltage supplied to pixels close to the driving device in a high grayscale level and a middle grayscale level of pixel data written to the pixels.

The driving method further includes making the pixel driving voltage supplied to the pixels far from the driving device equal to the pixel driving voltage supplied to the pixels close to the driving device in a low grayscale level of the pixel data written to the pixels.

The display device of the present disclosure senses a pulse width of a feedback signal for a pulse applied to a screen in real time and changes one or both of a pulse voltage and a pulse width of a shift clock according to the sensing result. As a result, it is possible to realize uniform image quality across the screen by accurately sensing electrical characteristics of the driving element in all pixels of an even display panel having an RC delay of a shift clock line.

It should be noted that the advantageous effects of the present disclosure are not limited to the above-described effects, and other effects that are not described herein will be apparent to those skilled in the art from the following claims.

While the aspects of the present disclosure have been described in detail above with reference to the accompanying drawings, the present disclosure is not limited to the aspects, and various changes and modifications may be made without departing from the technical spirit of the present disclosure. Accordingly, the aspects disclosed herein are to be considered descriptive and not restrictive of the technical spirit of the present disclosure, and the scope of the technical spirit of the present disclosure is not limited by the aspects. Therefore, it should be understood that the above aspects are illustrative rather than restrictive in all respects. The scope of the disclosure should be construed by the appended claims, and all technical spirits within the scopes of their equivalents should be construed as being included in the scope of the disclosure.

What is claimed is:

1. A display device comprising:

a display panel in which data lines and gate lines intersect each other and in which pixels are disposed in a matrix form;

a gate driving unit formed on the display panel and configured to supply a scan signal to the gate lines;

a shift clock line formed on the display panel and configured to supply a shift clock to the gate driving unit using a feedback transistor connected to the gate driving unit, a feedback line connected to the feedback transistor and a sensing unit;

a sensing device configured to receive a feedback signal supplied to the display panel and sense a pulse width of the scan signal, wherein the sensing device comprises:

the feedback transistor connected to the gate driving unit; and the feedback line connected to the feedback transistor and the sensing unit; and a drive integrated circuit configured to supply a data voltage to the data lines and generate the shift clock, wherein the drive integrated circuit changes at least one of a pulse width of the shift clock and a pulse voltage of the shift clock for each screen position of the display panel in response to a pulse width of the feedback signal sensed by the sensing device.

2. The display device of claim 1, wherein the pulse voltage of the shift clock and a pulse voltage of the scan signal are the same gate-on voltage, and wherein each of the pixels comprises one or more pixel switch elements that are turned on according to the gate-on voltage.

3. The display device of claim 1, wherein a pulse signal supplied to the display panel includes the shift clock supplied to the shift clock line.

4. The display device of claim 3, wherein the sensing unit is configured to compare the feedback signal input through the feedback line to a predetermined reference voltage, detect a voltage interval having voltages less than or equal to the predetermined reference voltage from the feedback signal as the pulse width of the feedback signal, and output digital data indicating the pulse width of the feedback signal.

5. The display device of claim 4, wherein the gate driving unit comprises a shift register configured to receive a start pulse and the shift clock and sequentially shift and output the scan signal, wherein the shift register comprises stages connected in cascade, wherein the stages comprise a pull-up transistor turned on according to a voltage of a Q node and configured to charge an output node connected to the gate lines with a gate-on voltage, and wherein the pixels comprise one or more pixel switch elements that are turned on according to the gate-on voltage.

6. The display device of claim 5, wherein the feedback transistor is turned on according to the voltage of the Q node and configured to connect the shift clock line to the feedback line.

7. The display device of claim 6, wherein the feedback transistor is connected to each of the stages or connected to at least two stages spaced a predetermined distance from each other.

8. The display device of claim 1, wherein the display panel further comprises:

an enable line configured to receive an enable signal from the drive integrated circuit;

a test data line configured to receive a pulse signal from the drive integrated circuit; and a switch element turned on in response to the enable signal and configured to supply the pulse signal to one of the data lines.

9. The display device of claim 8, wherein a pulse signal supplied to the display panel includes the pulse signal supplied to the test data line.

10. The display device of claim 9, wherein the sensing device comprises the data line through which the pulse signal is supplied through the switch element; and a sensing unit configured to compare the pulse signal input through the data line to a predetermined reference voltage, detect a voltage interval having voltages less than or equal to the predetermined reference voltage from the feedback signal as the pulse width of the feedback signal, and output digital data indicating the pulse width of the feedback signal.

11. The display device of claim 1, wherein the drive integrated circuit comprises a timing controller configured to reduce the pulse width of the shift clock synchronized with the scan signal supplied to pixels close to the drive integrated circuit to be smaller than the pulse width of the shift clock synchronized with the scan signal supplied to pixels far from the drive integrated circuit in response to digital data received from the sensing device.

12. The display device of claim 11, wherein the drive integrated circuit comprises a level shifter configured to convert the pulse voltage of the shift clock output from the timing controller into a gate-on voltage, and wherein the pixels comprise one or more pixel switches that are turned on according to the gate-on voltage.

13. The display device of claim 12, wherein the drive integrated circuit changes the pulse width of the shift clock using a lookup table in which a compensation pulse width corresponding to a pulse width value of the digital data received from the sensing device is defined.

14. The display device of claim 1, wherein the drive integrated circuit reduces a voltage of the shift clock synchronized with the scan signal supplied to pixels close to the drive integrated circuit to be lower than a voltage of the shift clock synchronized with the scan signal supplied to pixels far from the drive integrated circuit in response to digital data received from the sensing device.

15. The display device of claim 14, wherein the drive integrated circuit comprises a timing controller configured to output digital data changing the pulse voltage of the shift clock according to positions of the pixels in response to the digital data received from the sensing device.

16. The display device of claim 15, wherein the drive integrated circuit further comprises:

a digital-to-analog converter configured to convert the digital data received from the timing controller into an analog voltage; and a level shifter configured to convert a voltage received from the digital-to-analog converter into a gate-on voltage, and wherein the pixels comprise one or more pixel switches that are turned on according to the gate-on voltage.

17. The display device of claim 1, wherein each of the pixels comprises:

a light-emitting element;

a driving element including a gate, a source and a drain for adjusting current flowing through the light-emitting element according to a gate-source voltage; and an internal compensation circuit configured to sense a threshold voltage of the driving element in a sensing period defined by a pulse voltage of the scan signal and supply the threshold voltage to a capacitor, wherein the internal compensation circuit comprises:

the capacitor connected to the gate of the driving element; and one or more switch elements configured to connect the capacitor, the driving element, and the light-emitting element, and wherein at least one switch element of the one or more switch elements is turned on according to the pulse voltage of the scan signal.

18. The display device of claim 17, wherein, in a high grayscale level and a middle grayscale level of pixel data written to the pixels, the drive integrated circuit increases and outputs a pixel driving voltage supplied to pixels far from the drive integrated circuit to be larger than a pixel driving voltage supplied to pixels close to the drive integrated circuit.

19. The display device of claim 18, wherein, in a low grayscale level of the pixel data written to the pixels, the drive integrated circuit outputs the pixel driving voltage supplied to the pixels far from the drive integrated circuit to be equal to the pixel driving voltage supplied to the pixels close to the drive integrated circuit.

20. A driving method of a display device including a display panel in which data lines and gate lines intersect each other and in which pixels are disposed in a matrix form, a gate driving unit formed on the display panel and configured to supply a scan signal to the gate lines, and a shift clock line formed on the display panel and configured to supply a shift clock to the gate driving unit, the driving method comprising:

receiving a feedback signal for a pulse signal supplied to the display panel and sensing a pulse width of the scan signal; and changing at least one of a pulse width of the shift clock and a pulse voltage of the shift clock for each screen position of the display panel in response to a pulse width of the feedback signal.

* * * * *